US006420824B1

(12) United States Patent
Abe et al.

(10) Patent No.: US 6,420,824 B1
(45) Date of Patent: Jul. 16, 2002

(54) IMAGE FORMING APPARATUS

(75) Inventors: Naoto Abe, Yokohama; Masahiro Fushimi, Zama; Hideaki Mitsutake, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/391,531

(22) Filed: Sep. 8, 1999

Related U.S. Application Data

(62) Division of application No. 08/995,895, filed on Dec. 22, 1997, now Pat. No. 6,104,136.

(30) Foreign Application Priority Data

Dec. 25, 1996 (JP) ..... 8-346305

(51) Int. Cl.[7] ..... H01J 1/62; H01J 63/04

(52) U.S. Cl. ..... 313/495; 313/292; 313/496; 313/497

(58) Field of Search ..... 313/495, 292, 313/422, 496, 497, 308, 309, 336, 351, 355

(56) References Cited

U.S. PATENT DOCUMENTS

| | | | | |
|---|---|---|---|---|
| 4,904,895 A | | 2/1990 | Tsukamoto et al. | 313/336 |
| 5,066,883 A | | 11/1991 | Yoshioka et al. | 313/309 |
| 5,532,548 A | | 7/1996 | Spindt et al. | 313/422 |
| 5,614,781 A | | 3/1997 | Spindt et al. | 313/422 |
| 5,760,538 A | | 6/1998 | Mitsutake et al. | 313/422 |
| 5,821,689 A | | 10/1998 | Andoh et al. | 313/495 |
| 5,936,343 A | | 8/1999 | Fushimi et al. | 313/495 |
| 6,104,136 A | * | 8/2000 | Abe et al. | 313/495 |

FOREIGN PATENT DOCUMENTS

| | | |
|---|---|---|
| EP | 0 496 450 | 7/1993 |
| EP | 0 580 244 | 1/1994 |
| EP | 0 690 472 | 1/1996 |
| JP | 64-31332 | 2/1989 |
| JP | 2-257551 | 10/1990 |
| JP | 3-55738 | 3/1991 |
| JP | 4-28137 | 1/1992 |
| JP | 8-7811 | 1/1996 |
| JP | 8-180821 | 7/1996 |

* cited by examiner

*Primary Examiner*—Vip Patel
*Assistant Examiner*—Kevin Quarterman
(74) *Attorney, Agent, or Firm*—Fitzpatrick, Cella, Harper & Scinto

(57) ABSTRACT

An image forming apparatus includes a vacuum envelope and an electron emission element, an image forming member and a spacer disposed within the vacuum envelope. The spacer, which is disposed between electrodes to which mutually different voltages are applied within the vacuum vessel, has semiconductivity on a surface thereof faced to vacuum and a conductive member arranged to encircle the surface.

18 Claims, 45 Drawing Sheets

IMAGE FORMING APPARATUS

This application is a divisional of application Ser. No. 08/995,895, filed on Dec. 22, 1997, now U.S. Pat. No. 6,104,136.

BACKGROUND OF THE INVENTION

1. Field of the Invention

This invention relates to an image forming apparatus having electron emission elements and spacers in a vacuum envelope.

2. Description of the Related Art

Flat panel displays of large areas have been the focus of much research and development in recent years.

In general, an image forming apparatus using electrons is equipped with an envelope for maintaining a vacuum, electron sources and their drive circuitry for emitting electrons, an image forming member having phosphors or the like for emitting light owing to electron bombardment, accelerating electrodes for accelerating electrons toward the image forming member, and a high-voltage power supply for the accelerating electrodes. Further, in an image forming apparatus using a flat envelope as in the manner of a flat-panel display having a large screen area, there are cases where supporting columns (spacers) are disposed within the envelope as structures resistant to atmospheric pressure.

Two types of elements, namely thermionic cathode elements and cold cathode elements, are known as electron emission elements for constructing the electron sources mentioned above. Examples of cold cathode elements are surface-conduction electron emission elements, electron emission elements of the field emission type (abbreviated to "FE" below) and metal/insulator/metal type (abbreviated to "MIM" below).

An example of the surface-conduction electron emission element is described by M. I. Elinson, Radio. Eng. Electron Phys., 10 (1965). There other examples as well, as will be described later.

The surface-conduction electron emission element makes use of a phenomenon in which an electron emission is produced in a small-area thin film, which has been formed on a substrate, by passing a current parallel to the film surface. Various examples of this surface-conduction electron emission element have been reported. One relies upon a thin film of $SnO_2$ according to Elinson, mentioned above. Other examples use a thin film of Au [G. Dittmer: "Thin Solid Films", 9.317 (1972)]; a thin film of $In_2O_3/SnO_2$ (M. Hartwell and C. G. Fonstad: "IEEE Trans. E.D. Conf.", 519 (1975); and a thin film of carbon (Hisashi Araki, et al: "Vacuum", Vol. 26, No. 1, p. 22 (1983).

FIG. 45 is a plan view of the element according to M. Hartwell, et al., described above. This element construction is typical of these surface-conduction electron emission elements. As shown in FIG. 45, numeral 3001 denotes a substrate. Numeral 3004 denotes an electrically conductive thin film comprising a metal oxide formed by sputtering and is formed into a flat shape resembling the letter "H" in the manner illustrated. The conductive film 3004 is subjected to an electrification process referred to as "electrification forming", described below, whereby an electron emission portion 3005 is formed. The spacing L in FIG. 45 is set to 0.5~1 mm, and the spacing W is set to 0.1 mm. For the sake of illustrative convenience, the electron emission portion 3005 is shown to have a rectangular shape at the center of the conductive film 3004. However, this is merely a schematic view and the actual position and shape of the electron emission portion may be represented in other ways.

In the above-mentioned conventional surface-conduction electron emission elements, especially the element according to Hartwell, et al., generally the electron emission portion 3005 is formed on the conductive thin film 3004 by the so-called "electrification forming" process before electron emission is performed. According to the forming process, a constant DC voltage or a DC voltage which rises at a very slow rate on the order of 1 V/min is impressed across the conductive thin film 3004 to pass a current through the film, thereby locally destroying, deforming or changing the property of the conductive thin film 3004 and forming the electron emission portion 3005, the electrical resistance of which is very high. A fissure is produced in part of the conductive thin film 3004 that has been locally destroyed, deformed or changed in property. Electrons are emitted from the vicinity of the fissure if a suitable voltage is applied to the conductive thin film 3004 after electrification forming.

Known examples of the FE type are described in W. P. Dyke and W. W. Dolan, "Field Emission", Advance in Electron Physics, 8.89 (1956), and in C. A. Spindt, "Physical Properties of Thin-Film Field Emission Cathodes with Molybdenum Cones," J. Appl. Phys., 47, 5248 (1976).

A typical example of the construction of an FE-type element is shown in FIG. 46, which is a sectional view of the element according to Spindt, et al., described above. The element includes a substrate 3010, emitter wiring 3011 comprising an electrically conductive material, an emitter cone 3012, an insulating layer 3013 and a gate electrode 3014. The element is caused to produce a field emission from the tip of the emitter cone 3012 by applying an appropriate voltage across the emitter cone 3012 and gate electrode 3014.

In another example of the construction of an FE-type element, the stacked structure of the kind shown in FIG. 46 is not used. Rather, the emitter and gate electrode are arranged on the substrate in a state substantially parallel to the plane of the substrate.

A known example of the MIM type is described by C. A. Mead, "Operation of Tunnel Emission Devices," J. Appl. Phys., 32, 646 (1961). FIG. 47 is a sectional view illustrating a typical example of the construction of the MIM-type element. The element includes a substrate 3020, a lower electrode 3021 consisting of a metal, a thin insulating layer 3022 having a thickness on the order of 100 Å, and an upper electrode 3023 consisting of a metal and having a thickness on the order of 80~300 Å. The element is caused to produce an emission from the surface of the upper electrode 3023 by applying an appropriate voltage across the upper electrode 3023 and lower electrode 3021.

Since the above-mentioned cold cathode element makes it possible to obtain an electron emission element at a lower temperature in comparison with a thermionic cathode element, a heater for applying, heat is unnecessary. Accordingly, the structure is more simple than that of the thermionic cathode element, and it is possible to fabricate elements that are more slender. Further, even though a large number of elements are arranged on a substrate at a high density, problems such as fusing of the substrate do not readily arise. In addition, the cold cathode element differs from the thermionic cathode element in that the latter has a slow response speed because it is operated by heat produced by a heater. Thus, an advantage of the cold cathode element is a quicker response speed.

For these reasons, extensive research into applications for cold cathode elements is being carried out.

By way of example, among the various cold cathode elements, the surface-conduction electron emission element is particularly simple in structure and easy to manufacture and therefore is advantageous in that a large number of elements can be formed over a large area. Accordingly, research has been directed to a method of arraying and driving a large number of elements, as disclosed in Japanese Patent Application Laid-Open No. 64-31332, filed by the applicant.

Further, applications of surface-conduction electron emission elements that have been researched are image forming devices such as image display devices and image recording devices, as well as charged beam sources, etc.

As for applications to image display devices, research has been conducted with regard to such devices using, in combination, surface-conduction type electron emission elements and phosphors which emit light in response to irradiation with an electron beam, as disclosed, for example, in the specifications of U.S. Pat. No. 5,066,833 and Japanese Patent Application Laid-Open (KOKAI) Nos. 2-257551 and 4-28137 filed by the present applicant. The image display device using the combination of the surface-conduction type electron emission elements and phosphors is expected to have characteristics superior to those of the conventional image display device of other types. For example, in comparison with a liquid-crystal display device that has become so popular in recent years, the above-mentioned image display device emits its own light and therefore does not require back-lighting. It also has a wider viewing angle.

A method of driving a number of FE-type elements in a row is disclosed, for example, in the specification of U.S. Pat. No. 4,904,895 filed by the present applicant. A flat panel-type display apparatus reported by Meyer et al., for example, is known as an example of an application of an FE-type element to an image display apparatus. [R. Meyer: "Recent Development on Microtips Display at LETI", Tech. Digest of 4th Int. Vacuum Microelectronics Conf., Nagahara, pp. 6~9, (1991).]

An example in which a number of MIM-type elements are arrayed in a row and applied to an image display device is disclosed in the specification of Japanese Patent Application Laid-Open Nos. 3-55738 filed by the present applicant.

The inventors have experimented with cold cathode elements consisting of various materials manufactured by various methods and having a variety of structures. Furthermore, the inventors have investigated multiple electron beam sources, consisting of an array of a number of cold cathode elements, and image display devices which employ these multiple electron beam sources.

In a flat panel image display device, an electron emission element, an image forming member and various electrodes are placed within a vacuum envelope. The various electrodes include wiring electrodes for supplying the electron emission element with current, an accelerating electrode for applying a high voltage to the image forming member, and electrodes (a focusing electrode, modulating electrode, deflecting electrode, etc.) for controlling the electron beam. Of course, all of these electrodes are not necessarily required, and it will suffice if only the electrodes for controlling the electron beam are provided as necessary.

In such a flat panel image display device, mechanical strength capable of withstanding atmospheric pressure cannot readily be achieved by a vacuum envelope alone. For this reason, the general practice is to provide supporting columns (spacers) inside the vacuum envelope. However, a flat panel image display device of this kind has the following problems:

Specifically, the inventors have discovered cases where the light emitting position of the phosphor constituting the image forming member (the position bombarded by electrons) and the shape of the emitted light deviate from their design values.

In particular, when an image forming member for a color image is used, there are cases where a decline in brightness and the occurrence of a color shift arise along with a shift in the light emitting position. It has been confirmed that this phenomenon occurs in the vicinity of the supporting column (spacer) disposed between the electron source and the image forming member.

Further, the inventors have found that the prime cause of the aforementioned phenomenon is the electrons emitted from the electron source.

In the above-described image forming apparatus, the electrons emitted from the electron source bombard the phosphors constituting the image forming member as well as any gas remaining in the vacuum, although the probability of this occurring is low. It has been found that some scattered particles (ions, secondary electrons, neutral particles, etc.) produced at a certain probability at the time of these bombardments impact upon the exposed portion of the support column (spacer) within the image forming apparatus, thereby charging the exposed portion. Owing to the electric charge, the electric field changes in the vicinity of the exposed portion, thereby causing a shift in the path of the electrons. It is believed that this causes a change in the light emitting position of the phosphors and a change in the shape of the light emission.

Further, the inventors have found that mainly a positive charge accumulates at the exposed portion based upon the change in the light emitting position and the change in the shape of the light emission. The cause is believed to be either charging due to the accumulation of positive ions included among the scattered particles or the occurrence of positive charging owing to the emission of secondary electrons generated when the scattered particles bombard the exposed portion mentioned above.

In order to solve these problems, a method of preventing charging by covering the surface of the spacer with a resistive film is already known. According to this method, the ability to prevent charging is improved by reducing the electrical resistance of the resistive film. However, when the electrical resistance is made small, the current which flows in a steady state increases, thereby raising power consumption.

In a case where the surface of the spacer cannot be covered with the resistive film evenly, the current which flows through the resistive film develops a non-uniform distribution, resulting in an undesirable electric potential distribution being produced on the spacer surface. If this problem arises, the path of the electron beam is affected. Consequently, a shift in the light emitting position occurs, though the shift is not at serious as that caused when the spacer is not covered with the resistive film.

Accordingly, there has been reported a device in which the surface of a spacer is covered with a resistive film and a portion of the spacer surface is provided with an electrode in an attempt to solve the problems of power consumption and deviation of the light emitting position. Specifically, the specification of U.S. Pat. No. 5,532,548 discloses an arrangement in which electrodes parallel to a face plate and a back plate are formed on part of the surface of a spacer and a desired potential distribution is obtained by controlling the voltage applied to the electrodes. FIGS. 40, 41 and 42 are diagrams disclosed in the prior-art U.S. Pat. No. 5,532,548. A flat panel display 5010 includes a face plate 5012, a back plate 5014 and a side wall 5016. These components form a hermetic envelope 5018. The interior of the envelope 5018 has a light-emitting area of length L1 obtained by coating the inner side of the face plate 5012 with phosphors. One or more spacers 5020 supports the faceplate 5012 so as to oppose the back plate 5014. Each spacer 5020 has a length L and electrodes 5028 formed on each spacer 5020 each have a length of L2. If the spacers 5020 are formed from an insulator, the side wall of the spacer is provided with a coating 5026 of a resistor or is surface-doped.

According to U.S. Pat. No. 5,532,548, electrodes having a length (L2) at least greater than that L1 of the light-emitting area are formed on the spacers (of length L), which are longer than the light-emitting area (of length L1) that forms the image. It should be noted that a disclosure similar to that of U.S. Pat. No. 5,532,548 is made in U.S. Pat. No. 5,614,781 as well.

A problem with this device is that the electrodes 5028 formed on the spacer surface tend to produce a spark discharge. If a spark discharge is produced, the phosphors and electron emission elements may sustain damage from which recovery is not possible. Accordingly, in a device of this kind, the voltage impressed upon the phosphors must be suppressed in such a manner that spark discharge will not occur. A practical problem which arises is that a displayed image having a high brightness cannot be obtained.

As a result of continuing their investigations, the inventors have found that the locations at which spark discharge occurs are the points indicated by the arrows Bd in FIG. 43. More specifically, these locations are on the boundary between the electrode 5028 and a spacer, and reside at the corners of the electrode 5028.

Further, the inventors have studied spacers in which the length L of the spacer and the length L2 of the electrodes are equal, as illustrated in FIG. 44. This, however, failed to solve the problem of spark discharge. In other words, it was found that spark discharge occurs at the points indicated by the arrows Bd.

SUMMARY OF THE INVENTION

An object of the present invention is to provide an image forming apparatus having an electron emission element, an image forming member and a spacer provided within a vacuum envelope, wherein it is possible to achieve formation of a high-definition image and a reduction in image deterioration, especially in the vicinity of the spacer, caused by deviation of the electron beam irradiation position toward the image forming member.

Another object of the present invention is to provide an image forming apparatus having an electron emission element, an image forming member possessing phosphors and a spacer provided within a vacuum envelope, wherein it is possible to achieve formation of a high-luminance image and a reduction in image deterioration, especially in the vicinity of the spacer, caused by a deformation in the shape of the light emission, a change in light-emitting position and a shift in color.

Another object of the present invention is to provide an image forming apparatus capable of reducing the occurrence of spacer charging and especially spark discharge attributable to the spacer.

Another object of the present invention is to provide an image forming apparatus in which the surface potential of each portion of a spacer is controlled to provide a prescribed potential distribution in such a manner that the path of an electron beam will not be adversely affected.

Another object of the present invention is to provide an image forming apparatus in which the above-mentioned charging and spark discharge are reduced and, moreover, the manufacture of the spacers is facilitated.

Another object of the present invention is to provide an image forming apparatus in which the above-mentioned charging and spark discharge are reduced and in which there are disposed spacers which exhibit excellent evacuation conductance when the interior of the envelope is evacuated.

According to the present invention, the foregoing objects are attained by providing an image forming apparatus comprising a vacuum envelope and an electron emission element, an image forming member and a spacer disposed within the vacuum envelope, the spacer being disposed between electrodes to which mutually different voltages are applied within the vacuum vessel, the spacer having semiconductivity on a surface thereof faced to vacuum and a conductive member arranged to encircle the surface.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

A

DESCRIPTION OF THE PREFERRED EMBODIMENTS

The present invention will now be described taking preferred embodiments as an example.

According to the present invention, a flat panel image forming apparatus includes a vacuum envelope internally provided with at least an electron emission element, an image forming member and a spacer for reinforcing the mechanical strength of the vacuum envelope. The spacer is disposed between two electrodes to which different voltages are applied, at least a portion of the surface of the spacer exposed to the vacuum is furnished with semiconductivity, and the area furnished with the semiconductivity is provided with a member comprising an electrically conductive material which is arranged to encircle the outside of the spacer.

Figure 5:
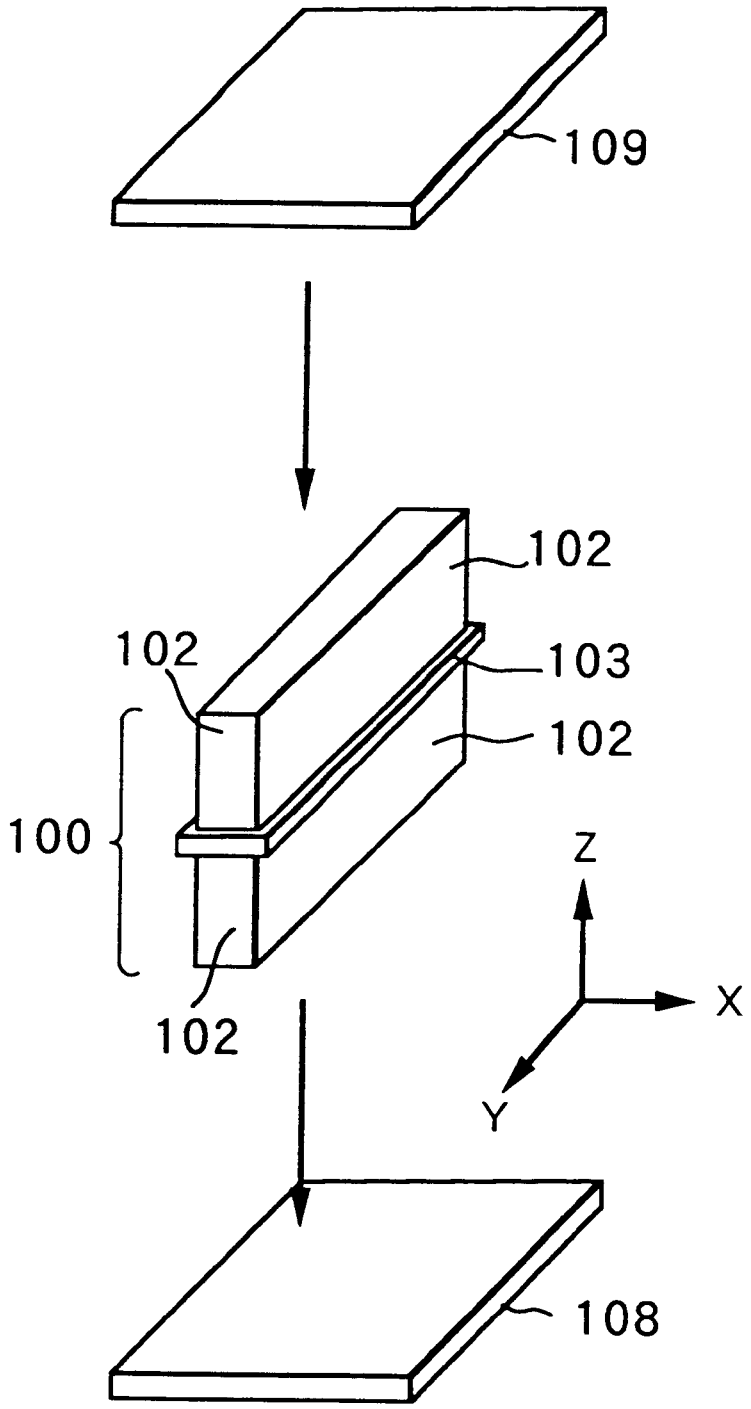
FIG. 5 is a perspective view of a plate-shaped spacer according to the present invention.
Figure 6:
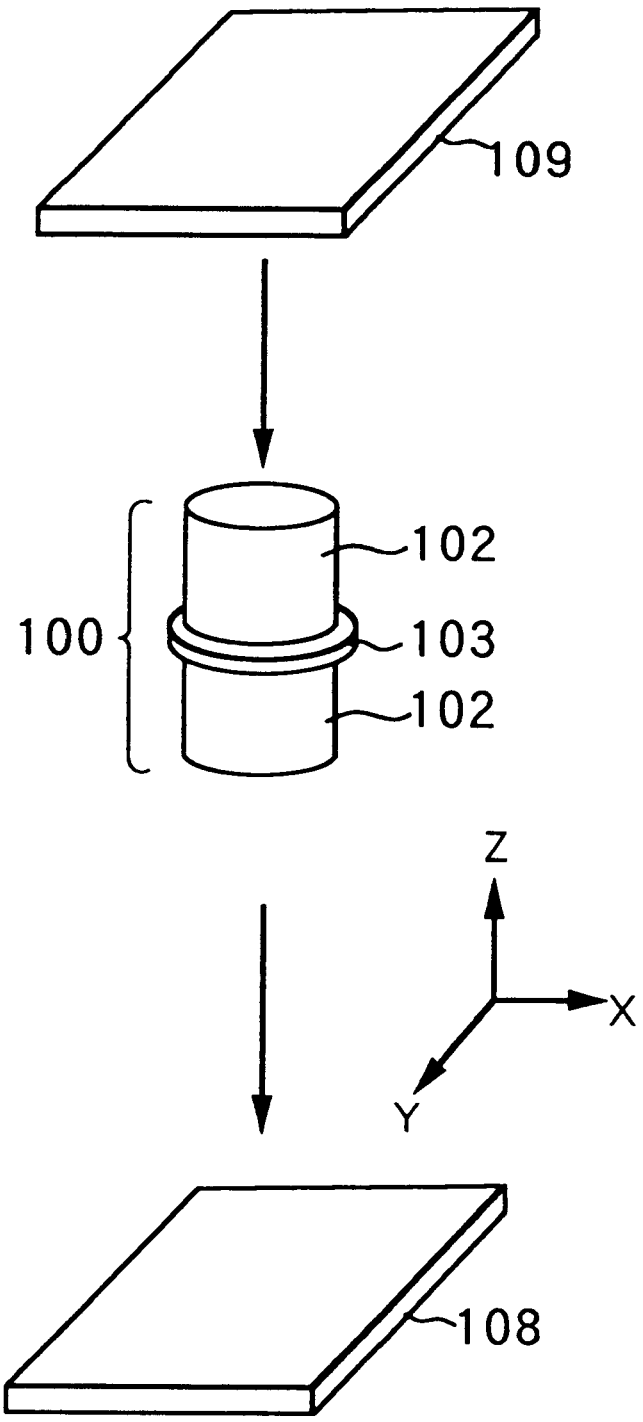
FIG. 6 is a perspective view of a cylindrical spacer according to the present invention.

For example, as shown in FIGS. 5 and 6, a spacer 100 provides support between an electrode 108 and an electrode 109 to which mutually different voltages are applied. A portion 102 exposed to the vacuum is furnished with semiconductivity and is provided with a loop-shaped conductor 103. The electrode 108, spacer 100 and electrode 109 are shown in spaced-apart relation for the sake of illustration, though in actuality the bottom and top of the spacer are in contact with the electrodes 108, 109, respectively. Accordingly, the portion of the spacer surface exposed to the vacuum is the side surface (that is, the surface of the spacer not parallel to the XY plane). This means that at least the side surface of the spacer 100 is made semiconductive and is provided with a loop-shaped conductor which encircles the spacer along its side surface.

Since the loop-shaped conductor is provided in accordance with this embodiment, the entire surface furnished with semiconductivity is utilized so that electric charge can escape in an effective manner. Since the conductor has the shape of a loop, there are no corners at end portions and local concentration of an electric field can be prevented from occurring.

Thus, in accordance with the present invention, charging of the spacer can be prevented and so can the occurrence of spark discharge.

Further, according to the present invention, the above-mentioned loop-shapedmember is disposed at a position which divides the distance between the two electrodes, which are supported by the spacer, at a fixed ratio.

Figure 7:
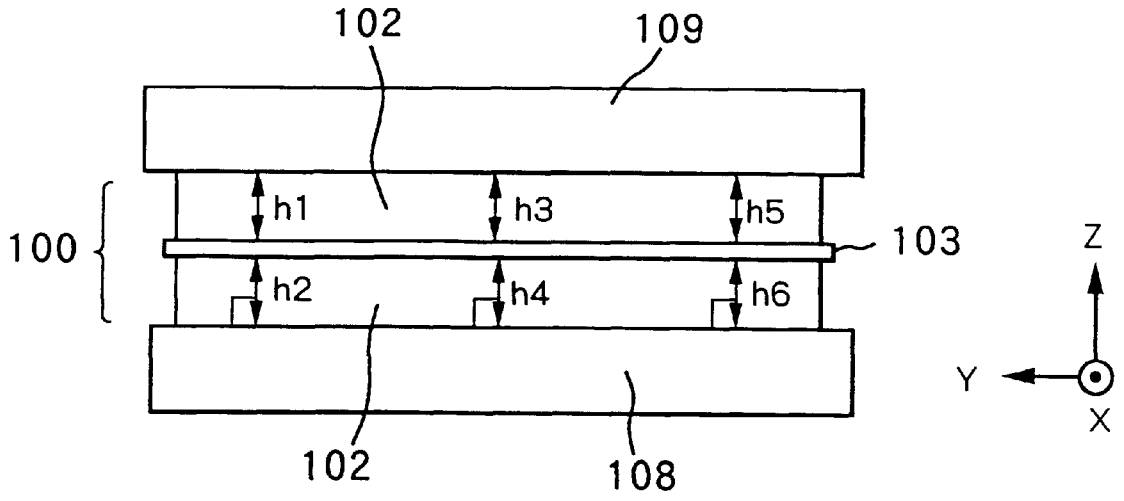
FIG. 7 is a side view showing the arrangement of a loop-shaped conductor of a spacer according to the present invention.
Figure 8:
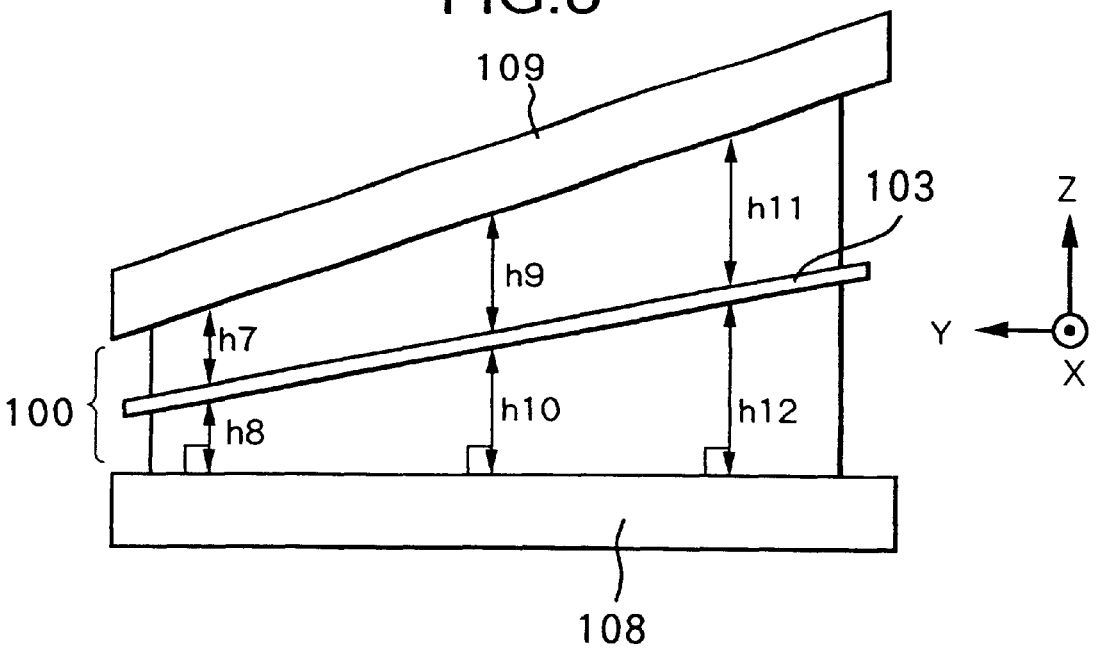
FIG. 8 is a side view showing the arrangement of a loop-shaped conductor of a spacer according to the present invention.

For example, as shown in FIGS. 7 and 8, distances from the electrode 108 to the loop-shaped conductor 103 along normal lines to the top surface of the electrode 108 are h2, h4, h6, h8, h10 and h12. Distances from the loop-shaped conductor 103 to the electrode 109 along normal lines are h1, h3, h5, h7, h9 and h11. According to the present invention, the position of the loop-shaped conductor 103 is set so as to satisfy the relations h1/h2=h3/h4=h5/h6, h7/h8=h9/10=h11/h12. As a result, it is possible to prevent an irregular potential distribution on the surface of the spacer so that the path of the electron beam will not be adversely affected.

Further, according to the present invention, the size of the spacer is set to smaller than the size of the image forming member. Therefore, when the interior of the vacuum envelope is evacuated, an excellent evacuation conductance can be obtained and the time needed to achieve vacuum can be shortened. This makes it possible to reduce the cost of manufacturing the image forming apparatus.

Further, according to the present invention, a plurality of spacers smaller than the image forming area are laid out, with spaces between them, in parallel or zigzag fashion. Therefore, when the interior of the vacuum envelope is evacuated, an excellent evacuation conductance can be obtained, and the time needed to achieve vacuum can be shortened. This makes it possible to reduce the cost of manufacturing the image forming apparatus.

Further, according to the present invention, of the two electrodes sandwiching the spacer, one is an electrode electrically connected to the image forming member, and the other is an electrode electrically connected to the electron emission element.

Figure 9:
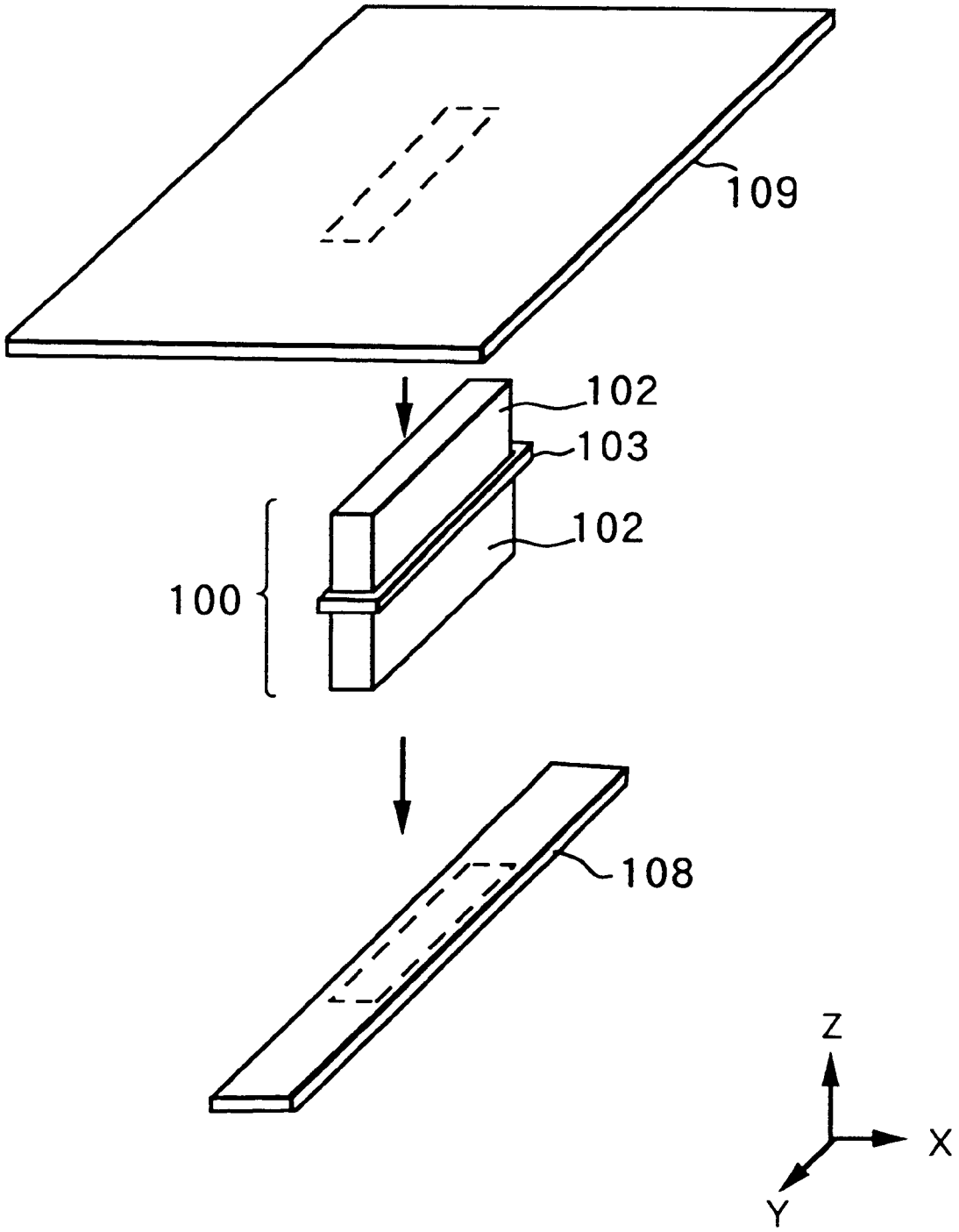
FIG. 9 is a partial perspective view of the inventive apparatus illustrating an example of a spacer and electrodes on either side of the spacer.

For example, in the apparatus shown in FIG. 9, the electrode 109 is a transparent electrode formed on a face plate or a metal back electrode.

The electrode 108 is a common wiring electrode for applying a driving signal to a plurality of electron emission elements or a connecting electrode for connecting a common wiring electrode and each electron emission element. A typical common wiring electrode is a row wiring electrode or column wiring electrode constituting a matrix. The connecting electrode may be one integrated with an electron emission element per se.

Further, according to the present invention, of the two electrodes sandwiching the spacer, one is an electrode electrically connected to the image forming member, and the other is an electron-beam control electrode.

Figure 10:
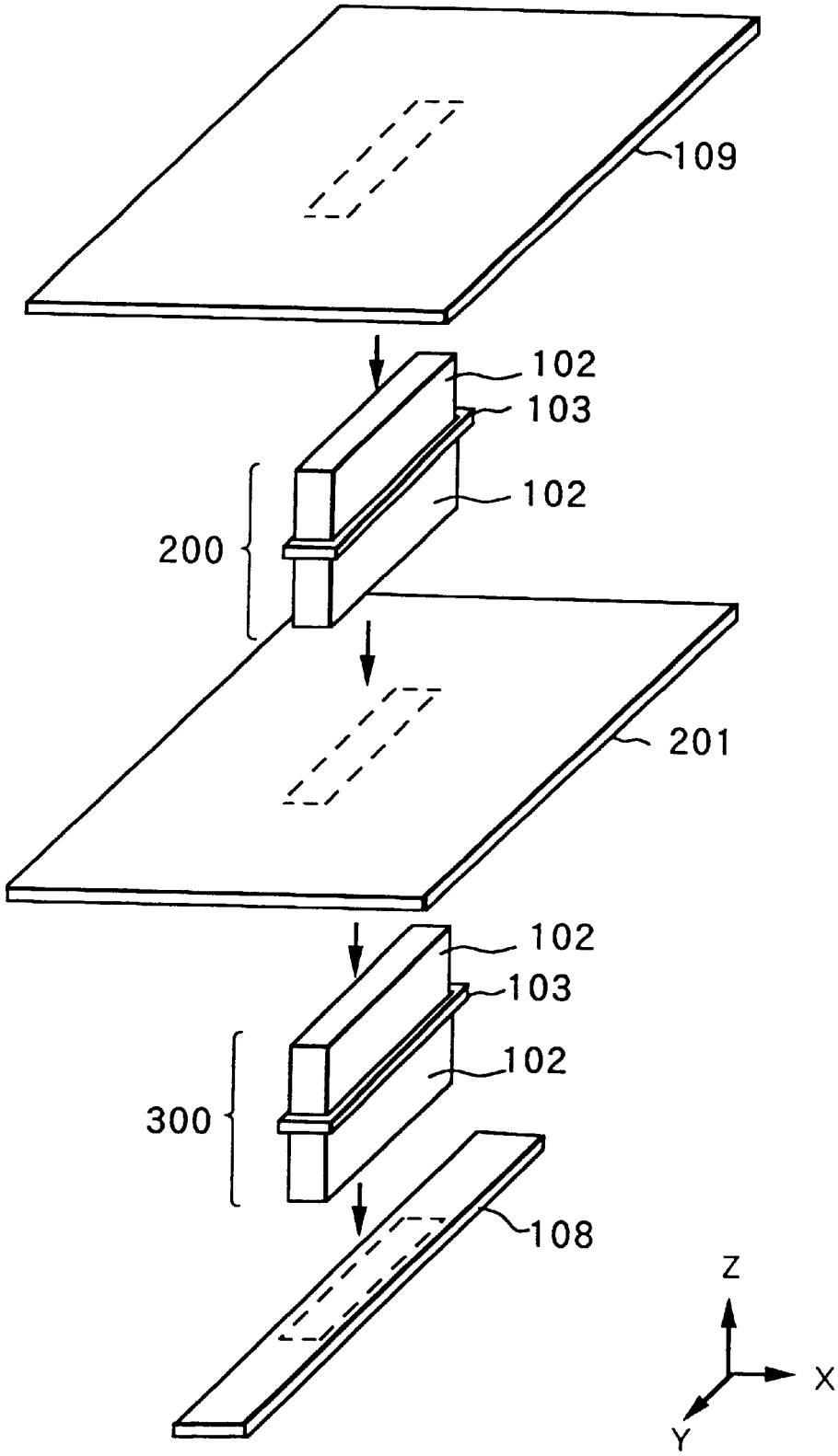
FIG. 10 is a partial perspective view of the inventive apparatus illustrating an example of spacers and electrodes on either side of the spacers.

For example, in the apparatus shown in FIG. 10, the electrode 109 supported by a spacer 200 is a transparent electrode formed on a face plate or a metal back electrode. An electrode 201 supported by the spacer 200 is an electron-beam control electrode. The electrode 201 may be any one of a focusing electrode, modulating electrode, deflecting electrode, potential shielding electrode or ion shielding electrode, by way of example. There are also cases in which the electron-beam control electrode 201 is provided with a window serving as a passageway for the electron beam.

Further, according to the present invention, of the two electrodes sandwiching the spacer, one is an electron-beam control electrode, and the other is an another electron-beam control electrode.

Figure 11:
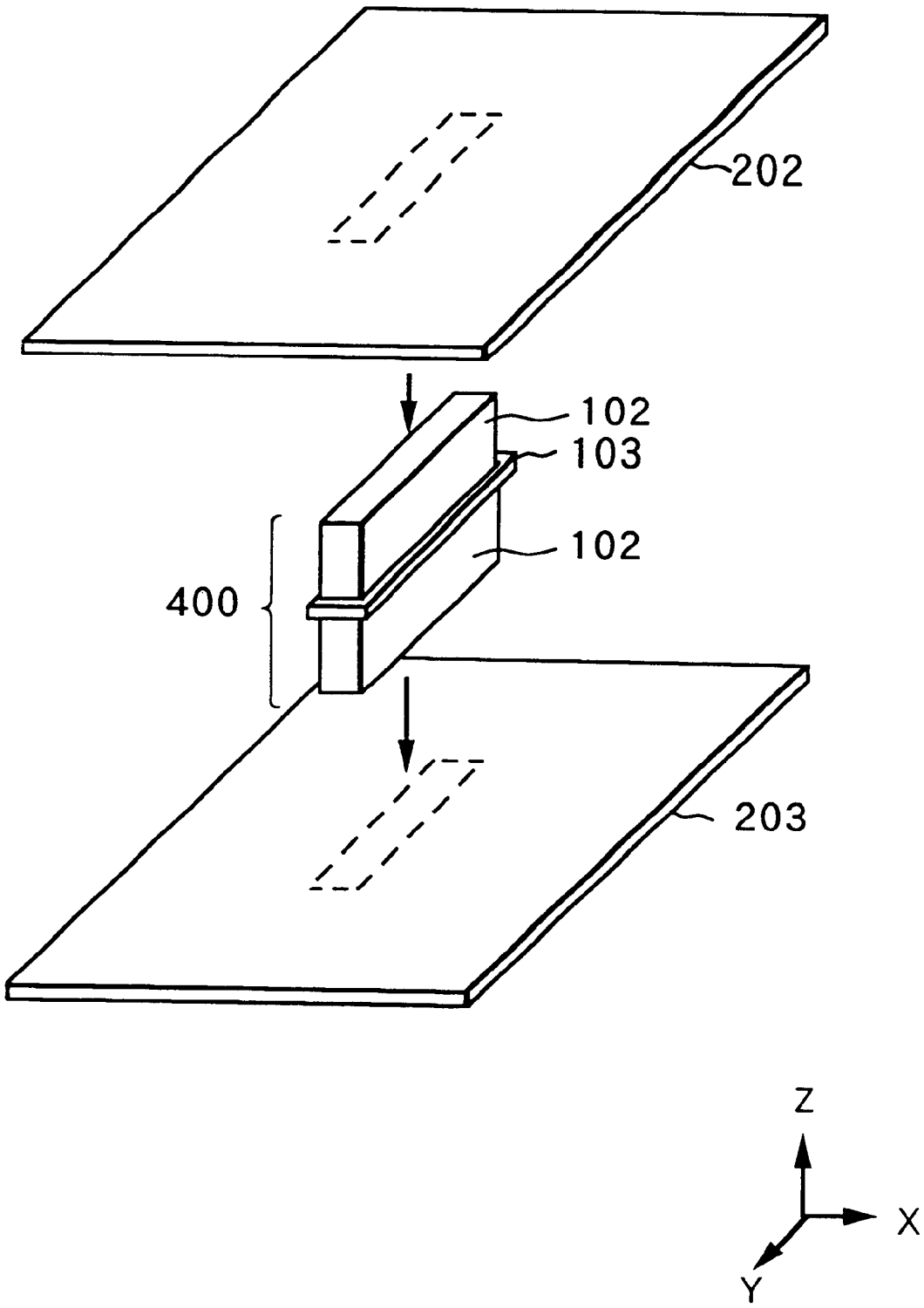
FIG. 11 is a partial perspective view of the inventive apparatus illustrating an example of a spacer and electrodes on either side of the spacer.

For example, in the apparatus shown in FIG. 11, electrodes 202 and 203 supported by a spacer 400 are electron-beam control electrodes. Each of the electrodes 202 and 203 is any one of a focusing electrode, modulating electrode, deflecting electrode, potential shielding electrode or ion shielding electrode. There are also cases in which the electron-beam control electrodes are provided with a window serving as a passageway for the electron beam.

Further, according to the present invention, of the two electrodes sandwiching the spacer, one is an electron-beam control electrode and the other is an electrode electrically connected to an electron emission element.

For example, in the apparatus shown in FIG. 10, the electrode 201 supported by a spacer 300 is an electron-beam control electrode. The electrode 201 is anyone of a focusing electrode, modulating electrode, deflecting electrode, potential shielding electrode or ion shielding electrode, by way of example. There are also cases in which the electron-beam control electrode 201 is provided with a window serving as a passageway for the electron beam.

The electrode 108 is a common wiring electrode for applying a driving signal to a plurality of electron emission elements or a connecting electrode for connecting a common wiring electrode and each electron emission element. A typical common wiring electrode is a row wiring electrode or column wiring electrode constituting a matrix. The connecting electrode may be one integrated with an electron emission element per se.

According to the present invention, the portion at which the spacer and electrode are connected is provided with an intermediate layer comprising a conductor. This makes it possible to achieve an excellent electrical connection between the semiconductive area of the spacer and the electrode.

According to the present invention, layers of semiconductive film and conductor are built up on the spacer material in the order mentioned.

According to the present invention, layers of conductor and semiconductive film are built up on the spacer material in the order mentioned.

According to the present invention, layers of an insulating member and a conductive member are stacked in alternating fashion, and a semiconductive film is formed on the side surface of the resulting stack.

An image forming apparatus according to a preferred embodiment of the present invention basically includes a thin-type vacuum envelope, multiple electron sources obtained by arraying a number of electron sources such as cold cathode elements on a substrate, and an image forming member for forming an image by irradiation of electrons, wherein the multiple electron sources and the image forming member being arranged to oppose each other within the vacuum envelope. Since cold cathode elements can be accurately positioned and formed on a substrate if use is made of a manufacturing technique such as photolithographic etching, it is possible to array a large number of these elements with a very small spacing between them. Moreover, since the cold cathodes themselves as well as their peripherals can be driven at relatively low temperature in comparison with thermonic cathodes of the kind used conventionally in a CRT or the like, multiple electron sources arrayed at a finer pitch can be realized with ease.

For these reasons, the present invention concerns an image forming apparatus which preferably uses the abovementioned cold cathode elements as the multiple electron sources. Cold cathode elements that are particularly preferred are surface-conduction electron emission elements. More specifically, among the cold cathode elements, those of the MIM type require that the thickness of the insulating layer or upper electrode be controlled relatively precisely, and those of the FE type require that the shape of the tip of the needle-shaped emission portion be controlled in precise fashion. As a consequence, these elements are comparatively costly to manufacture and there are cases where it is difficult to fabricate elements having a large area owing to limitations imposed by the manufacturing process. By contrast, a surface-conduction electron emission element is simple in structure, easy to manufacture and can readily be fabricated to have a large area. Surface-conduction electron emission elements are especially desirable cold cathode elements in view of the recent demand for large-screen display devices that are low in cost.

The image forming apparatus for practicing the present invention may be an apparatus having spacers whose length is greater than that of the image forming area or an apparatus having spacers of a length less than that of the image forming area. By providing the encircling conductor, the occurrence of spark discharge can be prevented to an extent greater than with the apparatus having the spacers of the kind shown in FIG. 43 or FIG. 44. Accordingly, since a voltage more than, say, 20% higher than that used heretofore can be applied, the brightness of the displayed image can be increased.

However, what is desired is an image forming apparatus in which spacers having a length smaller than that of the image forming area, namely spacers sized to fit in the image forming area, are disposed at a suitable spacing. The reason for this is that since a spacer having a smaller size has a smaller surface area, the semiconductive treatment and the formation of the encircling conductor are facilitated. Furthermore, since a flow passage for air can be obtained in the process for evacuating the interior of the image forming apparatus, this has the effect of increasing evacuation conductance. This makes it possible to shorten the time needed for evacuation and to lower manufacturing cost.

Embodiments of the present invention will now be described with reference to the drawings.

<First Embodiment>

Figure 1:
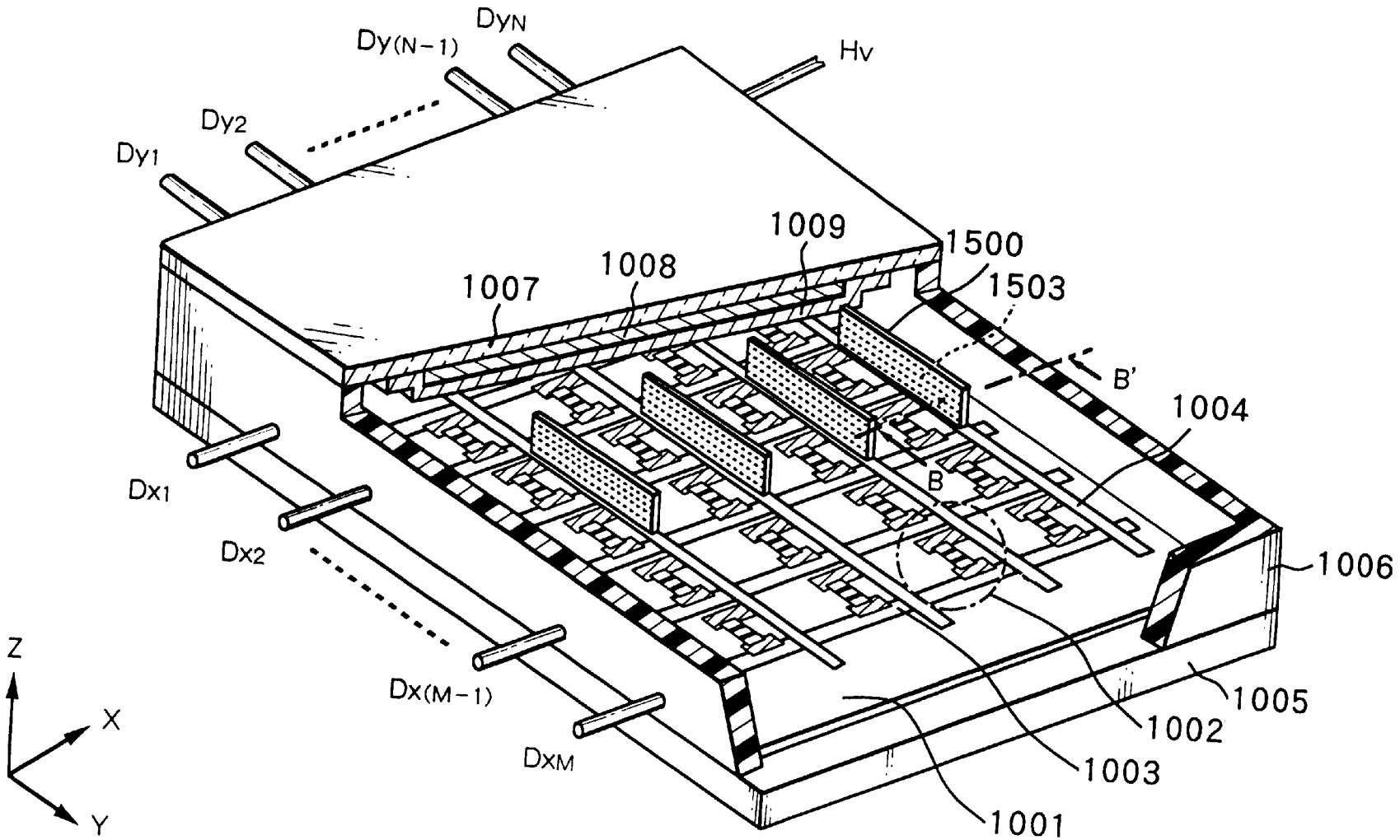
FIG. 1 is a perspective view, partially broken away, illustrating a first embodiment of an image forming apparatus according to the present invention.
Figure 2:
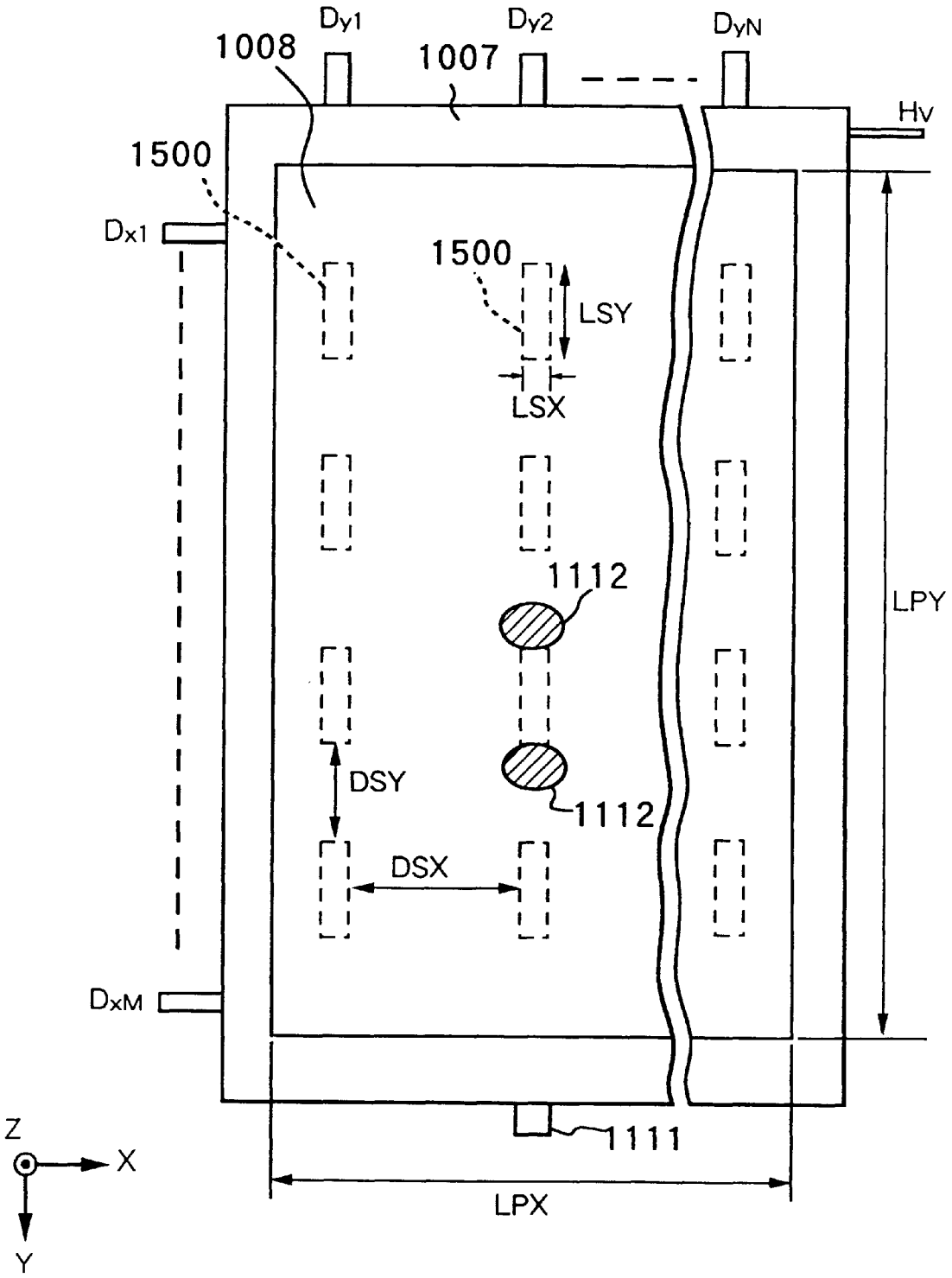
FIG. 2 is a plan view illustrating the first embodiment of the image forming apparatus according to the present invention.

FIG. 1 is a perspective view of an image forming apparatus according to a first embodiment of the present invention. Part of a panel is broken away to reveal the internal structure of the apparatus. FIG. 2 is a plan view showing the image forming apparatus as seen from the side of a face plate.

As shown in FIG. 1, the apparatus includes a substrate 1001 made of glass or the like, and cold cathode elements 1002 such as surface-conduction electron emission elements. Row-direction wires (Dx1~DxM) 1003 connect one of the element electrodes of respective ones of the cold cathode elements 1002, and column-direction wires (Dy1~DyN) 1004 connect the other of the element electrodes of respective ones of the cold cathode elements 1002. The apparatus further includes a rear plate 1005 made of glass or the like, a side wall 1006 made of glass or the like, and a face plate 1007 made of glass or the like. The rear plate 1005, side wall 1006 and face plate 1007 are bonded by frit glass or the like and form a hermetic envelope for maintaining a vacuum within the display panel. A vacuum on the order of $10^{-7}$ torr is maintained within the hermetic envelope.

The substrate 1001 is fixed to the rear plate 1005 and N×M of the cold cathode elements 1002 are formed on the substrate. (N, M are positive integers equal to or greater than one, with at least one of the integers being two or greater. The integers N and M are set appropriately in dependence upon the number of display pixels intended.) The M×N cold cathode elements are matrix-wired by M-number of row-direction wires 1003 and N-number of column-direction wires 1004. The portion constituted by the components 1001~1004 is referred to as a "multiple electron beam source".

The method of manufacturing the multiple electron beam source and the structure thereof will be described in detail later.

In this embodiment, the arrangement is such that the substrate 1001 of the multiple electron beam source is fixed to the rear plate 1005 of the hermetic envelope. However, if the substrate 1001 of the multiple electron beam source has sufficient strength, the substrate 1001 itself may be used as the rear plate of the hermetic envelope.

A phosphor film 1008 is formed on the underside of the face plate 1007. A metal back 1009 well known in the field of CRT technology is provided. In a case where a phosphor material for low voltages is used as the phosphor film 1008, the metal back 1009 is unnecessary. In such case a transparent electrode (not shown) is formed on the underside of the face plate 1007.

Figure 12A:
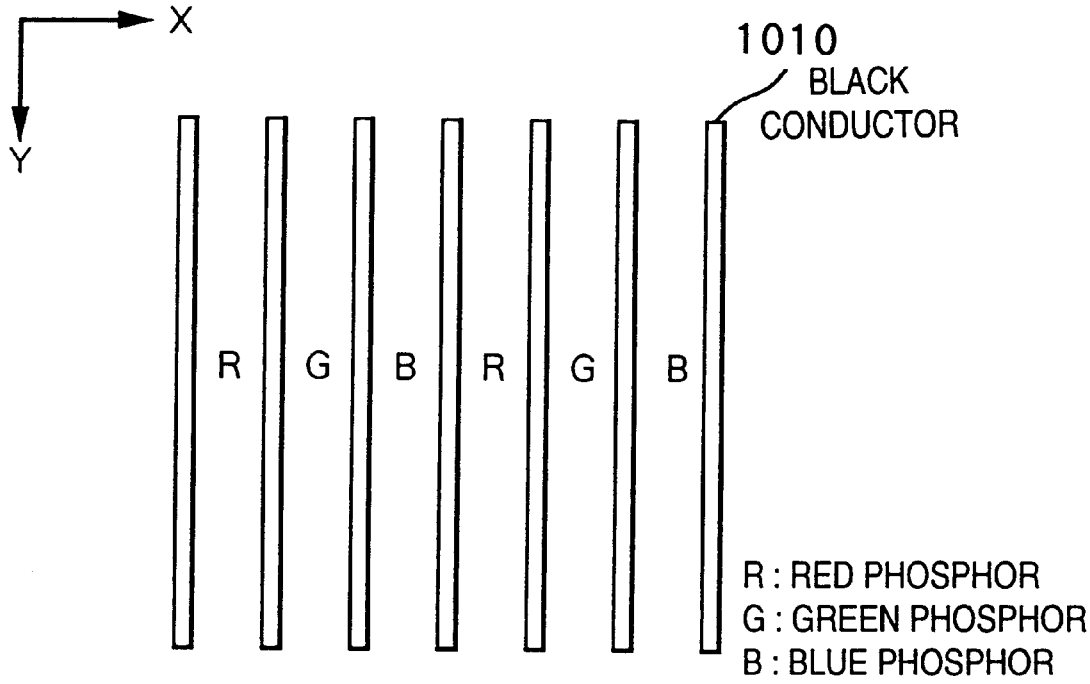
FIGS. 12A and 12B are plan views exemplifying an array of phosphors on face plates of a display panel.
Figure 12B:
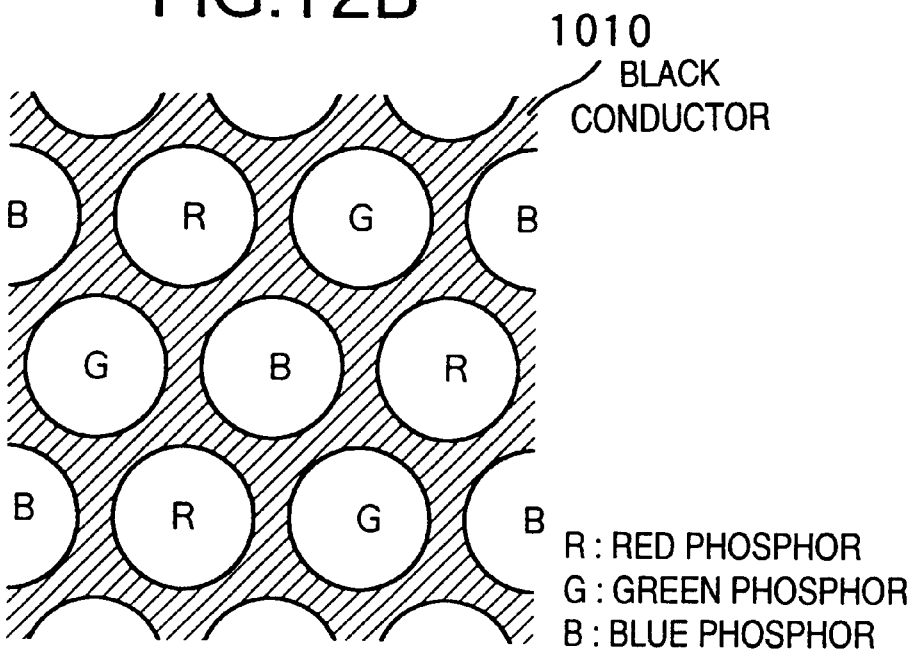

Since this embodiment relates to a color display apparatus, portions of the phosphor film 1008 are coated with phosphors of the three primary colors red, green and blue used in the field of CRT technology. The phosphor of each color is applied in the form of stripes, and a black conductor 1010 FIGS. 12A, 12B is provided between the phosphor stripes.

Spacers 1500 are provided within the hermetic envelope and serve as structures for providing-resistance against atmospheric pressure. The spacers 1500 within the hermetic envelope are provided in a number and at a spacing required to attain this object. For example, each spacer 1500 is formed from a member of the kind described below.

As shown in FIG. 2, the size (LSX, LSY) of each spacer is made smaller than the size (LPX, LPY) of the image forming member, and the spacers are arranged to have a prescribed spacing (DSX, DSY). The values of DSX, DSY are decided to assure sufficient strength against atmospheric pressure and to increase conductance in the evacuation process.

Shown at 1111 in FIG. 2 is an exhaust port used when evacuating the interior of the panel.

Figure 3:
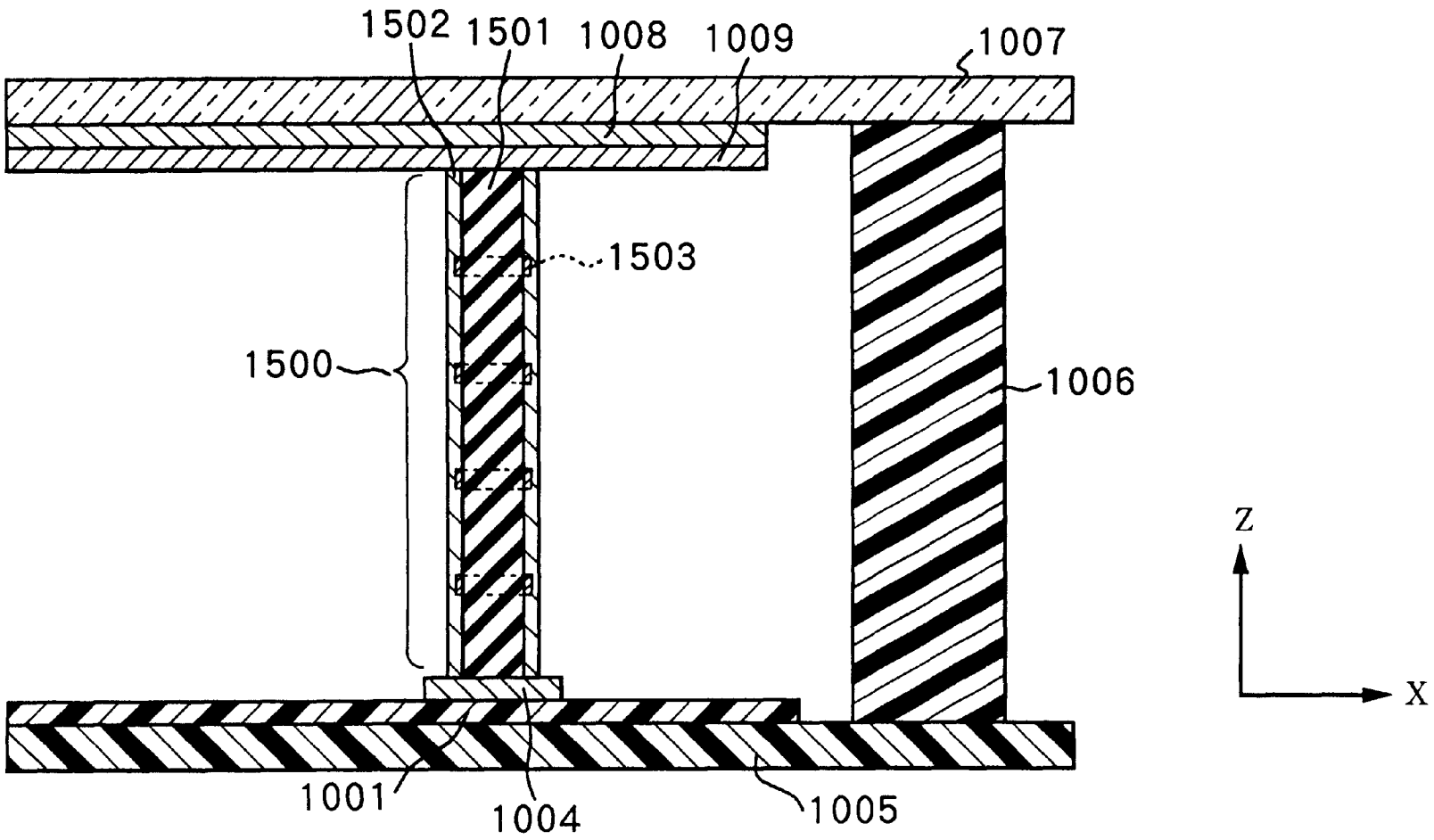
FIG. 3 is a sectional view taken along line B–B' in the vicinity of a spacer in the image forming apparatus of FIG. 1.

FIG. 3 is a sectional view taken along line B–B' in the vicinity of the spacer 1500 of the image forming apparatus shown in FIG. 1.

The spacer 1500 has an insulating base 1501 consisting of a material having enough insulation to withstand a high voltage impressed across the column-direction wire 1004 and metal back 1009. Examples of materials for the insulating base 1501 are quartz glass, glass having a reduced impurity (e.g., Na) content, soda-lime glass or a ceramic member consisting of alumina or the like.

Figure 4:
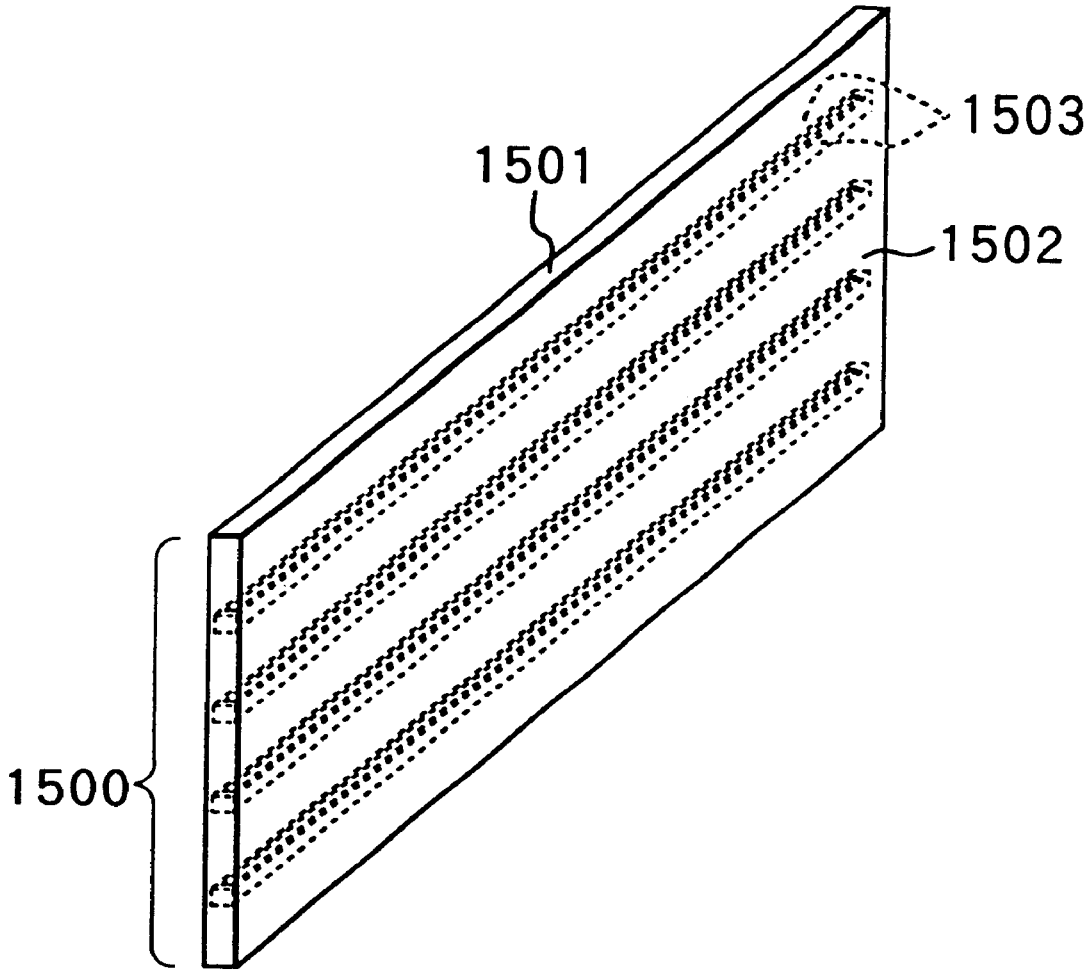
FIG. 4 is a perspective view of a spacer according to the first embodiment of the present invention.

Components in FIGS. 3 and 4 designated by like reference characters in FIG. 1 are not described again.

A semiconductive thin film 1502 is obtained by, for example, forming a group IV semiconductor such as silicon or germanium, a compound semiconductor such as gallium arsenide, an oxide semiconductor such as tin oxide or an impurity semiconductor, which is obtained by adding a trace amount of an impurity to the various semiconductors mentioned above, on the surface of the insulating base 1501 in the amorphous state, polycrystalline state or monocrystalline state. For example, the semiconductive thin film 1502 may be obtained by a vacuum film-forming method such as vacuum deposition, sputtering or chemical vapor deposition, or by applying and calcining an organic solution or a dispersion by dipping or by using a spinner. The semiconductive film 1502 is electrically connected to the black conductor 1010 or metal back 1009 on the side of the face plate 1007 and is electrically connected to the column-direction wire 1004 on the side of the rear plate 1005.

A conductive member 1503, which is a conductive thin film, is obtained by forming a metal thin film of aluminum, nickel, copper, silver or gold, etc., a group IV semiconductor such as silicon or germanium, a compound semiconductor such as gallium arsenide, an oxide semiconductor such as tin oxide or an impurity semiconductor, which is obtained by adding an impurity to the various semiconductors mentioned above in an amount greater than that used in the semiconductive film 1502, in the amorphous state, polycrystalline state or monocrystalline state. For example, the conductive member 1503 may be obtained by a vacuum film-forming method such as vacuum deposition, sputtering or chemical vapor deposition, or by applying and calcining an organic solution or a dispersion by dipping or by using a spinner. The conductive member 1503 is formed before the formation of the semiconductive film 1502 on the surface of the insulating base 1501.

One or a plurality of the conductive members 1503 are formed and each is provided along a direction approximately perpendicular to the direction of an electric field between the black conductor 1010 or metal back 1009 and the column-direction wire 1004. Further, the conductive member 1503 is formed to have a width smaller than the distance between the black conductor 1010 or metal back 1009 and the column-direction wire 1004. The semiconductive thin film 1502 and the conductive member 1503 are electrically connected.

The following construction was adopted for an actual image forming apparatus:

Spacers 1500 each having a height of 5 mm, a thickness of 200 $\mu$m and a length of 20 mm, for example, were fixed at equal intervals to the column-direction wires 1004 in a direction substantially parallel to the column-direction wires 1004. The joints between the rear plate 1005, face plate 1007 and side wall 1006 as well as the joints between the rear plate 1005, face plate 1007 and the spacers 1500 were coated with frit glass (not shown) and the joints were sealed by carrying out calcination in the atmosphere at a temperature of 400~500° C. for 10 min or more. The spacers 1500 were bonded in place by placing them on the column-direction wires 1004 (of width 300 $\mu$m, for example) on the side of the rear plate 1005 and on the black conductors 1010 (of width 300 $\mu$m, for example) on the side of the face plate 1007 via conductive frit glass (not shown) mixed with a conductive material such as metal, and carrying out calcination in the atmosphere at a temperature of 400~500° C. for 10 min or more. Sealing and electrical connection were also achieved through this process.

To obtain the spacers 1500, a film of tin oxide having a thickness of 1000 Å was formed as the semiconductive thin film 1502 on the insulating base 1501 consisting of soda-lime glass that had been cleaned. The film was formed in an argon-oxygen atmosphere by ion plating method using the electron-beam. The surface resistance value of the semiconductive thin film 1502 was about $10^9$ Ω/□ (ohms per square). Before the semiconductive thin film 1502 was formed, the four lines of the conductive members 1503 were formed by vapor-depositing, say, gold to a film thickness of 250 Å and a width of 100 $\mu$m so as to make one revolution about the spacer 1500, as shown in FIG. 4. Etching was carried out as necessary to obtain the desired shape.

As shown in FIG. 12A, the phosphor film 1008, which serves as the image forming member, employed stripe shapes in which the phosphors of each color extend in the Y direction. The black conductor 1010 was shaped not only to separate the phosphors of each of the colors but also to separate the pixels in the Y direction and to allow installation of the spacers 1500. The phosphor film 1008 was fabricated by first forming the black conductors 1010 and then applying the phosphors of each of the colors in the gaps between them. A material having graphite as the main ingredient was used as the material for the black conductor 1010.

The method used to coat the face plate 1007 with the phosphors was the slurry method.

The metal back 1009 provided on the inner surface of the phosphor film 1008 was fabricated by applying a smoothing treatment (usually referred to as "filming") to the inner surface of the phosphor film 1008 after the phosphor film is formed, and then depositing aluminum by vacuum deposition. In order to improve the conductivity of the phosphor film 1008, there are cases in which the face plate 1007 is provided with transparent electrodes. In this embodiment, however, sufficient conductivity was obtained solely by use of the metal back 1009. This made the transparent electrodes unnecessary.

When the above-mentioned sealing is carried out, the phosphors of each color and the cold cathode elements 1002 must be made to correspond. For this reason the rear plate 1005, face plate 1007 and spacers 1500 were positioned correctly. Ordinarily a voltage Vf applied across the pair of element electrodes of the cold cathode elements 1002 is 12~16 V, a distance d between the metal back 1009 and cold cathode elements 1002 is 2~8 mm and a voltage Va between the metal back 1009 and the cold cathode element 1002 is 1~15 kV.

The arrangement described above is an overview of the arrangement necessary to fabricate an excellent image forming apparatus for use in an image display. Various details such as the materials of the various members and the disposition of these members are not limited to those set forth above; these may be selected so as to suit the particular application of the image forming apparatus. When a desired voltage is applied to each of the cold cathode elements 1002 based upon the above-described arrangement via the row-direction wires (Dx1~DxM) 1003 and column-direction wires (Dy1~DyN) 1004, electrons are emitted from each cold cathode element. Simultaneously applying a high voltage of several kilovolts to the metal back 1009 (or transparent electrodes, not shown) through a high-voltage terminal Hv accelerates the electrons emitted from each cold cathode element 1002 and causes these electrons to bombard the face plate 1007. As a result, the phosphors of the phosphor film 1008 are excited and emit light so as to form an image.

Figure 13:
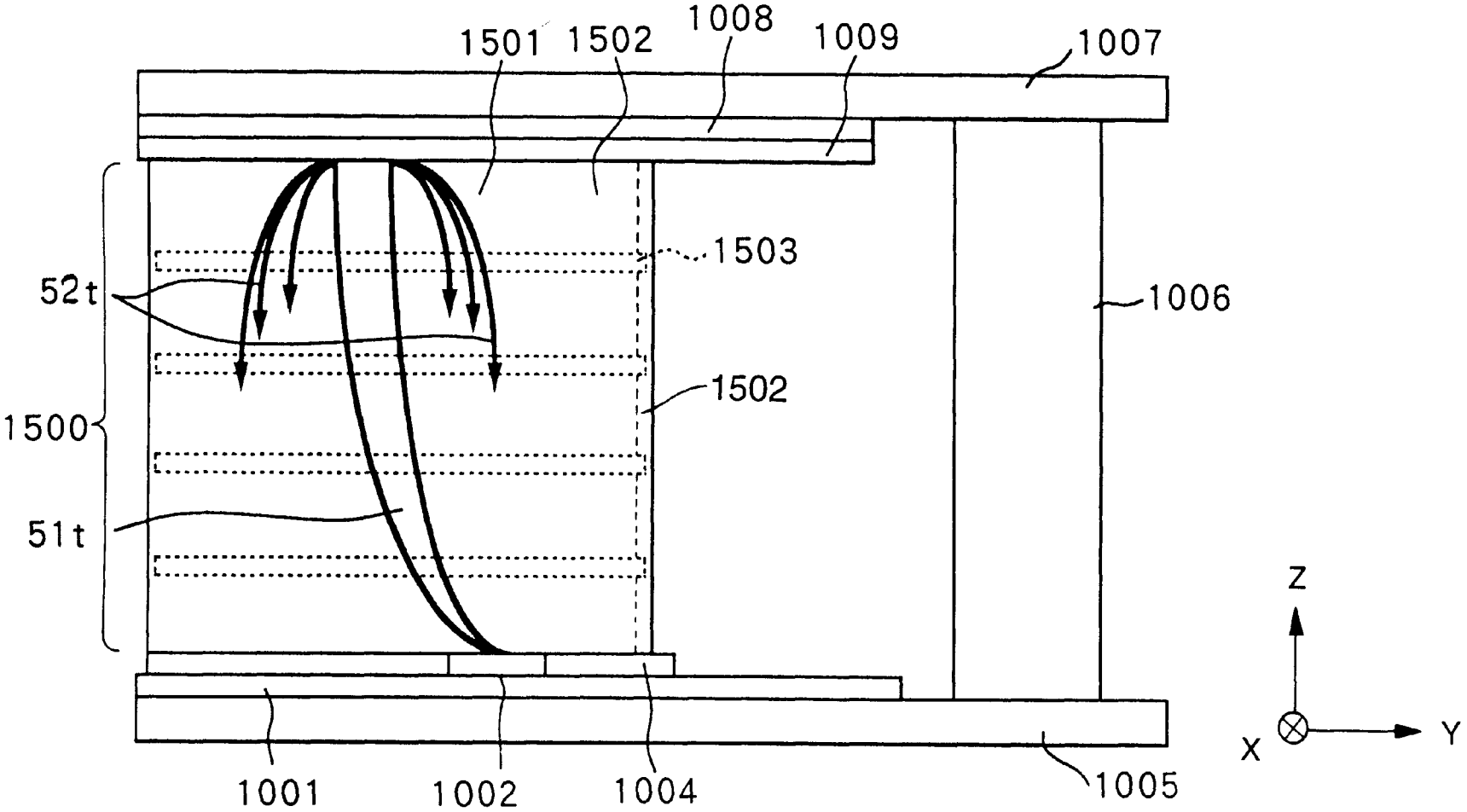
FIG. 13 is a diagram for describing the circumstances in which electrons and scattered particles are generated in the image forming apparatus shown in FIG. 1.
Figure 14:
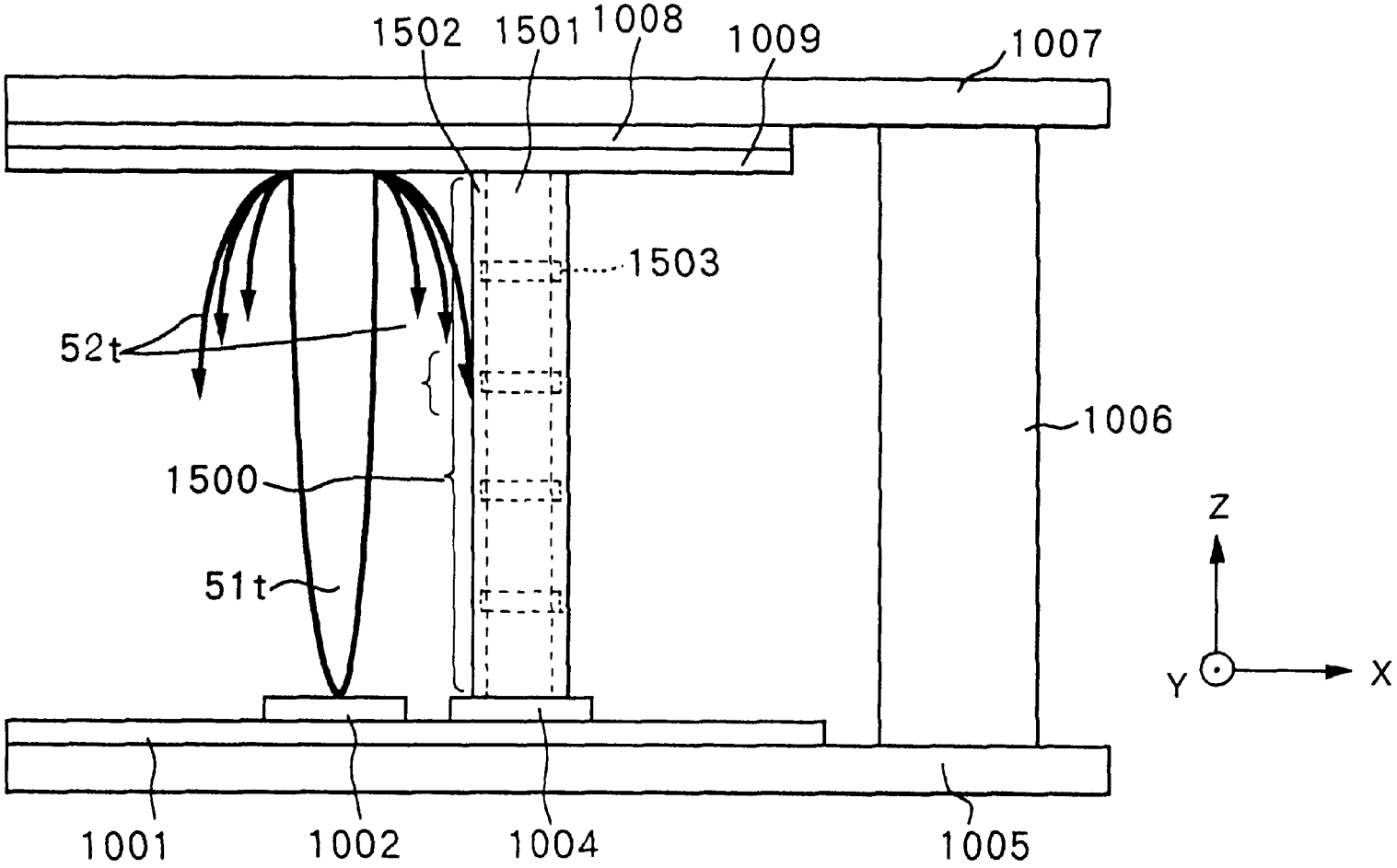
FIG. 14 is a diagram for describing the circumstances in which electrons and scattered particles are generated in the image forming apparatus shown in FIG. 1.

This is illustrated in FIGS. 13 and 14. FIGS. 13 and 14 are diagrams useful in describing the circumstances in which electrons and scattered particles (described later) are generated in the image forming apparatus shown in FIG. 1. FIG. 13 is a diagram showing the view from the X direction and FIG. 14 a diagram showing the view from the Y direction.

As shown in FIG. 13, a cold cathode element 1002 for which a desired voltage has been applied to the row-direction wire (Dx1~DxM) 1003 and column-direction wire (Dy1~DyN) 1004 emits electrons. Owing to an acceleration voltage Va applied to the metal back 1009 on the face plate 1007, the electrons emitted by the cold cathode element 1002 shift toward the element electrode on the high-potential side relative to the normal line from the cold cathode element 1002 to the surface of the rear plate 1005 and travel following a parabolic path indicated at 51*t*. As a consequence, the center of the light-emitting portion of the phosphor film 1008 deviates from the normal line from the cold cathode element 1002 to the surface of the rear plate 1005.

The electrons emitted by the cold cathode element 1002 reach the inner surface of the face plate 1007 and induce the light-emitting phenomenon in the phosphor film 1008. In addition, scattered particles (ions, secondary electrons, neutral particles, etc.) are generated at a certain probability owing to electron bombardment of the phosphor film 1008 and electron bombardment of gas remaining in the vacuum, although the probability of this occurring is low. It is believed that these particles travel within the hermetic envelope along the paths indicated at 52*t* in FIGS. 13 and 14.

In an experiment for comparative purposes in which the semiconductive film 1501 and conductive member 1503 were not formed on the spacer 1500 in the image forming apparatus shown in FIG. 1, the inventors discovered the occurrence of cases where the light emitting position (the position bombarded by electrons) of the phosphor film 1008 situated in the vicinity of the spacer 1500 and the shape of the emitted light deviate from their design values. In particular, when an image forming member for a color image is used, there are cases where a decline in brightness and the occurrence of a color shift arise along with a shift in the light emitting position.

The prime cause of this phenomenon is believed to be as follows: Some of the above-mentioned scattered particles bombard the insulating substrate 1501 of the spacer 1500 and the exposed portion mentioned above is charged. As a result, the electric field changes in the vicinity of the exposed portion, and a deviation occurs in the path of the electrons. This leads to a change in the light-emitting position of the phosphors and a change in the shape of the light emission. Further, the inventors have found that mainly a positive charge accumulates at the exposed portion based upon the change in the light emitting position of the phosphors and the change in the shape of the light emission. The cause is believed to be either charging due to the accumulation of positive ions included among the scattered particles or the occurrence of positive charging owing to the emission of secondary electrons generated when the scattered particles bombard the exposed portion mentioned above.

On the other hand, in the spacer according to this embodiment, the semiconductive film 1502 and the conductive member 1503 are formed on the surface of the insulating base 1501. In the image forming apparatus of this embodiment formed to have the semiconductive thin film 1502 and the conductive member 1503, it has been verified that the light-emitting position (the position bombarded by electrons) on the phosphor film 1008, situated in the vicinity of the spacer 1500, and the shape of the light emission are as designed. That is, it is believed that even if charged particles build up on the spacer 1500, some of the current (actually electrons or positive holes) that flows through the semiconductive thin film 1502 is electrically neutralized, and any charge that maybe produced at the exposed portion is canceled out immediately. It is believed that since one or a plurality of the conductive members 1503 is provided along a direction approximately perpendicular to the direction of the electric field between the black conductor 1010 or metal back 1009 and the column-direction wire 1004, the current can flow through the semiconductive film 1502 without disturbing the electric field in the vicinity of the spacer 1500.

Figure 43:
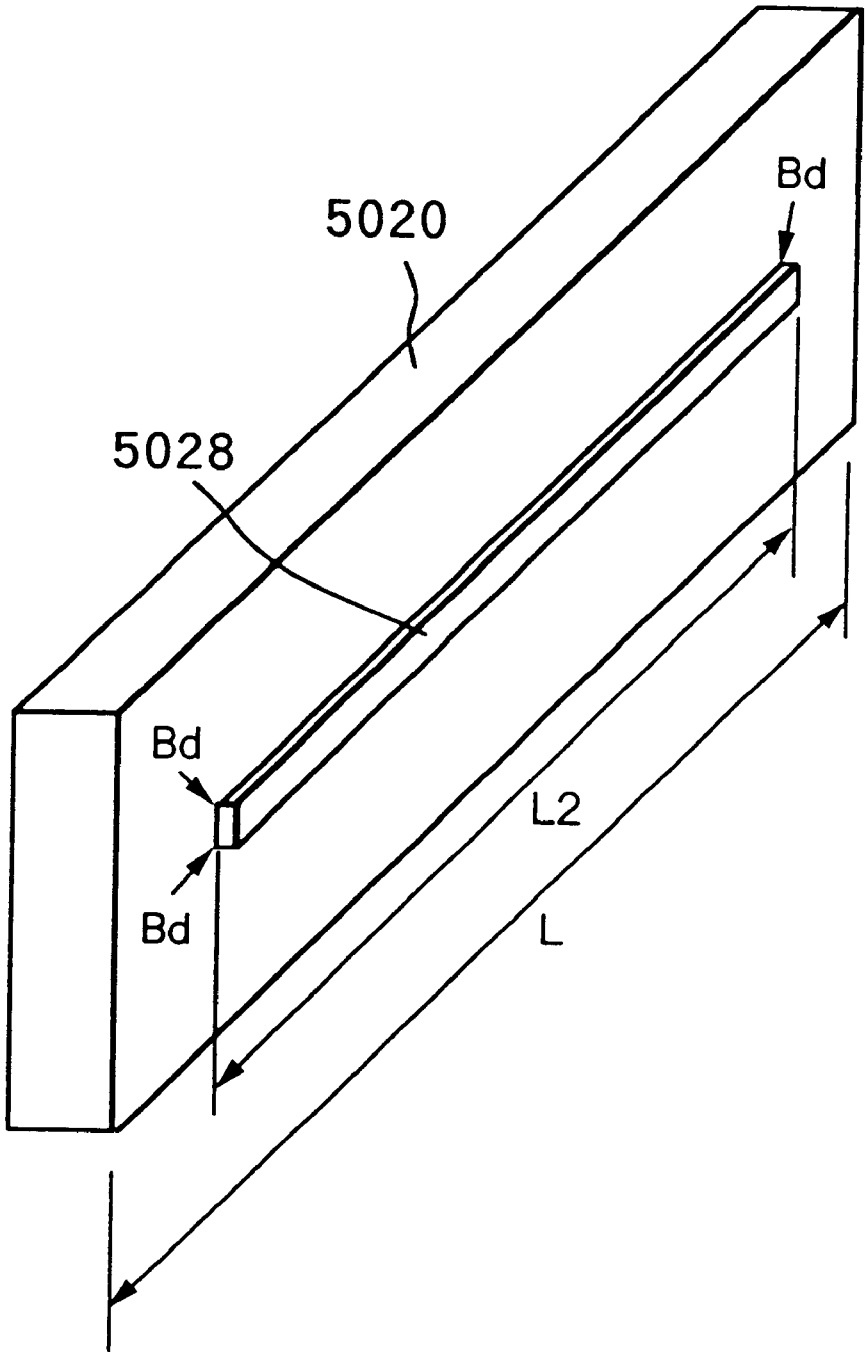
FIG.43 PRIOR ART
FIG. 43 is a perspective view of a spacer according to the prior art.
Figure 44:
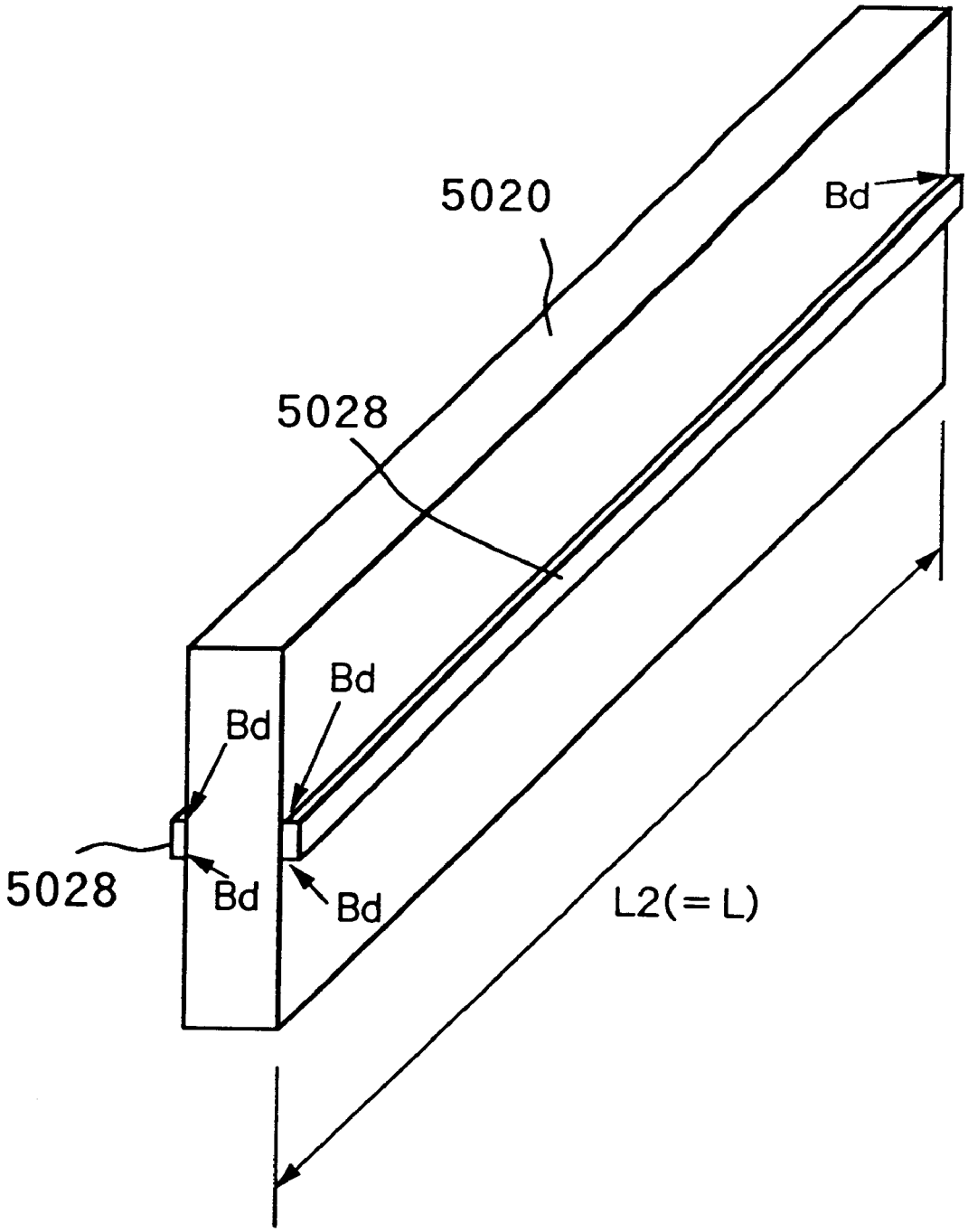
FIG. 44 is a perspective view of a spacer according to the prior art.
Figure 45:
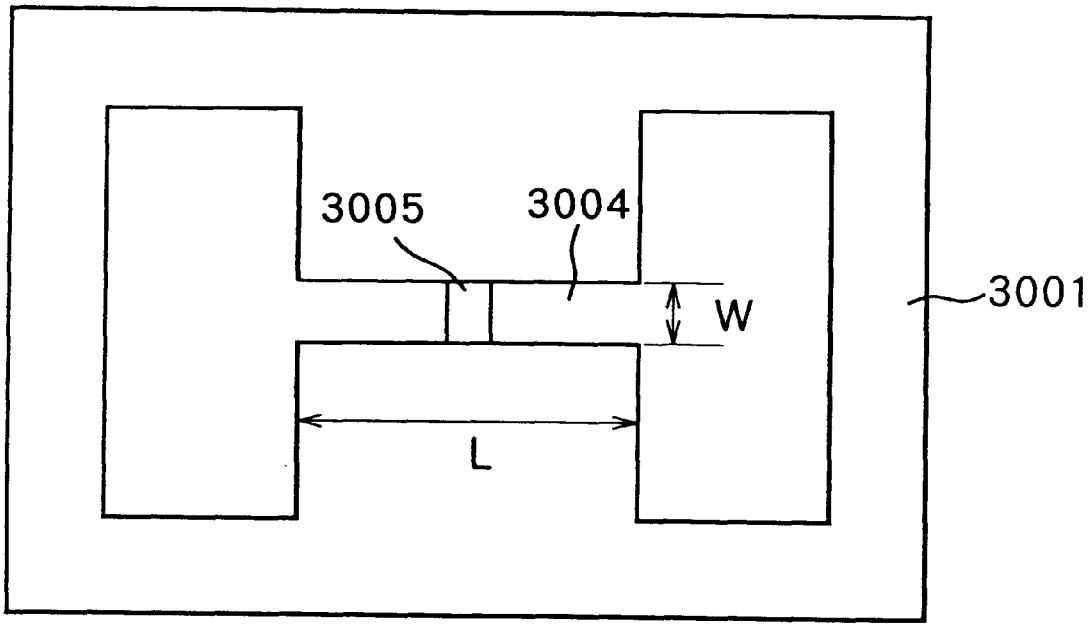
FIG. 45 is a diagram showing an example of a surface-conduction emission element known in the art.
Figure 46:
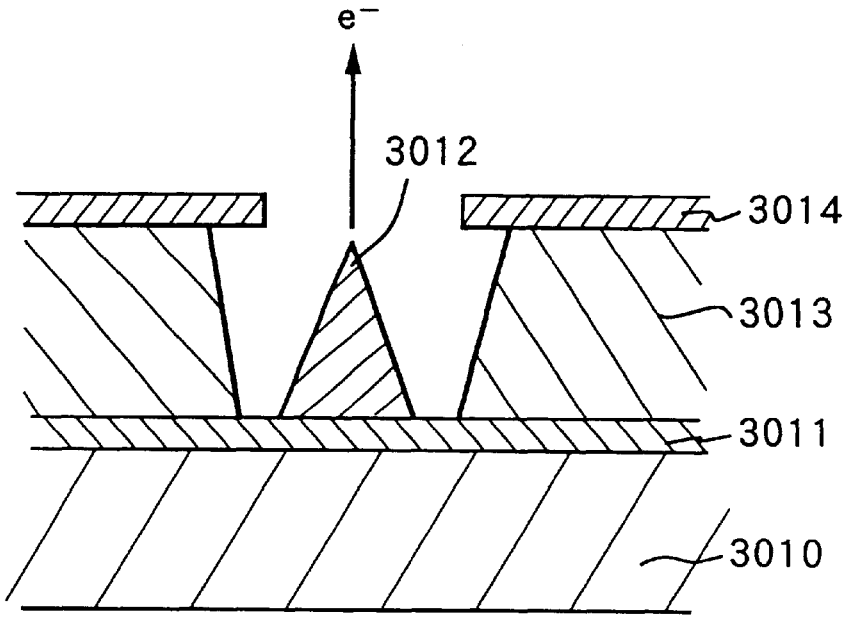
FIG. 46 is a diagram showing an example of an FE-type element known in the art.
Figure 47:
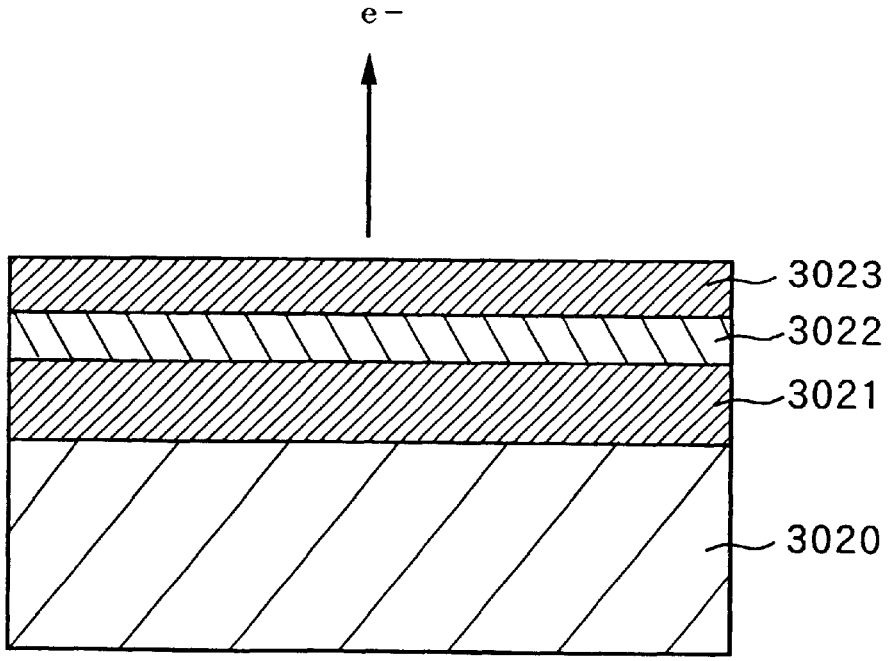
FIG. 47 is a diagram showing an example of a MIM-type element known in the art.

This image forming apparatus was compared with an image forming apparatus having spacers of the kind shown in FIG. 43 and with an image forming apparatus having spacers of the kind shown in FIG. 44. These apparatus will be referred to as Apparatus 1, Apparatus 2 and Apparatus 3, respectively. Spacer size (LSX, LSY) and spacing (DSX, DSY) were set to be the same for all three apparatus.

When the voltage applied to the metal back 1009 was gradually increased, a spark discharge was produced first in Apparatus 3 and then in Apparatus 2 after the voltage was raised a further 3%. In Apparatus 1, on the other hand, no spark discharge was produced even when the voltage was raised by more than 20%. As a result, the highest brightness could be achieved with Apparatus 1.

Next, in each apparatus the voltage was raised to the maximum extent possible without causing the occurrence of spark discharge and the displayed image was observed. It was found that the brightness of the displayed images of Apparatus 2 and Apparatus 3 was not only less than that of the displayed image of Apparatus 1 but was also less uniform. In other words, Apparatus 2 and 3 experienced a deformation in the shape of the light emission, a deviation in the light-emitting position and a shift in color. These problems arose near both ends of the spacer, namely in the areas indicated by the shaded portions 1112 in FIG. 2. (For the sake of illustration, these areas are shown for only one spacer. In actuality, however, these areas are produced at both ends of each spacer.) By contrast, in Apparatus 1, these problems did not occur and a uniform display image could be obtained. It is believed that the reason for this is that, unlike Apparatus 2 and 3, a uniform potential distribution is achieved about the entire circumference of the spacer.

Several examples in which the design values of Apparatus 1 were changed will now be described.

EXAMPLE 1

[Conditions: surface resistance value: $10^9$ Ω/□, conductive member: gold (several lines), Anode Voltage: 3~10 kV]

In the arrangement described above, the insulating base 1501 of the spacer 1500 is glass in which the content of impurities such as Na has been reduced. A film of nickel oxide having a thickness of 1000 Å was formed as the semiconductive thin film 1502 of the spacer 1500. The film was formed in an oxygen environment by ion plating using the electron-beam method. The surface resistance value of the semiconductive thin film 1502 was about $10^9$ Ω/□. The conductive member 1503 was gold film formed to a thickness of 200 Å by vacuum deposition prior to the formation of the semiconductive thin film 1502. The conductive members 1503 were formed by vapor-depositing four lines of a width of 100 μm and at a spacing of 1 mm so as each of the four lines makes one revolution about the spacer 1500.

The voltage Va applied to the high-voltage terminal Hv was made 3 to 10 kv and the voltage Vf applied across the pair of element electrodes of the cold cathode elements 1002 was made 14 V.

At this time rows of equally spaced light-emission spots were formed in two dimensions. These included light-emission spots produced by emitted electrons from the cold cathode elements 1002 at positions in the vicinity of the spacers 1500. A clear color image display having excellent color reproducibility could be obtained. A disturbance in the electric field that would affect the electron path did not occur despite the provision of the spacers 1500.

EXAMPLE 2

[Conditions: surface resistance value: $10^{12}$ Ω/□, conductive member: gold (several lines), Anode Voltage: 3~10 kV]

This example differs from Example 1 in that nickel oxide having a thickness of 1000 Å was formed as the semiconductive thin film 1502 of the spacer 1500 in an argon atmosphere by ion plating using the electron-beam method. The surface resistance value of the semiconductive thin film 1502 was about $10^{12}$ Ω/□.

The cold cathode elements 1002 in the image forming apparatus using the spacer 1500 were caused to emit electrons by applying a scanning signal and a modulating signal to the cold cathode elements from signal generating means (not shown) via external terminals Dx1~DxM, Dy1~DyN of the envelope. The emitted electron beam was accelerated by applying a high voltage to the metal back 1009 via the high-voltage terminal Hv, thus causing the electrons to bombard the phosphor film 1008 and excite the phosphors into a light emitting state so as to display an image. The voltage Va applied to the high-voltage terminal Hv was made 3 to 10 kV and the voltage Vf applied across the pair of element electrodes of the cold cathode elements 1002 was made 14 V.

By making a comparison with an image forming apparatus for experimental purposes using spacers devoid of the semiconductive thin film 1502, it was confirmed that a charging preventing effect could be obtained.

EXAMPLE 3

[Conditions: surface resistance value: $10^{7}$ Ω/□, conductive member: gold (several lines), Anode Voltage: less than 1 kV, no metal back]

This example differs from Example 1 in that nickel oxide having a thickness of 1000 Å was formed as the semiconductive thin film 1502 of the spacer 1500 in an oxygen atmosphere by ion plating using the electron-beam method. The surface resistance value of the semiconductive thin film 1502 was about $10^{7}$ Ω/□.

The face plate 1007 was not provided with the metal back 1009, and a transparent electrode consisting of an ITO film was provided between the face plate and the phosphor film 1008.

The cold cathode elements 1002 in the image forming apparatus using the spacer 1500 were caused to emit electrons by applying a scanning signal and a modulating signal to the cold cathode elements from signal generating means (not shown) via external terminals Dx1~DxM, Dy1~DyN of the envelope. The emitted electron beam was accelerated by applying a high voltage to the transparent electrode via the high-voltage terminal Hv, thus causing the electrons to bombard the phosphor film 1008 and excite the phosphors into a light emitting state so as to display an image. The voltage Va applied to the high-voltage terminal Hv was made less than 1 kV and the voltage Vf applied across the pair of element electrodes of the cold cathode elements 1002 was made 14 V.

At this time rows of equally spaced light-emission spots were formed in two dimensions. These included light-emission spots produced by emitted electrons from the cold cathode elements 1002 at positions in the vicinity of the spacers 1500. A clear color image display having excellent color reproducibility could be obtained. A disturbance in the electric field that would affect the electron path did not occur despite the provision of the spacers 1500.

EXAMPLE 4

[Conditions: surface resistance value: $10^{9}$ Ω/□, conductive member: gold (one line), Anode Voltage: 3~10 kV]

This example differs from Example 1 in the number of lines of the conductive member 1503, with one line having a width of 100 μm being fabricated so as to encircle the spacer 1500 at its central portion.

The cold cathode elements 1002 in the image forming apparatus using the spacer 1500 were caused to emit electrons by applying a scanning signal and a modulating signal to the cold cathode elements from signal generating means (not shown) via external terminals Dx1~DxM, Dy1~DyN of the envelope. The emitted electron beam was accelerated by applying a high voltage to the metal back 1009 via the high-voltage terminal Hv, thus causing the electrons to bombard the phosphor film 1008 and excite the phosphors into a light emitting state so as to display an image. The voltage Va applied to the high-voltage terminal Hv was made 3 to 10 kV and the voltage Vf applied across the pair of element electrodes of the cold cathode elements 1002 was made 14 V.

By making a comparison with an image forming apparatus for experimental purposes using spacers devoid of the semiconductive thin film 1502, it was confirmed in this case also that a charging preventing effect could be obtained.

EXAMPLE 5

[Conditions: surface resistance value: $10^{7}$ Ω/□, conducting member: tin oxide, surface resistance value of conductive member: $10^{5}$ Ω/□ (several lines), Anode Voltage less than 1 kV, no metal back]

This example differs from Example 1 in that tin oxide having a thickness of 1000 Å inclusive of dopant was formed as the conductive member 1503 of the spacer 1500 by ion plating method using the electron-beam. The tin oxide serving as the conductive member 1503 was fabricated by forming four lines of a width of 100 μm and at a spacing of 1 mm so as to each of the four lines make one revolution about the spacer 1500. Other portions were etched. The surface resistance value of the conductive member 1503 was about $10^{5}$ Ω/□.

Next, a film of nickel oxide having a thickness of 1000 Å was formed as the semiconductive thin film 1502 of the spacer 1500. The film was formed in an oxygen atmosphere by ion plating using the electron-beam method. The surface resistance value of the semiconductive thin film 1502 was about $10^{7}$ Ω/□. The face plate 1007 was not provided with the metal back 1009, and a transparent electrode consisting of an ITO film was provided between the face plate and the phosphor film 1008.

The cold cathode elements 1002 in the image forming apparatus using the spacer 1500 were caused to emit electrons by applying a scanning signal and a modulating signal to the cold cathode elements from signal generating means (not shown) via external terminals Dx1~DxM, Dy1~DyN of the envelope. The emitted electron beam was accelerated by applying a high voltage to the transparent electrode via the high-voltage terminal Hv, thus causing the electrons to bombard the phosphor film 1008 and excite the phosphors into a light emitting state so as to display an image. The voltage Va applied to the high-voltage terminal Hv was made less than 1 kV and the voltage Vf applied across the pair of element electrodes of the cold cathode elements 1002 was made 14 V.

At this time rows of equally spaced light-emission spots were formed in two dimensions. These included light-emission spots produced by emitted electrons from the cold cathode elements 1002 at positions in the vicinity of the spacers 1500. A clear color image display having excellent color reproducibility could be obtained. A disturbance in the electric field that would affect the electron path did not occur despite the provision of the spacers 1500.

The advantages of the image forming apparatus of the first embodiment of the invention and the examples thereof are as follows:

First, since charging that is to be prevented occurs at the surface of the spacer 1500, it will suffice if a charging preventing function is obtained solely at the surface portion of the spacer 1500. Accordingly, in this embodiment, the insulating base 1501 was used as the member constituting the spacer 1500, and the semiconductive thin film 1502 was formed on the surface of the insulating base 1501. As a result, it was possible to realize a spacer having a resistance value large enough to counteract charging at the surface of the spacer 1500. The amount of leakage current was not so large as to greatly increase the power consumption of the overall apparatus. Furthermore, the conductive member 1503 is provided along a direction approximately perpendicular to the direction of the electric field between the black conductor 1010 or metal back 1009 and the column-direction wire 1004. As a result, charge at the surface of the spacer 1500 is capable of escaping over the entire circumference of the spacer. This makes possible a further increase in charge escaping performance.

Thus, there was obtained a thin, large-area image forming apparatus without sacrificing the advantage of little evolution of heat, which is a characteristic of a cold cathode such as a surface-conduction electron emission element.

Furthermore, as for the shape of the spacer 1500, a spacer having a plate-shaped configuration whose cross section is uniform in the direction normal to the cold cathode element 1002 and face plate 1007 was employed. As a result, the electric field is not disturbed by the spacer 1500 per se. Accordingly, the spacer 1500 and the cold cathode element 1002 can be placed close together as long as the spacer 1500 does not block the path of the electrons from the cold cathode element 1002. As a result, the electron emission elements could be arrayed at a high density in the X direction, which is perpendicular to the spacer 1500.

Further, the spacer 1500 is electrically connected to one column-direction wire (Dy1~DyN) on the side of the cold cathode element 1002. This made it possible to avoid unnecessary electrical connections between the wires of the cold cathode element 1002. The foregoing effects are obtained by providing the desired semiconductive thin film 1502 and the conductive member 1503. By applying the spacer 1500 of this embodiment, which does not require a complicated additional structure for preventing charging, to an image forming apparatus that uses simple matrix-type electron sources based upon the cold cathode elements 1002 proposed by the present applicant, it was possible to provide a thin-type, large-area image forming apparatus capable of forming a high-quality image through a simple arrangement.

In the first embodiment, charging which occurs at the surface of the insulating member 1501 can be eliminated rapidly by the semiconductive film 1502 formed on the insulating member 1501, and the current density at which the above-mentioned electric charge flows through the semiconductive film 1502 can be made uniform by the conductive member 1503. As a result, even if the quantity of electrons emitted by the electron sources varies in conformity with the formed image, disturbance of the electric field distribution in the vicinity of the insulating member 1501 can be suppressed. In particular, in accordance with the arrangement of this embodiment, the conductive member 1503 is provided to encircle the side surface of the spacer in such a manner that a closed curve is formed. As a result, it is possible to prevent the concentration of an electric field, which tends to occur in a case where the conductive member has end portions, as well as the occurrence of electric spark discharge caused by the concentration of electric field. This makes it possible to accelerate, by a higher voltage, the electrons-emitted by the electron emission elements.

Further, since the conductive member 1503 is covered by the semiconductive film 1502 formed by a subsequent process, this has the effect of weakening the electric field at the boundary of the conductive member 1503 and semiconductive film 1502.

Further, even though the resistance value of the conductive member 1503 is only two places smaller than that of the semiconductive thin film 1502, it was found that a satisfactory charge escaping effect could be obtained.

<Second Embodiment>

[When spacer has conductive member on its outer side]

Figure 15:
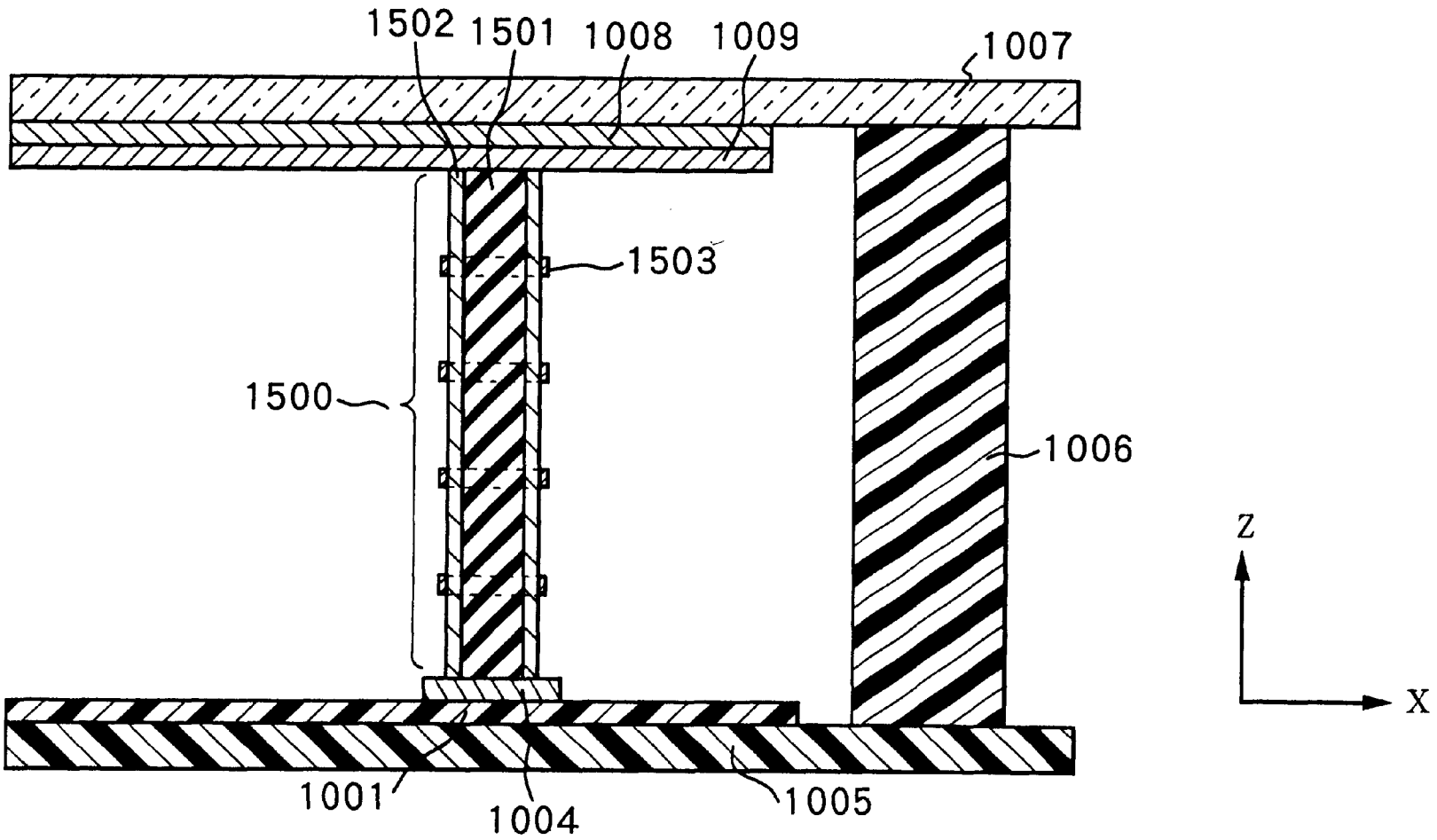
FIG. 15 is a sectional view taken along line B–B' in the vicinity of a spacer in the image forming apparatus of FIG. 1 according to a second embodiment of the present invention.
Figure 16:
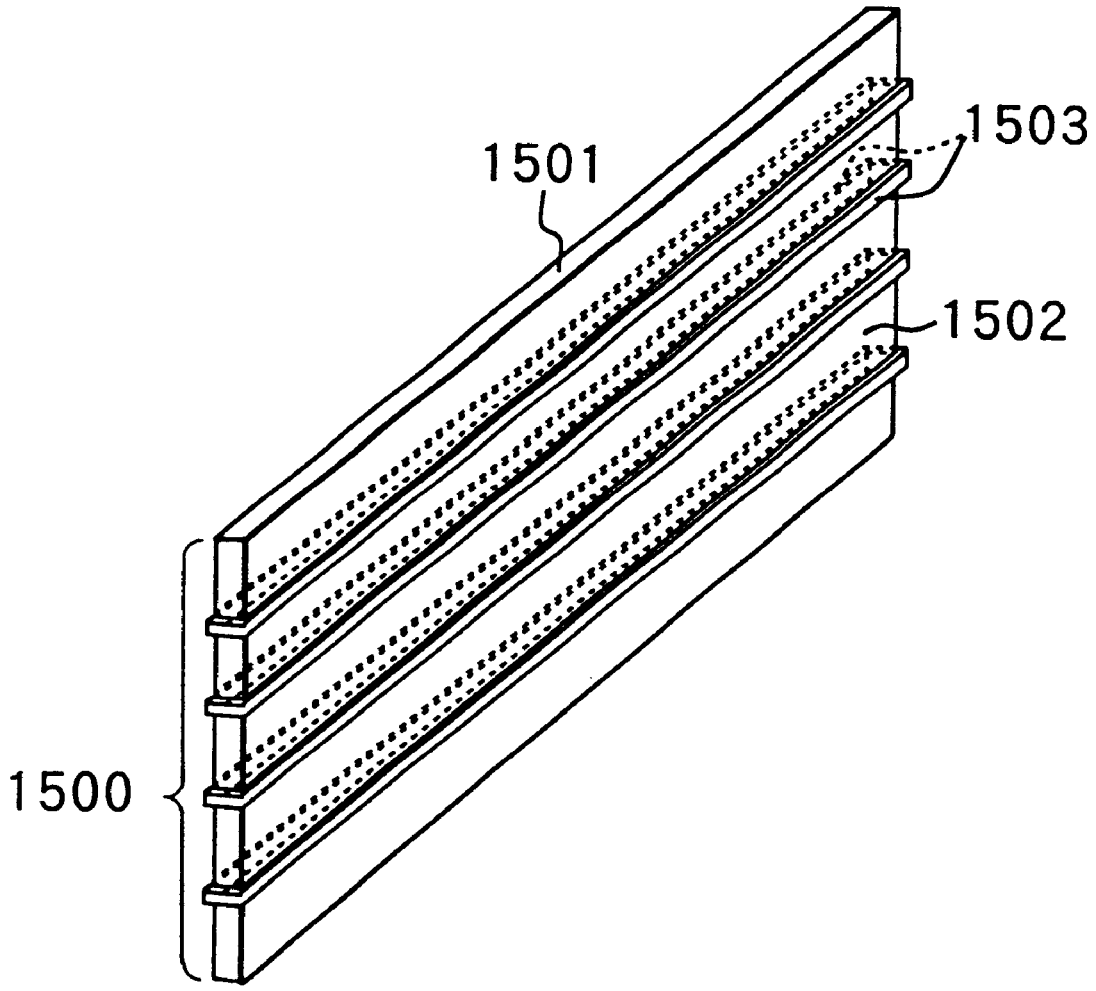
FIG. 16 is a perspective view of a spacer according to the second embodiment of the present invention.

FIGS. 15 and 16 illustrate a second embodiment of the present invention. The second embodiment differs from the first embodiment in the constitution of the spacer. The two embodiments are the same in other aspects.

FIG. 15 is a sectional view taken along line B–B' in the vicinity of the spacer 1500 of the second embodiment in the image forming apparatus shown in FIG. 1. FIG. 16 is a perspective view of the spacer according to the second embodiment.

Since the components of the second embodiment are designated by reference characters the same as those of the first embodiment, these components need not be described again.

Though the second embodiment is structurally the same as the first embodiment, one difference is that the conductive member 1503 of the spacer 1500 is formed on the outer side of the semiconductive film 1502, as illustrated in the drawings. The two embodiments are structurally identical in other aspects.

As shown in FIGS. 15 and 16, the semiconductive thin film 1502 is obtained by forming a group IV semiconductor such as silicon or germanium, a compound semiconductor such as gallium arsenide, an oxide semiconductor such as tin oxide or an impurity semiconductor, which is obtained by adding a trace amount of an impurity to the various semiconductors mentioned above, on the surface of the insulating base 1501 in the amorphous state, polycrystalline state or monocrystalline state. For example, the semiconductive thin film 1502 may be obtained by a vacuum film-forming method such as vacuum deposition, sputtering or chemical vapor deposition, or by applying and calcining an organic solution or a dispersion by dipping or by using a spinner. The semiconductive film 1502 is electrically connected to the black conductor 1010 or metal back 1009 on the side of the face plate 1007 and is electrically connected to the column-direction wire 1004 on the side of the rear plate 1005.

The conductive member 1503 is obtained by forming a thin metal film of aluminum, nickel, copper, silver or gold, etc., a group IV semiconductor such as silicon or germanium, a compound semiconductor such as gallium arsenide, an oxide semiconductor such as tin oxide or an impurity semiconductor, which is obtained by adding an impurity to the various semiconductors mentioned above in an amount greater than that used in the semiconductive film 1502, in the amorphous state, polycrystalline state or monocrystalline state. For example, the conductive member 1503 may be obtained by a vacuum film-forming method such as vacuum deposition, sputtering or chemical vapor deposition, or by applying and calcining an organic solution or a dispersion by dipping or by using a spinner. The conductive member 1503 is formed after the formation of the semiconductive film 1502 on the surface of the insulating base 1501.

One or a plurality of the conductive members 1503 are formed and each is provided along a direction approximately perpendicular to the direction of an electric field between the black conductor 1010 or metal back 1009 and the column-direction wire 1004. Further, the conductive member 1503 is formed to have a width smaller than the distance between the black conductor 1010 or metal back 1009 and the column-direction wire 1004. The semiconductive thin film 1502 and the conductive member 1503 are electrically connected.

EXAMPLE 6

[Conditions: surface resistance value: $10^9$ Ω/□, conductive member: gold (several lines), Anode Voltage: 3~10 kV]

An image forming apparatus that uses the above-described spacer and whose other components were the same as those of the first embodiment was fabricated. The voltage Va applied to the high-voltage terminal Hv was made 3 to 10 kv and the voltage Vf applied across the pair of element electrodes of the cold cathode elements 1002 was made 14 V.

At this time rows of equally spaced light-emission spots were formed in two dimensions. These included light-emission spots produced by emitted electrons from the cold cathode elements 1002 at positions in the vicinity of the spacers 1500. A clear color image display having excellent color reproducibility could be obtained. By making a comparison with an image forming apparatus for experimental purposes using spacers devoid of the semiconductive thin film 1502, it was confirmed that a charging preventing effect could be obtained with the construction of this spacer as well.

<Third Embodiment>

[When spacer has a laminated conductive member]

Figure 17:
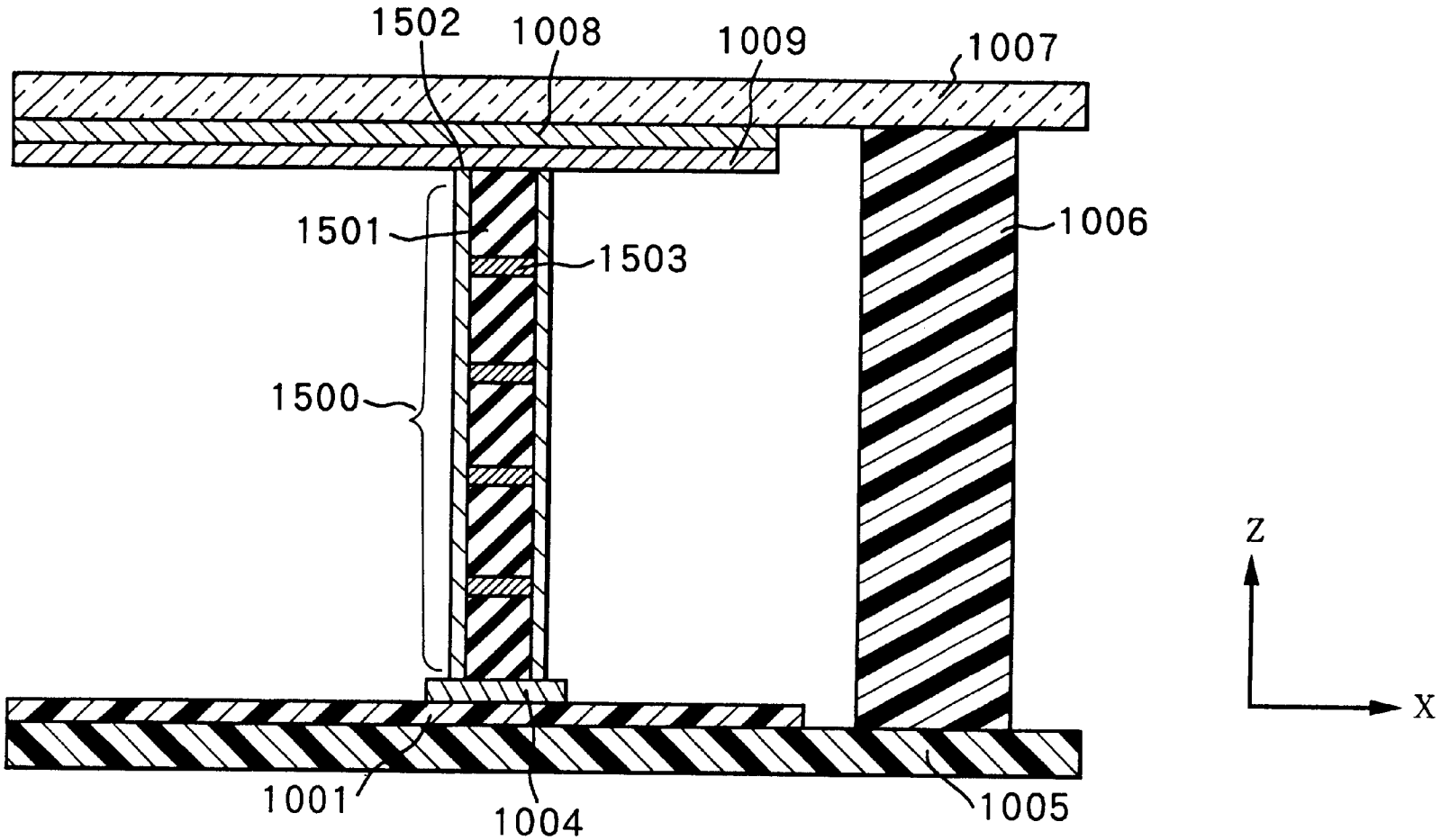
FIG. 17 is a sectional view taken along line B–B' in the vicinity of a spacer in the image forming apparatus of FIG. 1 according to a third embodiment of the present invention.
Figure 18:
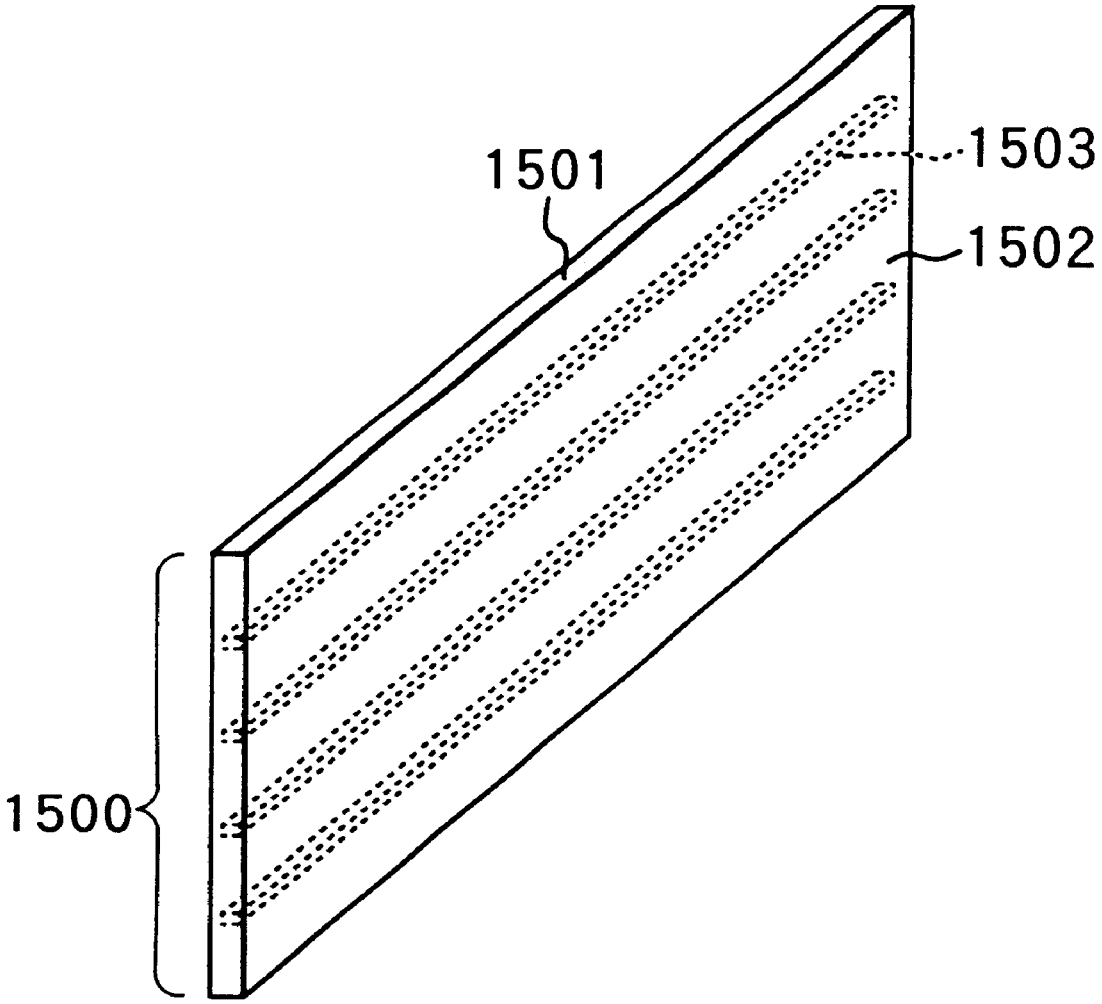
FIG. 18 is a perspective view of a spacer according to the third embodiment of the present invention.

FIGS. 17 and 18 illustrate a third embodiment of the present invention. The third embodiment differs from the first embodiment in the constitution of the spacer. The two embodiments are the same in other aspects.

FIG. 17 is a sectional view taken along line B–B' in the vicinity of the spacer 1500 of the third embodiment in the image forming apparatus shown in FIG. 1. FIG. 18 is a perspective view of the spacer according to the third embodiment.

Since the components of the third embodiment are designated by reference characters the same as those of the first embodiment, these components need not be described again.

Though the third embodiment is structurally the same as the first embodiment, one difference is that the spacer 1500 is formed by stacking layers of the conductive member 1503 and insulating base 1501, as illustrated in FIG. 17. The two embodiments are structurally identical in other aspects.

An advantage of this embodiment is that in a case where a spacer of a high aspect ratio in which the ratio of height to thickness is large is desired, the spacer can be constructed by stacking layers of members having a low aspect ratio.

As shown in FIGS. 17 and 18, the conductive member 1503 is obtained by forming a metal thin film of aluminum, nickel, copper, silver or gold, etc., a group IV semiconductor such as silicon or germanium, a compound semiconductor such as gallium arsenide, an oxide semiconductor such as tin oxide or an impurity semiconductor, which is obtained by adding an impurity to the various semiconductors mentioned above in an amount greater than that used in the semiconductive film 1502, in the amorphous state, polycrystalline state or monocrystalline state. For example, the conductive thin film 1503 may be obtained by a vacuum film-forming method such as vacuum deposition, sputtering or chemical vapor deposition, or by applying and calcining an organic solution or a dispersion by dipping or by using a spinner. The conductive film 1503 is built up with the insulating base 1501 and is formed prior to the formation of the semiconductive film 1502. In general, a conductive thin film is formed on an insulating base, a further insulating base is bonded to the resulting body and a conductive thin film is then formed on this insulating based. This process is repeated to form a member. The member is then cut to form a member having a structure consisting of alternate layers of the insulating base 1501 and conductive member 1503.

Next, the semiconductive thin film 1502 is formed on the surface of this member as follows: The semiconductive thin film is obtained, for example, by forming a group IV semiconductor such as silicon or germanium, a compound semiconductor such as gallium arsenide, an oxide semiconductor such as tin oxide or an impurity semiconductor, which is obtained by adding a trace amount of an impurity to the various semiconductors mentioned above, on the surface of the member in the amorphous state, polycrystalline state or monocrystalline state. For example, the semiconductive thin film 1502 may be obtained by a vacuum film-forming method such as vacuum deposition, sputtering or chemical vapor deposition, or by applying and calcining an organic solution or a dispersion by dipping or by using a spinner. The semiconductive film 1502 is electrically connected to the black conductor 1010 or metal back 1009 on the side of the face plate 1007 and is electrically connected to the column-direction wire 1004 on the side of the rear plate 1005.

One or a plurality of the conductive members 1503 are formed and each is provided along a direction approximately perpendicular to the direction of an electric field between the black conductor 1010 or metal back 1009 and the column-direction wire 1004. Further, the conductive member 1503 is formed to have a thickness smaller than the distance between the black conductor 1010 or metal back 1009 and the column-direction wire 1004. The semiconductive thin film 1502 and the conductive member 1503 are electrically connected.

EXAMPLE 7

[Conditions: surface resistance value: $10^9$ Ω/□, conductive member: gold (several lines), Anode Voltage: 3~10 kV]

An image forming apparatus that uses the above-described spacer and whose other components were the same as those of the first embodiment was fabricated. The voltage Va applied to the high-voltage terminal Hv was made 3 to 10 kv and the voltage Vf applied across the pair of element electrodes of the cold cathode elements 1002 was made 14 V.

At this time rows of equally spaced light-emission spots were formed in two dimensions. These included light-emission spots produced by emitted electrons from the cold cathode elements 1002 at positions in the vicinity of the spacers 1500. A clear color image display having excellent color reproducibility could be obtained. By making a comparison with an image forming apparatus for experimental purposes using spacers devoid of the semiconductive thin film 1502, it was confirmed that a charging preventing effect could be obtained with the construction of this spacer as well.

<Fourth Embodiment>

[Columnar spacer]

Figure 19:
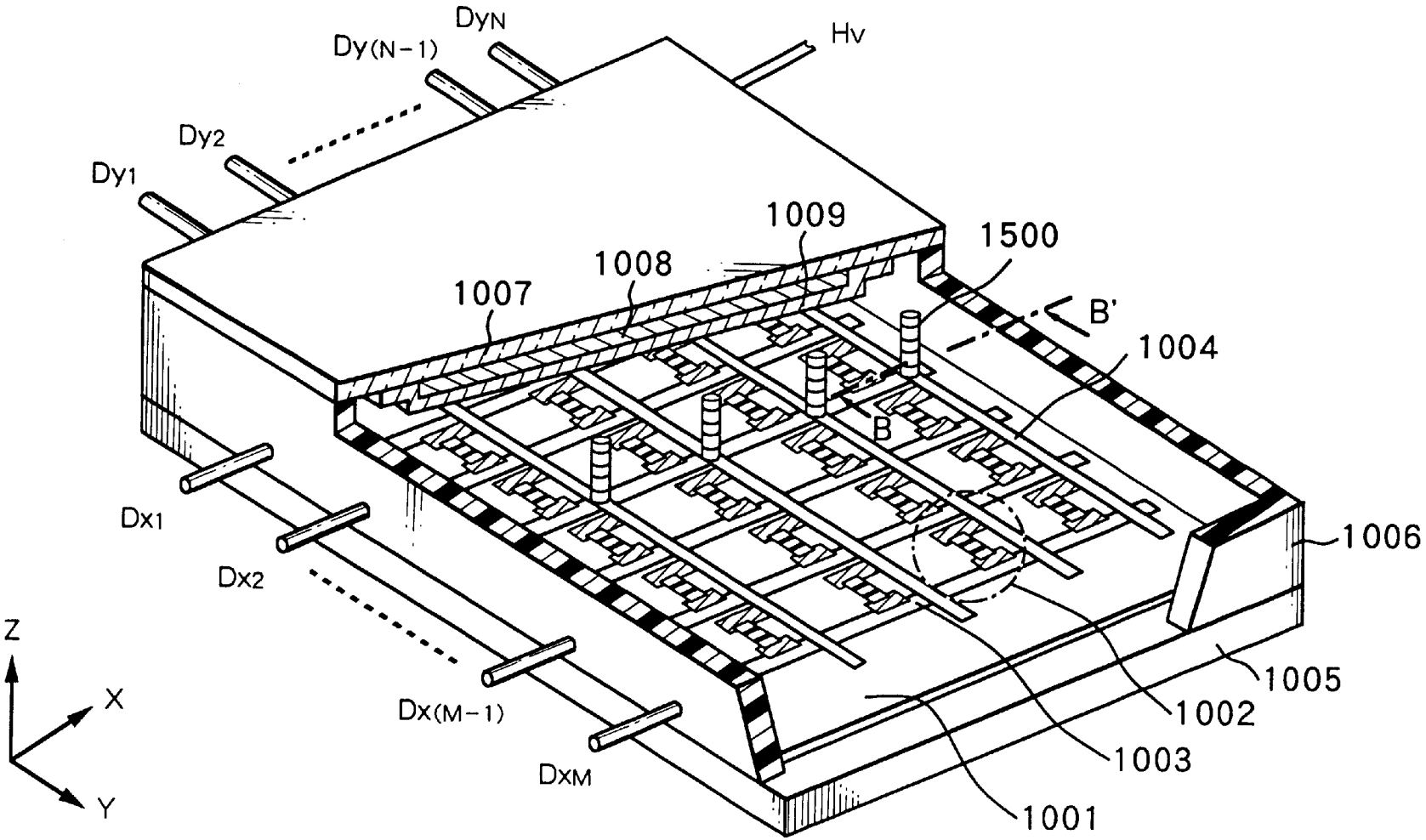
FIG. 19 is a perspective view, partially broken away, illustrating a fourth embodiment of an image forming apparatus according to the present invention.
Figure 20:
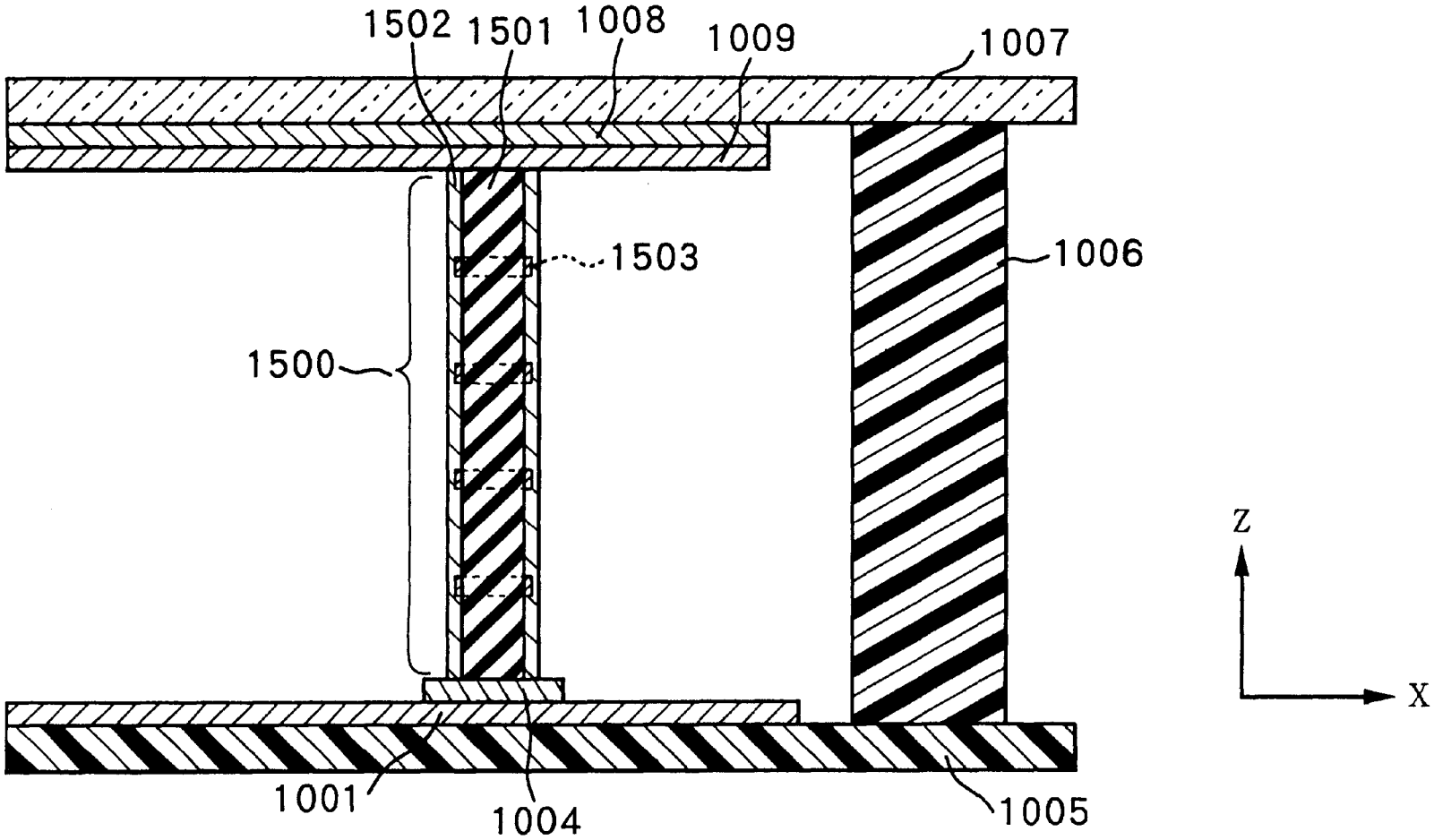
FIG. 20 is a sectional view taken along line B–B' in the vicinity of a columnar spacer in the image forming apparatus of FIG. 19.
Figure 21:
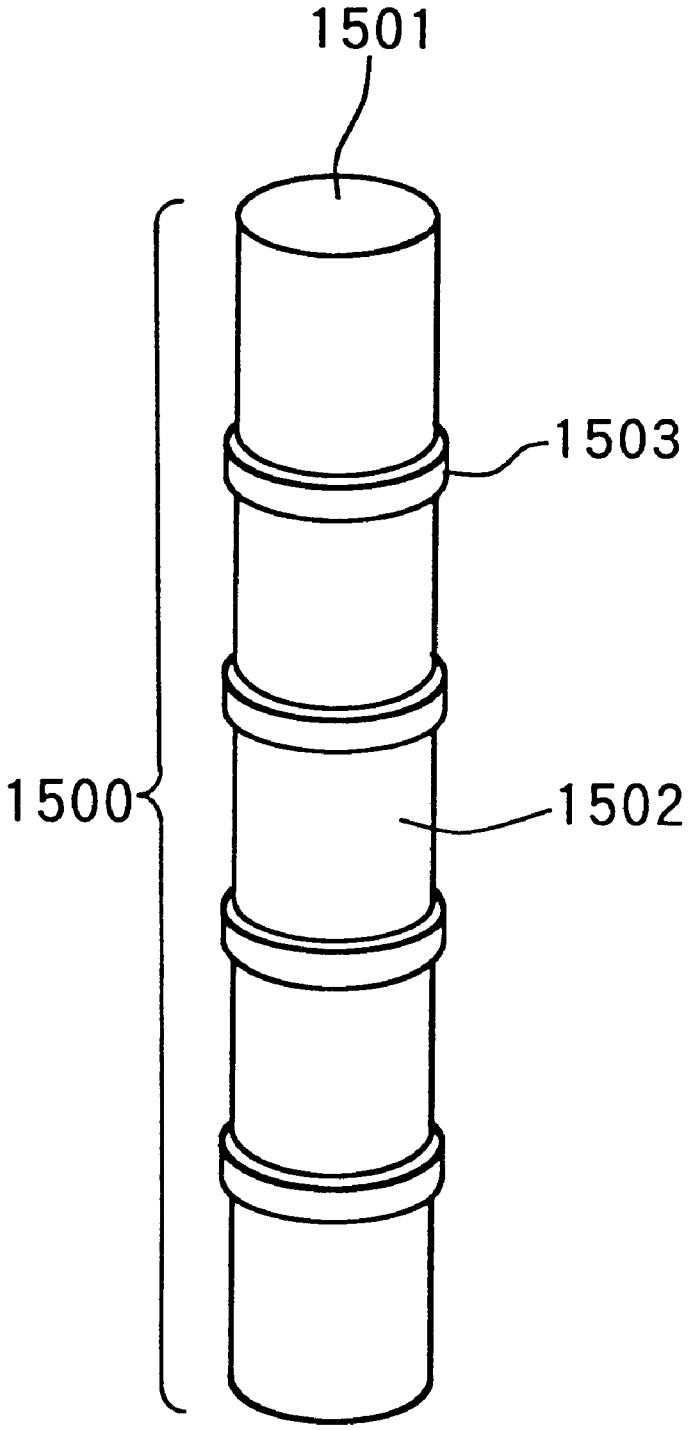
FIG. 21 is a perspective view of a cylindrical spacer according to the fourth embodiment of the present invention.

This embodiment differs from the first embodiment in that use is made of a columnar shaped spacer. FIGS. 19, 20 and 21 illustrate a fourth embodiment. The difference between the fourth embodiment and the first embodiment is that the shape of the spacer according to the former is columnar. The two embodiments are structurally the same in other aspects.

FIG. 19 is a perspective view of an image forming apparatus according to the fourth embodiment of the present invention. Part of a panel is broken away to reveal the internal structure of the apparatus. Components in FIG. 19 identical with those shown in FIG. 1 are designated by like reference characters and need not be described again.

FIG. 20 is a sectional view taken along line B–B' of FIG. 19. Components identical with those shown in FIG. 19 are designated by like reference characters.

FIG. 21 is a perspective view of a spacer according to the fourth embodiment. With the exception of its shape, the spacer is similar to that of the first embodiment and therefore a description of its structural components and method of formation, etc., need not be described again. The columnar spacer 1500 has a diameter smaller than the spacing between a plurality of cold cathode elements 1002.

EXAMPLE 8

[Conditions: surface resistance value: $10^9$ Ω/□, conductive member: gold (several lines), Anode Voltage: 3~10 kV]

An image forming apparatus that uses the above-described spacer and whose other components were the same as those of the first embodiment was fabricated. The voltage Va applied to the high-voltage terminal Hv was made 3 to 10 kv and the voltage Vf applied across the pair of element electrodes of the cold cathode elements 1002 was made 14 V.

At this time rows of equally spaced light-emission spots were formed. These included light-emission spots produced by emitted electrons from the cold cathode elements 1002 at positions,in the vicinity of the spacers 1500. A clear color image display having excellent color reproducibility could be obtained. By making a comparison with an image forming apparatus for experimental purposes using spacers devoid of the semiconductive thin film 1502, it was confirmed that a charging preventing effect could be obtained with the construction of this spacer as well.

In this embodiment, the experiments were conducted using the columnar spacer. However, if the spacer is smaller than the spacing of the plurality of cold cathode elements 1002, the effects of the present invention can be obtained if the spacer has the shape of a quadrangular prism, a triangular prism or a hexagonal prism.

In a case where a partial fault (only partial conduction) develops in the connection between the semiconductive thin film 1502 and the black conductor 1010 or metal back 1009 on the side of the face plate 1007 or in the connection between the semiconductive thin film 1502 and the column-direction wire 1004 on the side of the rear plate 1005, it was found through experiments that the spacer according to the present invention in which both the semiconductive thin film 1502 and conductive member 1503 are formed is superior to a spacer having only the semiconductive thin film 1502 formed on the surface. Rows of equally spaced light-emission. spots were better formed in two dimensions. These included light-emission spots produced by emitted electrons from the cold cathode elements 1002 at positions in the vicinity of the spacers 1500. A clear color image display having excellent color reproducibility could be obtained.

The reason for this is believed to be that the potential distribution of the semiconductive film 1502 on the surface of the spacer lies parallel, at least between the conductive members 1503, to an electric field produced by the black conductor 1010 or metal back 1009 on the side of the face plate 1007 and the column-direction wire 1004 on the side of the rear plate 1005, as a result of which no change is caused in the path of the electrons that travel in the vicinity. For this reason, it was found that the arrangement according to the present invention is effective even in a case where a partial fault tends to develop in the connection between the semiconductive thin film 1502 and the black conductor 1010 or metal back 1009 on the side of the face plate 1007 or in the connection between the semiconductive thin film 1502 and the column-direction wire 1004 on the side of the rear plate 1005.

In a case where the resistance values of the semiconductive thin film 1502 are the same, it was found through experiments that the spacer according to the present invention in which both the semiconductive thin film 1502 and conductive member 1503 are formed is superior to a spacer having only the semiconductive thin film 1502 formed on the surface in terms of obtaining a larger charge escaping effect in regard to charging caused by partial accumulation of ions. The reason is believed to be as follows: In the absence of the conductive member 1503, a charge escaping current flows into the semiconductive film 1502 only in the vicinity of the charged location in regard to part of the charge. However, between conductive members other than the conductive member at the charged location, a charge escaping current is capable of flowing through the entirety of the semiconductive thin film 1502 that surrounds the spacer. As a consequence, a large charge escaping current is readily obtained.

<Fifth Embodiment>

In addition to the spacers having the various constructions described in the foregoing embodiments, it is possible to use a spacer provided with electrodes to improve the electrical connection between the end face of the semiconductive film in contact with the face plate 1007 and the end face of the semiconductive film in contact with the rear plate 1005.

Figure 22:
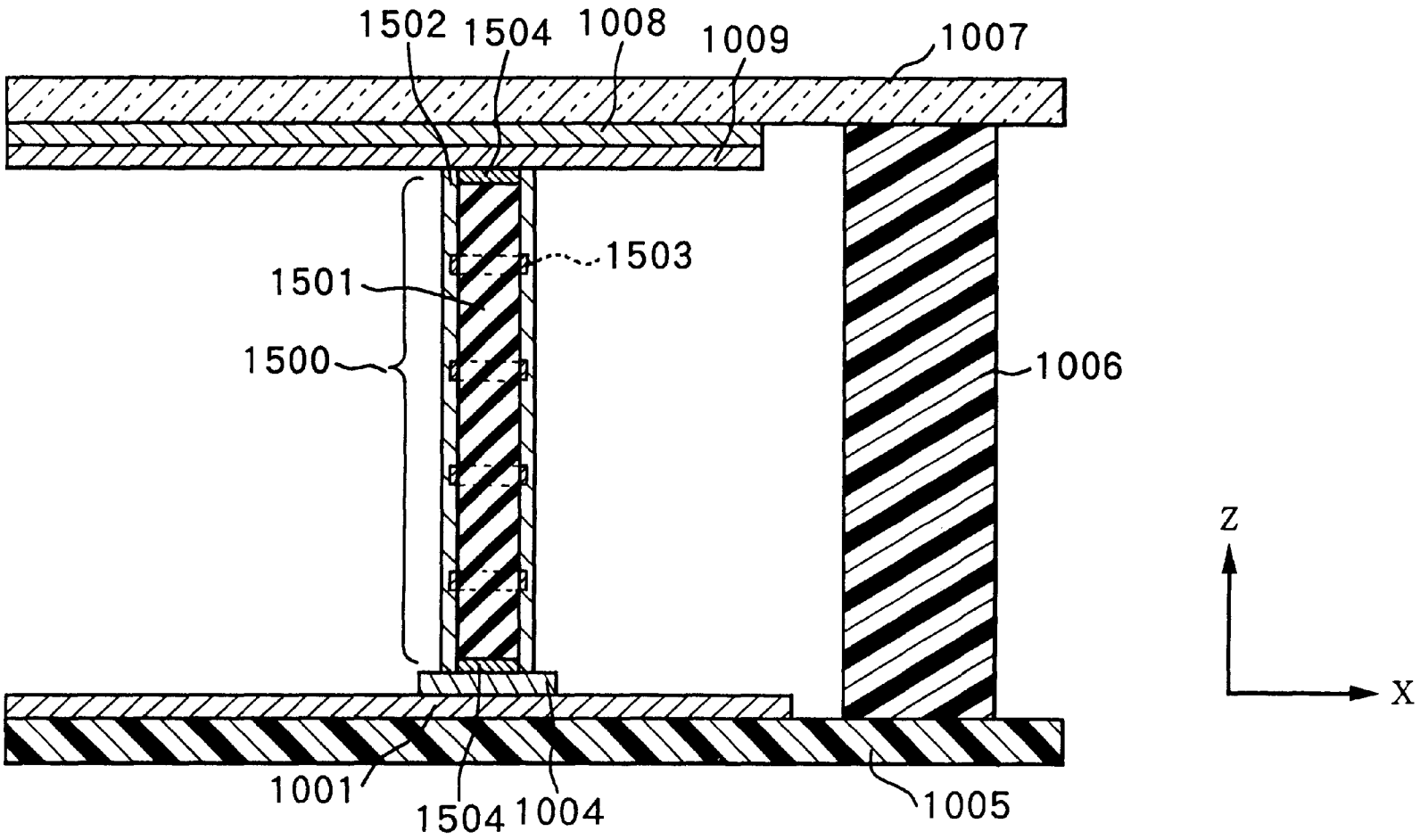
FIG. 22 is a sectional view of the inventive apparatus in which an electrically conductive intermediate layer is provided between a spacer and an electrode.
Figure 23:
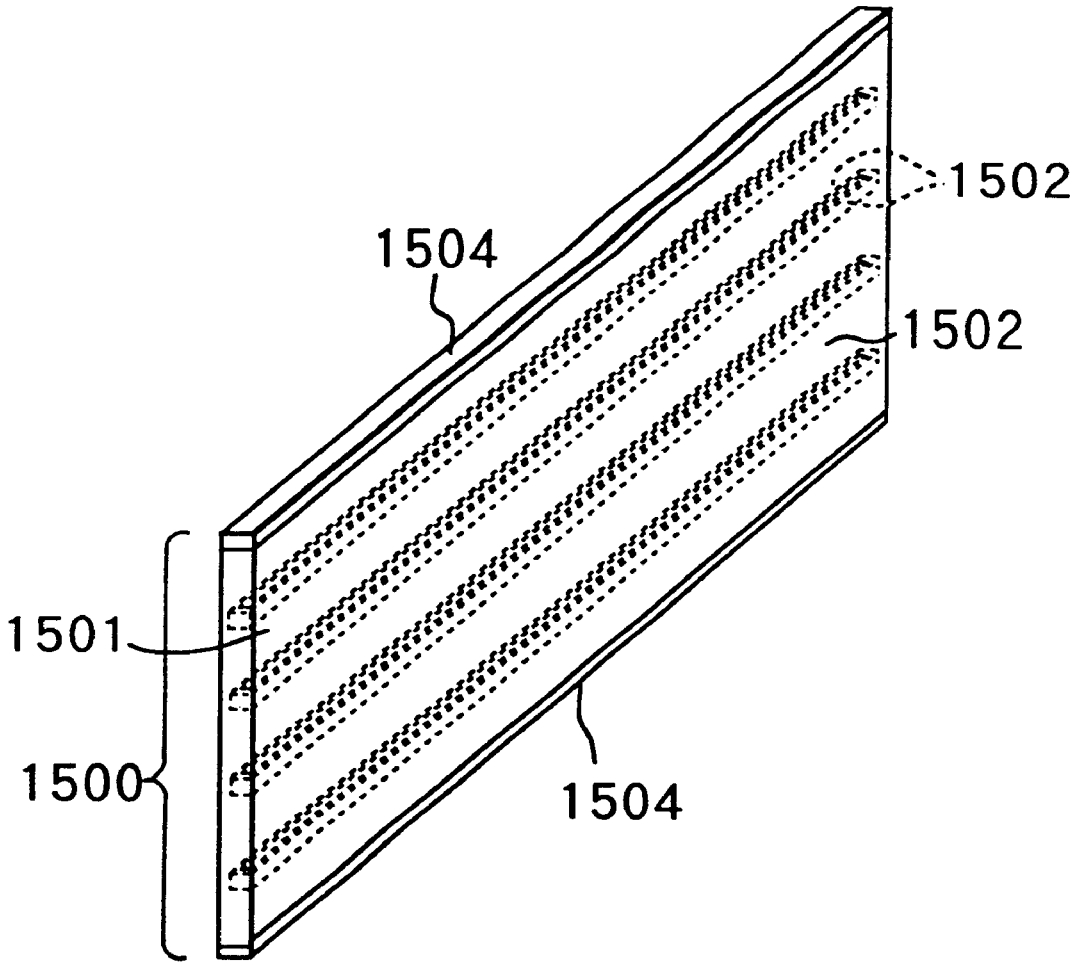
FIG. 23 is a perspective view showing a plate-shape spacer according to the invention provided with an electrically conductive layer at the connection to an electrode.
Figure 24:
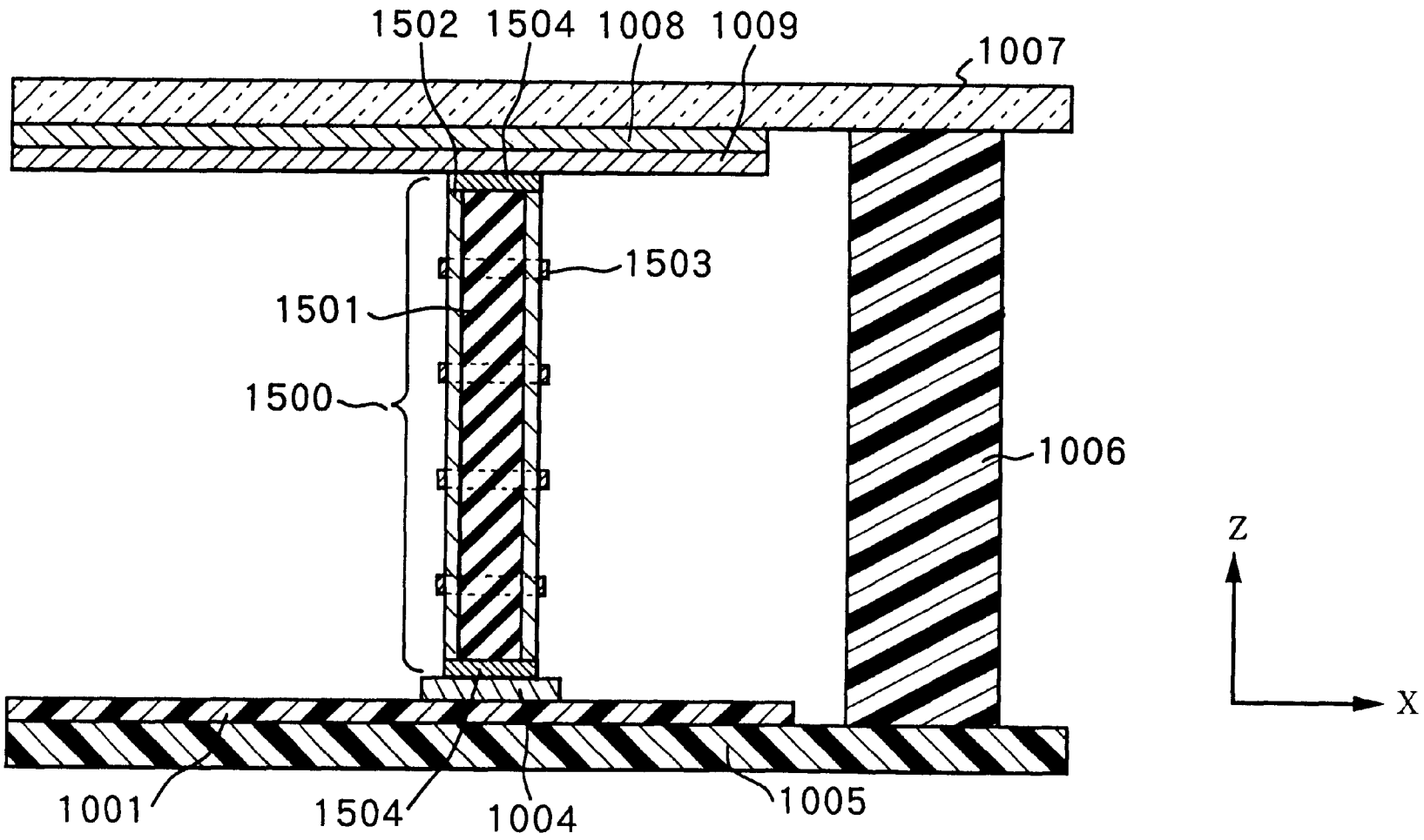
FIG. 24 is a sectional view of the inventive apparatus in which an electrically intermediate layer is provided between a spacer and an electrode.
Figure 25:
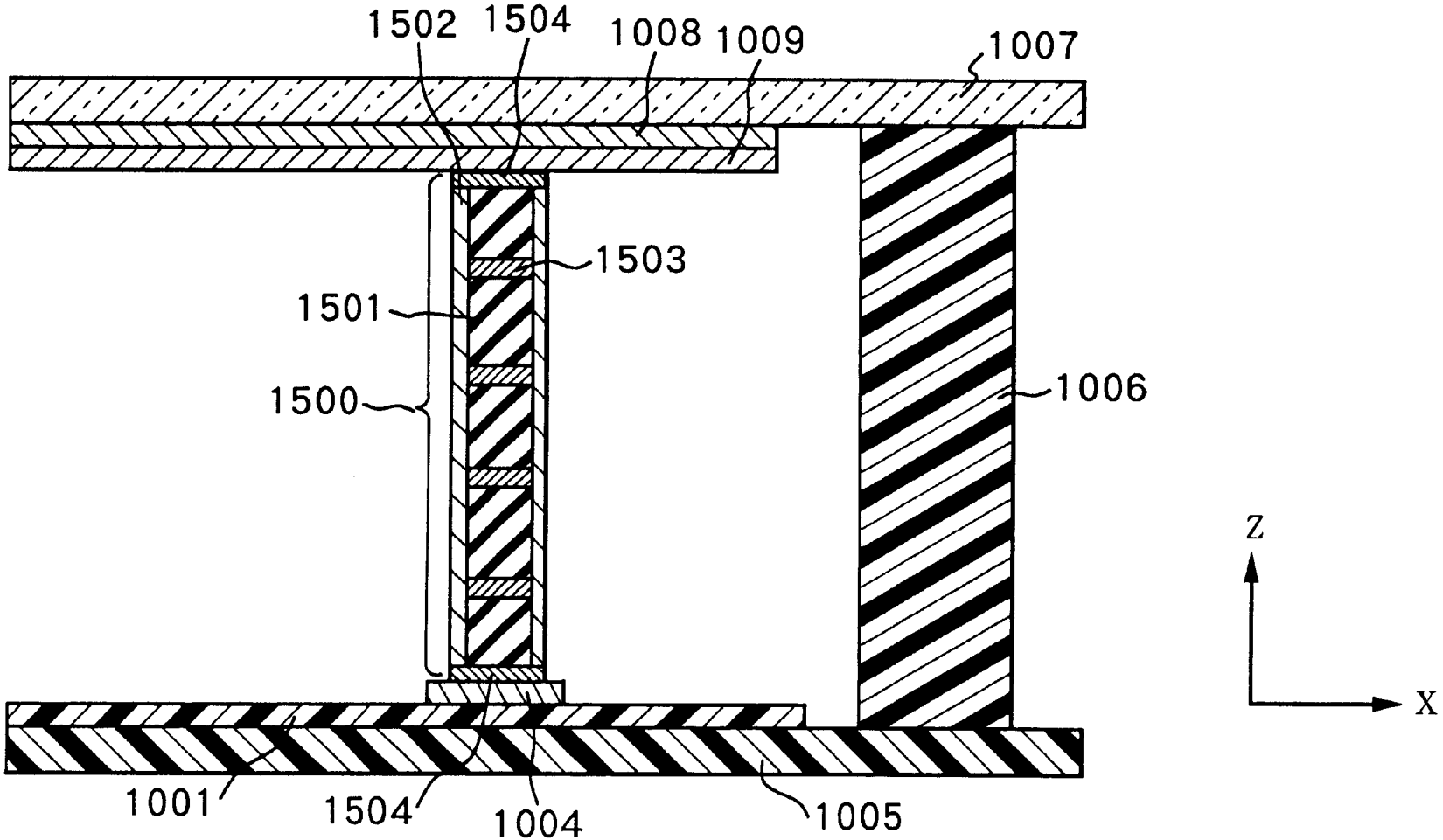
FIG. 25 is a sectional view of the inventive apparatus in which an electrically conductive intermediate layer is provided between a spacer and an electrode.
Figure 26:
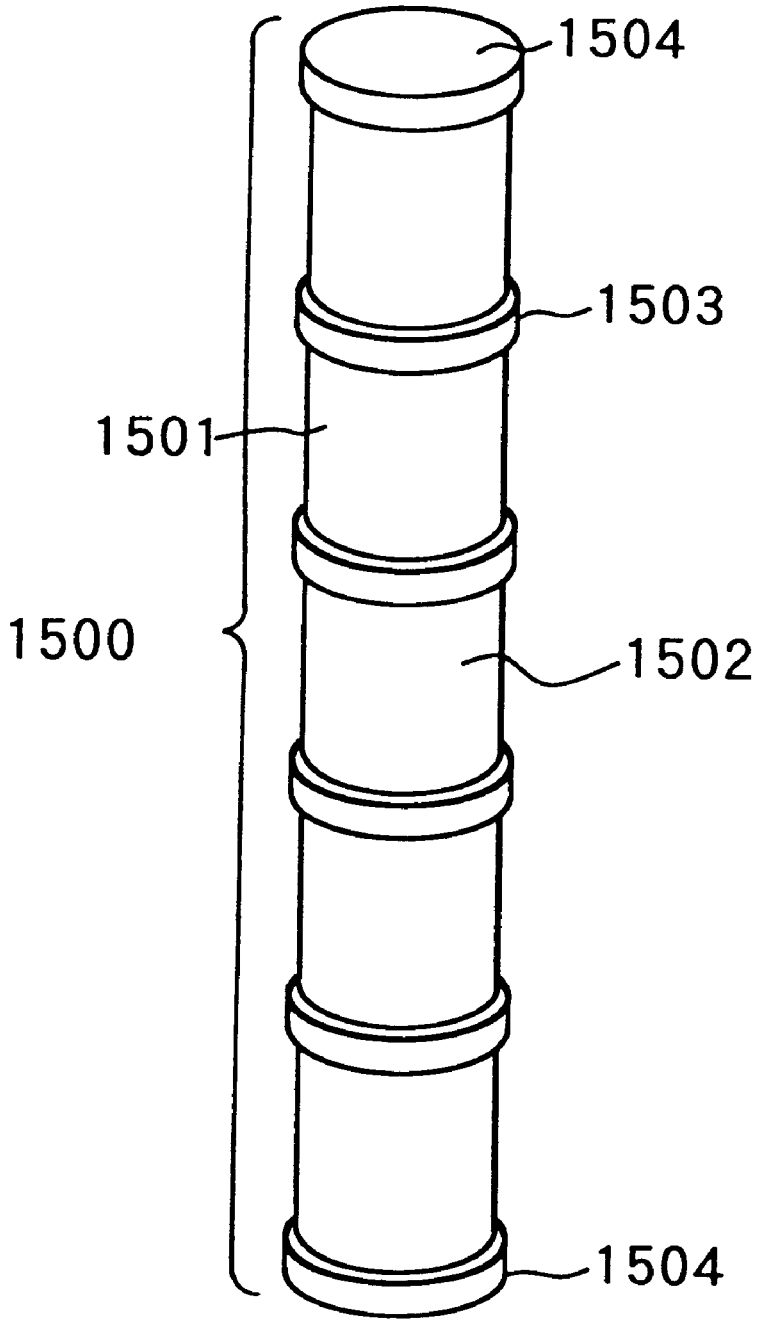
FIG. 26 is a perspective view showing a cylindrical spacer according to the invention provided with an electrically conductive layer at the connection to an electrode.

FIGS. 22 through 26 are diagrams illustrating arrangements of spacers used in this embodiment. FIGS. 22 and 23 correspond to the plate-shaped spacer of the first embodiment, in which the semiconductive film 1502 is formed after the conductive member 1503. FIG. 24 corresponds to the plate-shaped spacer of the second embodiment in which the conductive member 1503 is formed after the semiconductive thin film 1502. FIG. 25 corresponds to the spacer of the third embodiment in which alternate layers of the conductive member 1503 and insulating base 1501 are stacked. FIG. 26 corresponds to the spacer of the fourth embodiment in which the columnar spacer is formed.

In FIGS. 22 through 26, electrodes 1504 are electrically connected to the semiconductive film 1502. In the image forming apparatus, the electrodes 1504 are electrically connected to metal back 1009 on the inner surface of the face plate 1007 and to the wiring 1004 on the inner surface of the rear plate 1005.

<Sixth Embodiment>

Examples in which spacers described in the foregoing embodiments are disposed in an image forming apparatus will now be illustrated.

Figure 27:
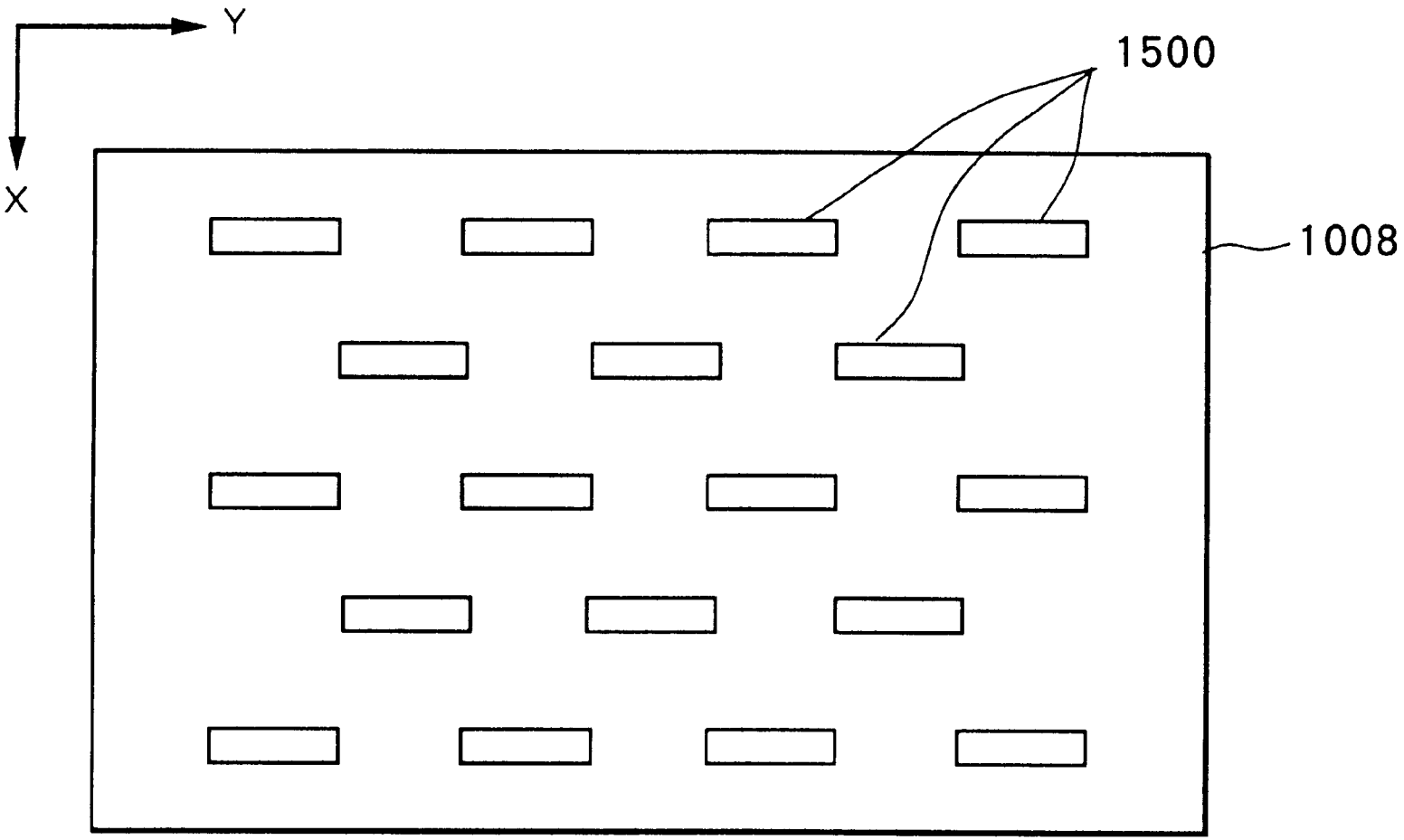
FIG. 27 is a plan view showing a layout (zigzag) of spacers according to the present invention.
Figure 28:
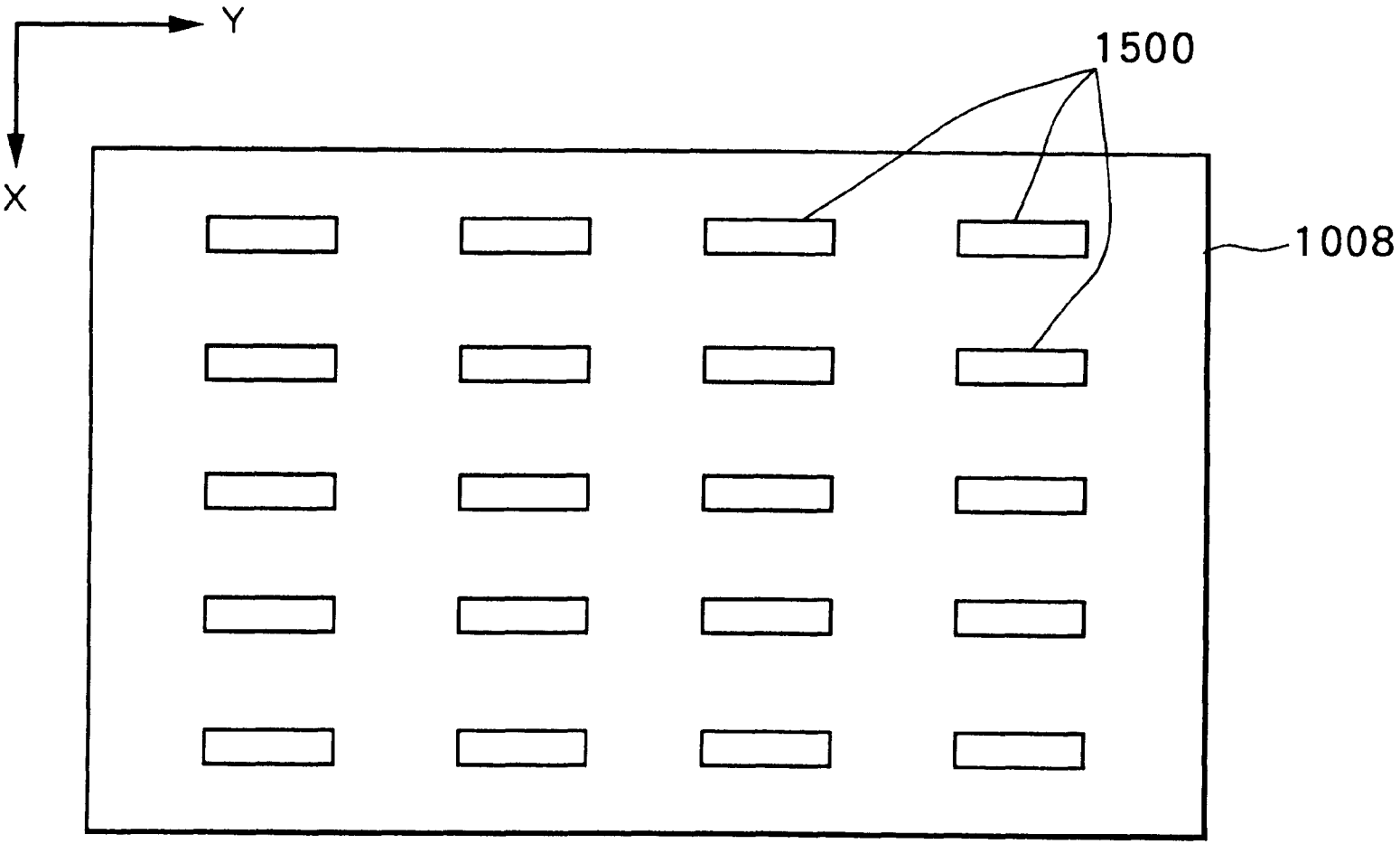
FIG. 28 is a plan view showing a layout (parallel) of spacers according to the present invention.

FIGS. 27 and 28 illustrate arrangements of spacers when viewed from the side of the face plate 1007 of the image forming apparatus according to the present invention. The spacers 1500 are disposed within the limits of the phosphor film 1008 that constitutes the image display area. The spacers 1500 have a staggered arrangement in FIG. 27 and a parallel arrangement in FIG. 28.

By thus arraying spacers, which are smaller than the length of the image display area, discontinuously in the image display area, the atmosphere within the envelope during the assembly of the image forming apparatus or in the evacuated state can be maintained more uniformly in comparison with a case (U.S. Pat. No. 5,532,548) in which spacers larger than the image display area are used. This provides desirable effects in terms of improving the characteristics and lifetime of the electron emission elements that construct the electron sources.

(Other Embodiments)

The construction of the invention in the foregoing embodiments has been described on the basis of cold cathode electron emission elements. However, it goes without saying that the invention is applicable to all types of electron emission elements as well. Further, the present invention can be applied to an image forming apparatus using electron sources of a type other than the simple matrix type. For example, there is a case in which a support member (spacer) of the above-mentioned type is used in an image forming apparatus providing a control electrode of the kind described in Japanese Patent Application Laid-Open No. 2-257551.

In accordance with the embodiments, the invention is not limited to an image forming apparatus suitable for a display. The image forming apparatus can be used as a light-emitting source employed as an alternative for the light-emitting diode in an optical printer which includes a photosensitive drum and a light-emitting diode. By suitably selecting the M-number of row-direction wires and N-number of column-direction wires, the apparatus can be used not only as a line-shaped light-emitting source but also as a two-dimensional light-emitting source.

Further, in accordance with the embodiments, the present invention is applicable also to a case where the member irradiated by electrons emitted from an electron source is a member other than an image forming member, as in the manner of an electron microscope, for example. Accordingly, it goes without saying that the present invention can take on the form of an electron beam generator in which the irradiated member is not specified.

Further, the embodiments illustrate examples in which the spacer 1500 is electrically connected to the black conductor 1010 or metal back 1009 on the side of the face plate 1007 and to the column-direction wire 1004 on the side of the rear plate 1005. However, the effect in which the path of electrons emitted from an electron source in the vicinity of a structural member is not influenced by the member can be obtained by the arrangement of the present invention even for a structural member between electrodes having different potentials in a hermetic envelope.

Figure 29:
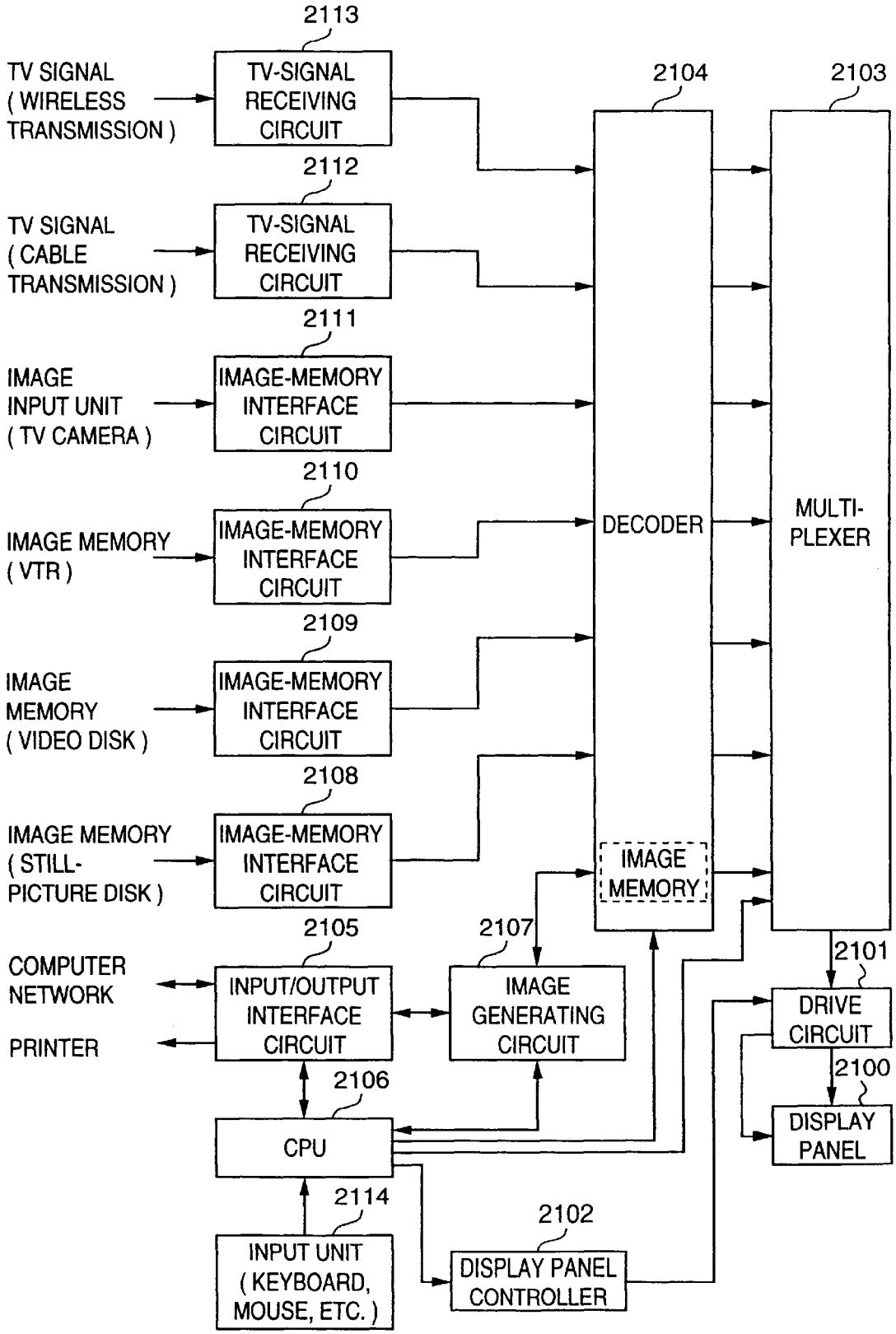
FIG. 29 is a block diagram showing an example of a multifunction image display apparatus which uses an image display device according to an embodiment of the present invention.

FIG. 29 is a diagram showing an example of a multifunction display apparatus constructed in such a manner that image information supplied from various image information sources, the foremost of which is a television (TV) broadcast, can be displayed on a display panel in which the surface-conduction electron emission elements described above are used as the electron beam sources.

Shown in FIG. 29 are a display panel 2100, a drive circuit 2101 for the display panel, a display controller 2102, a multiplexer 2103, a decoder 2104, an input/output interface circuit 2105, a CPU 2106, an image forming circuit 2107, image-memory interface circuits 2108, 2109 and 2110, an image-input interface circuit 2111, TV-signal receiving circuits 2112, 2113, and an input unit 2114.

In a case where the display apparatus of this embodiment receives a signal containing both video information and audio information, as in the manner of a television signal, for example, audio is of course reproduced at the same time that video is displayed. However, circuitry and speakers related to the reception, separation, reproduction, processing and storage of audio information not directly related to the features of this invention are not described.

The functions of the various units will be described in accordance with the flow of the image signal.

First, the TV-signal receiving circuit 2113 receives a TV image signal transmitted using a wireless transmission system that relies upon radio waves, optical communication through space, etc. The system of the TV signals received is not particularly limited. Examples of the systems are the NTSC system, PAL system and SECAM system, etc. ATV signal comprising a greater number of scanning lines (e.g., a so-called high-definition TV signal such as one based upon the MUSE system) is a signal source that is ideal for exploiting the advantages of the above-mentioned display panel suited to enlargement of screen area and to an increase in the number of pixels. A TV signal received by the TV-signal receiving circuit 2113 is output to the decoder 2104.

The TV-signal receiving circuit 2112 receives the TV image signal transmitted by a cable transmission system using coaxial cable or optical fibers, etc. As in the case of the TV-signal receiving circuit 2113, the system of the received TV signal is not particularly limited. Further, the TV signal received by this circuit also is output to the decoder 2104.

The image-input interface circuit 2111 is a circuit for accepting an image signal supplied by an image input unit such as a TV camera or image reading scanner. The accepted image signal is output to the decoder 2104.

The image-memory interface circuit 2110 accepts an image signal that has been stored in a video tape recorder (hereinafter abbreviated to VTR) and outputs the accepted image signal to the decoder 2104. The image-memory interface circuit 2109 accepts an image signal that has been stored on a video disk and outputs the accepted image signal to the decoder 2104.

The image-memory interface circuit 2108 acquires an image signal from a device storing still-picture data, such as a so-called still-picture disk, and outputs the acquired still-picture data to the decoder 2104.

The input/output interface circuit 2105 is a circuit for connecting the display apparatus and an external computer, computer network or output device such as a printer. It is of course possible to input/output image data, character data and graphic information and, depending upon the case, it is possible to input/output control signals and numerical data between the CPU 2106, with which the display apparatus is equipped, and an external unit.

The image generating circuit 2107 is for generating display image data based upon image data and character/graphic information entered from the outside via the input/output interface circuit 2105 or based upon image data character/graphic information output by the CPU 2106. By way of example, the circuit is internally provided with a rewritable memory for storing image data or character/graphic information, a read-only memory in which image patterns corresponding to character codes hare been stored, and a circuit necessary for generating an image, such as a processor for executing image processing. The display image data generated by the image generating circuit 2107 is output to the decoder 2104. In certain cases, however, it is possible to input/output image data relative to an external computer network or printer via an input/output interface circuit 2105.

The CPU 2106 mainly controls the operation of the display apparatus and operations relating to the generation, selection and editing of display images.

For example, the CPU outputs a control signal to the multiplexer 2103 to suitably select or combine image signals displayed on the display panel. At this time the CPU generates a control signal for the display panel controller 2102 in conformity with the image signal displayed and suitably controls the operation of the display apparatus, such as the frequency of the screen display, the scanning method (interlaced or non-interlaced) and the number of screen scanning lines.

Furthermore, the CPU 2106 outputs image data and character/graphic information directly to the image generating circuit 2107 or accesses the external computer or memory via the input/output interface circuit 2105 to enter the image data or character/graphic information. It goes without saying that the CPU 2106 may also be used for purposes other than these. For example, the CPU 21106 may be directly applied to a function for generating and processing information, as in the manner of a personal computer or word processor. Alternatively, the CPU 2106 may be connected to an external computer network via the input/output interface circuit 2105, as mentioned above, so as to perform an operation such as numerical computation in cooperation with external equipment.

The input unit 2114 is for allowing the user to enter instructions, programs or data into the CPU 2106. Examples are a keyboard and mouse or various other input devices such as a joystick, bar code reader, audio recognition unit, etc.

The decoder 2104 is a circuit for reversely converting various image signals, which enter from the units 2107~2113, to color signals of the three primary colors or to a luminance signal and I, Q signals.

It is desired that the decoder 2104 be internally equipped with an image memory, as indicated by the dashed line. This is for the purpose of handling a television signal that requires an image memory when performing the reverse conversion, as in a MUSE system, by way of example. Providing the image memory is advantageous in that display of a still picture is facilitated and in that, in cooperation with the image generating circuit 2107 and CPU 2106, editing and image processing such as thinning out of pixels, interpolation, enlargement, reduction and synthesis are facilitated.

The multiplexer 2103 suitably selects the display image based upon a control signal which enters from the CPU 2106. More specifically, the multiplexer 2103 selects a desired image signal from among the reversely-converted image signals which enter from the decoder 2104 and outputs the selected signal to the drive circuit 2101. In this case, by changing over and selecting the image signals within the display time of one screen, one screen can be divided up into a plurality of areas and images which differ depending upon the area can be displayed as in the manner of a multiple-screen television.

The display panel controller 2102 controls the operation of the drive circuit 2101 based upon the control signal which enters from the CPU 2106.

With regard to the basic operation of the display panel controller 2102, a signal for controlling the operating sequence of a driving power supply (not shown) for the display panel 2100 is output to the drive circuit 2101, by way of example. In relation to the method of driving the display panel, a signal for controlling, say, the screen display frequency or scanning method (interlaced or non-interlaced) is output to the drive circuit 2101.

Further, there is a case in which a control signal relating to adjustment of picture quality, namely luminance of the display image, contrast, tone and sharpness, is output to the drive circuit 2101.

The drive circuit 2101 is a circuit for generating a drive signal applied to the display panel 2100 and operates based upon the image signal which enters from the multiplexer 2103 and the control signal which enters from the display panel controller 2102.

The functions of the various units are as described above. By using the arrangement shown in FIG. 29, image information which enters from a variety of image information sources can be displayed on the display panel 2100 in the display apparatus of this embodiment. Specifically, various image signals, the foremost of which is a television broadcast signal, are reversely converted in the decoder 2104, suitably selected in the multiplexer 2103 and entered into the drive circuit 2101. On the other hand, the display controller 2102 generates a control signal for controlling the operation of the drive circuit 2101 in dependence upon the image signal displayed. On the basis of the aforesaid image signal and control signal, the drive circuit 2101 applies a drive signal to the display panel 2100. As a result, an image is displayed on the display panel 2100. This series of operations is under the overall control of the CPU 2106.

Further, in the display apparatus of this embodiment, the contribution of the image memory incorporated within the decoder 2104, the image generating circuit 2107 and CPU 2106 makes it possible not only to display image information selected from a plurality of items of image information but also to subject the displayed image information to image processing such as enlargement, reduction, rotation, movement, edge emphasis, thinning-out, interpolation, color conversion and vertical-horizontal ratio conversion and to image editing such as synthesis, erasure, connection, substitution and fitting.

Further, though not particularly touched upon in the description of this embodiment, it is permissible to provide a special-purpose circuit for performing processing and editing with regard also to audio information in the same manner as the image processing and image editing set forth above. Accordingly, the display apparatus of this invention is capable of being provided with various functions in a single unit, such as the functions of TV broadcast display equipment, office terminal equipment such as television conference terminal equipment, image editing equipment for handling still pictures and moving pictures, computer terminal equipment and word processors, games, etc. Thus, the display apparatus has wide application for industrial and private use.

FIG. 29 merely shows an example of the construction of a multifunction display apparatus using a display panel in which the surface-conduction emission elements are electron beam sources. However, the apparatus is not limited to this arrangement. For example, circuits relating to functions not necessary for the particular purpose of use may be deleted from the structural elements of FIG. 29. Conversely, depending upon the purpose of use, structural elements may be additionally provided. For example, in a case where the display apparatus is used as a TV telephone, it would be ideal to add a transmitting/receiving circuit inclusive of a television camera, audio microphone, illumination equipment and modem to the structural elements.

In the display apparatus of this embodiment, a display panel in which surface-conduction electron emission elements serve as the electron beam sources can be reduced in thickness with ease. This makes it possible to reduce the overall size of the display apparatus in the depth direction. In addition, a display panel in which surface-conduction electron emission elements serve as the electron beam sources can readily be enlarged in terms of screen size, and the display panel excels in its high luminance and viewing angle characteristic. This means that it is possible for the display apparatus to display, with excellent visual clarity, an image which is realistic and impressive.

(Construction of display panel and method of manufacture)

The construction and method of manufacturing a display panel of an image display apparatus to which the present invention is applied will now-be described with regard to a specific, example.

Figure 30:
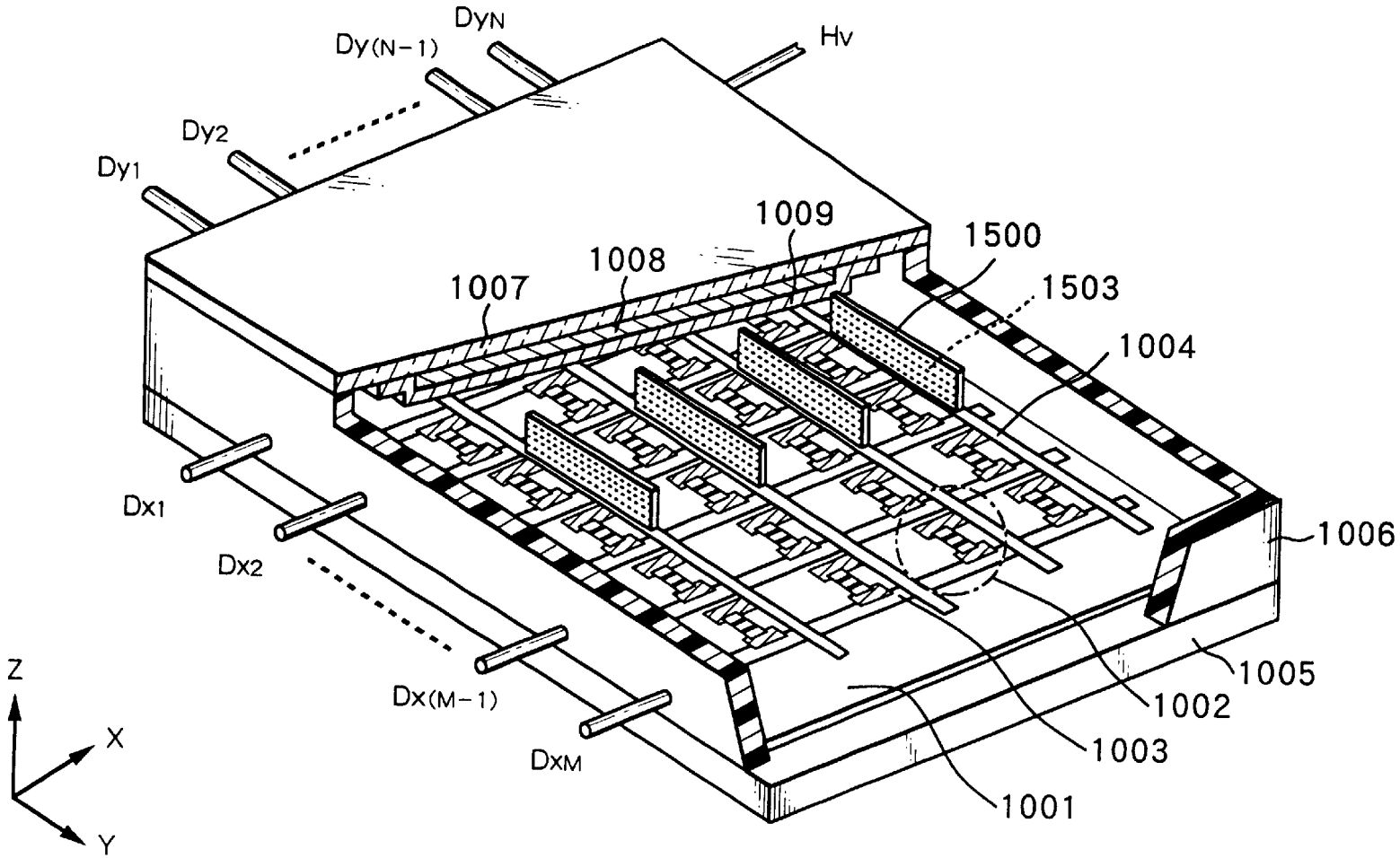
FIG. 30 is a perspective view showing a display panel, partially cut away, of an image display device according to an embodiment of the present invention.

FIG. 30 is a perspective view of a display panel used in the embodiments. Part of the panel is broken away to reveal the internal structure.

Shown in FIG. 30 are the rear plate 1005, the side wall 1006 and the face plate 1007. The hermetic envelope for maintaining a vacuum in the interior of the display panel is formed by the components 1005~1007. In terms of assembling the hermetic envelope, the joints between the members must to be sealed to maintain sufficient strength and airtightness. For example, a seal is achieved by coating the joints with frit glass and carrying out calcination in the atmosphere or in a nitrogen atmosphere at a temperature of 400~500° C. for 10 min or more. The method of evacuating the interior of the hermetic envelope will be described later.

The substrate 1001 is fixed to the rear plate 1005. The substrate 1001 has N×M cold cathode elements 1002 formed thereon. (Here M, N are positive integers of having a value of two or greater, with the number being set appropriately in conformity with the number of display pixels intended. For example, in a display apparatus the purpose of which is to display high-definition television, it is desired that the set numbers of elements be no less than N=3000, M=1000. In this embodiment, N=3072, M=1024 hold.)

The M×N cold cathode elements are matrix-wired by M-number of row-direction wires 1003 and N-number of column-direction wires 1004. The portion constituted by the components 1001~1004 is referred to as a "multiple electron beam source". The method of manufacturing the multiple electron beam source and the structure thereof will be described in detail later.

In this embodiment, the arrangement is such that the substrate 1001 of the multiple electron beam source is fixed to the rear plate 1005 of the hermetic envelope. However, if the substrate 1001 of the multiple electron beam source has sufficient strength, the substrate 1001 itself may be used as the rear plate of the hermetic envelope.

The phosphor film 1008 is formed on the underside of the faceplate 1007. Since this embodiment relates to a color display apparatus, portions of the phosphor film 1008 are coated with phosphors of the three primary colors red green and blue used in the field of CRT technology. The phosphor of each color is applied in the form of stripes, as shown in FIG. 12A, and the black conductor 1010 is provided between the phosphor stripes. The purpose of providing the black conductors 1010 is to assure that there will not be a shift in the display colors even if there is some deviation in the position irradiated with the electron beam, to prevent a decline in display contrast by preventing the reflection of external light, and to prevent the phosphor film from being charged by the electron beam. Though the main ingredient used in the black conductor 1010 is graphite, any other material may be used so long as it is suited to the above-mentioned objectives.

The application of the phosphors of the three primary colors is not limited to the stripe-shaped array shown in FIG. 12A. For example, a delta-shaped array, such as that shown in FIG. 12B, or other array may be adopted. In a case where a monochromatic display panel is fabricated, a monochromatic phosphor material may be used as the phosphor film 1008 and the black conductor material need not necessarily be used.

Further, the metal back 1009 well known in the field of CRT technology is provided on the surface of the phosphor film 1008 on the side of the rear plate. The purpose of providing the metal back 1009 is to improve the utilization of light by reflecting part of the light emitted by the phosphor film 1008, to protect the phosphor film 1008 against damage due to bombardment by negative ions, to act as an electrode for applying an electron-beam acceleration voltage, and to act as a conduction path for the electrons that have excited the phosphor film 1008. The metal back 1009 is fabricated by a method which includes forming the phosphor film 1008 on the face plate substrate 1007, subsequently smoothing the surface of the phosphor film and vacuum-depositing aluminum on this surface. In a case where a phosphor material for low voltages is used as the phosphor film 1008, the metal back 1009 is unnecessary.

Though not used in this embodiment, transparent electrodes made of a material such as ITO may be provided between the face plate substrate 1007 and the phosphor film 1008 for the purpose of applying an accelerating voltage and improving the conductivity of the phosphor film.

$D_{x1}$~$D_{xm}$, $D_{y1}$~$D_{yn}$ and Hv represent electrical connection terminals, which have an air-tight structure, for connecting this display panel with electrical circuitry, not shown. The terminals Dx1~Dxm are electrically connected to the row-direction wires 1003 of the multiple electron beam source, the feeder terminals $D_{y1}$~$D_{ym}$ are electrically connected to the column-direction wires 1004 of the multiple electron beam source, and the terminal Hv is electrically connected to the metal back 1009 of the face plate.

In order to evacuate the interior of the hermetic envelope, an exhaust pipe and a vacuum pump, not shown, are connected after the hermetic envelope is assembled and the interior of the envelope is exhausted to a vacuum of $10^{-7}$ torr. The exhaust pipe is then sealed. In order to maintain the degree of vacuum within hermetic envelope, a getter film (not shown) is formed at a prescribed position inside the hermetic envelope immediately before or immediately after the pipe is sealed. The getter film is a film formed by heating a getter material, the main ingredient of which is Ba, for example, by a heater or high-frequency heating to deposit the material. A vacuum on the order of $1\times10^{-5}$~$1\times10^{-7}$ torr is maintained inside the hermetic envelope by the adsorbing action of the getter film.

Since the interior of the hermetic envelope is maintained at a vacuum of approximately $10^{-6}$ torr, the flat plate-shaped spacers 1500 are provided within the envelope as structures for providing resistance against atmospheric pressure in order to prevent destruction of the envelope by atmospheric pressure and accidental impact. The spacer 1500 comprises a member obtained by forming a semiconductive thin film on the surface of the insulating base 1501. The row of the spacers 1500 are disposed approximately parallel to the X direction in a number and at a spacing required to attain this object. The inner surface of the hermetic envelope is sealed by frit glass or the like. The spacer 1500 comprises an insulating base 1501 consisting of a material having enough insulation to withstand a high voltage impressed across the column-direction wire 1004 and metal back 1009. Examples of materials for the insulating base 1501 of spacer 1500 are quartz glass, glass having a reduced impurity (e.g., Na) content, soda-lime glass or a ceramic member consisting of alumina or the like. It is preferred that the coefficient of thermal expansion of the insulating substrate 1501 of the spacer 1500 be close to that of the member constituting the hermetic envelope in order that the interior of the display panel will be held at vacuum by the elements 1005~1007.

The semiconductive thin film 1502 may be any material so long as it has enough surface conductivity to prevent the charging of the surface of the spacer 1500. For example, with a view to maintaining the charging preventing effect and suppressing power consumption due to leakage current, it is preferred that the semiconductive thin film 1502 have a surface resistance value ranging from $10^5$ to $10^{12}$ Ω/□. Examples of the material are a thin film obtained by forming a group IV semiconductor such as silicon or germanium, a compound semiconductor such as gallium arsenide, an oxide semiconductor such as tin oxide or an impurity semiconductor, which is obtained by adding a trace amount of an impurity to the various semiconductors mentioned above, in the amorphous state, polycrystalline state or monocrystalline state. Examples of methods of forming the semiconductive thin film 1502 are a vacuum film-forming method such as vacuum deposition, sputtering or chemical vapor deposition, or a coating method of applying and calcining an organic solution or a dispersion by dipping or by using a spinner. The method selected is in dependence upon the particular material.

The semiconductive thin film 1502 is formed at least on the part of the surface of the insulating base 1501 of spacer 1500 that is exposed to the vacuum in the hermetic envelope that maintains the vacuum in the display panel by the elements 1005~1007. The semiconductive thin film 1502 is electrically connected to the black conductor 1010 or metal back 1009 on the side of the face plate 1007 and is electrically connected to the column-direction wire 1004 on the side of the rear plate 1005.

The conductive member 1503, which is a conductive thin film, is obtained by forming a thin metal film of aluminum, nickel, copper, silver or gold, etc., a group IV semiconductor such as silicon or germanium, a compound semiconductor such as gallium arsenide, an oxide semiconductor such as tin oxide or an impurity semiconductor, which is obtained by adding an impurity to the various semiconductors mentioned above in an amount greater than that used in the semiconductive film 1502, in the amorphous state, polycrystalline state or monocrystalline state.

One or a plurality of the conductive members 1503 are formed and each is provided along a direction approximately perpendicular to the direction of an electric field between the black conductor 1010 or metal back 1009 and the column-direction wire 1004. Further, the conductive member 1503 generally is formed to have a width smaller than the distance between the black conductor 1010 or metal back 1009 and the column-direction wire 1004 on the side of the face plate 1007. The semiconductive thin film 1502 and the conductive member 1503 are electrically connected.

The constitution of the spacers 1500, the positions at which they are placed, the method of placing them and the electrical connection between the spacers and the faceplate 1007 and rear plate 1005 are not limited to the case set forth above. It will suffice if there is sufficient strength against atmospheric pressure, enough insulation to withstand the high voltage impressed across the column-direction wire 1004 and metal back 1009, for example, and a surface conductivity which will prevent the charging of the surface of the spacer 1500.

The foregoing is a description of the basic construction and method of manufacture of the display panel according to this embodiment of the invention.

The method of manufacturing the multiple electron beam source used in the display panel of the foregoing embodiment will be described next. If the multiple electron beam source used in the image display apparatus of this invention is an electron source in which cold cathode elements are wired in the form of a simple matrix, there is no limitation upon the material, shape or method of manufacture of the cold cathode elements. Accordingly, it is possible to use cold cathode elements such as surface-conduction electron emission elements or cold cathode elements of the FE or MIM type.

Since there is demand for inexpensive display devices having a large display screen, the surface-conduction electron emission elements are particularly preferred as the cold cathode elements. More specifically, with the FE-type element, the relative positions of the emitter cone and gate electrode and the shape thereof greatly influence the electron emission characteristics. Consequently, a highly precise manufacturing technique is required. This is a disadvantage in terms of enlarging surface area and lowering the cost of manufacture.

With the MIM-type element, it is required that the thickness of the insulating layer and of the film constituting the upper electrode be made small and uniform. This also is a disadvantage in terms of enlarging surface area and lowering the cost of manufacture. In contrast, the surface-conduction electron emission element is comparatively simple to manufacture, the surface area thereof is easy to enlarge and the cost of manufacture can be reduced with ease.

Further, the inventors have discovered that, among the surface-conduction electron emission elements available, an element in which the electron emission portion or periphery thereof is formed from a film of fine particles excels in its electron emission characteristic, and that the element can be manufactured easily.

Accordingly, it may be construed that such an element is most preferred for used in a multiple electron beam source in an image display apparatus having a high luminance and a large display screen. Furthermore, in the display panel of the foregoing embodiment, use was made of a surface-conduction electron emission element in which the electron emission portion or periphery thereof was formed from a film of fine particles. First, the basic construction, method of manufacture and characteristics of a surface-conduction electron emission element will be described, and this will be followed by a description of the structure of a multiple electron beam source in which a large number of elements are wired in the form of a matrix.

(Element construction for surface-conduction electron emission elements, and method of manufacturing same)

A flat panel-type and step-type element are the two typical types of construction of surface-conduction electron emission elements available in which the electron emission portion or periphery thereof is formed from a film of fine particles.

(Flat panel-type surface-conduction electron emission element)

Figure 31A:
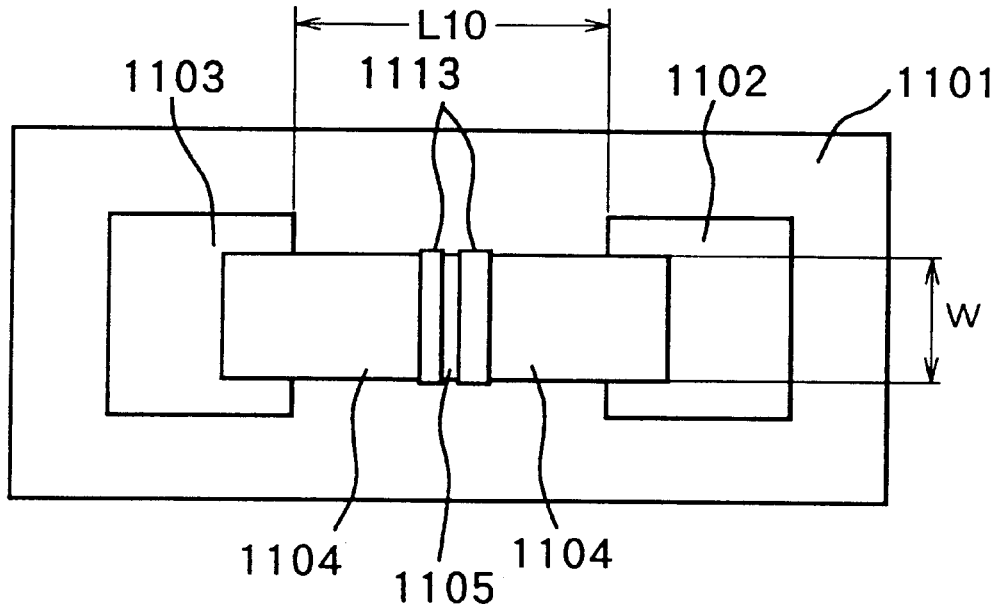
FIG. 31A is a plan view of a flat panel-type surface-conduction electron emission element used in this embodiment.
Figure 31B:
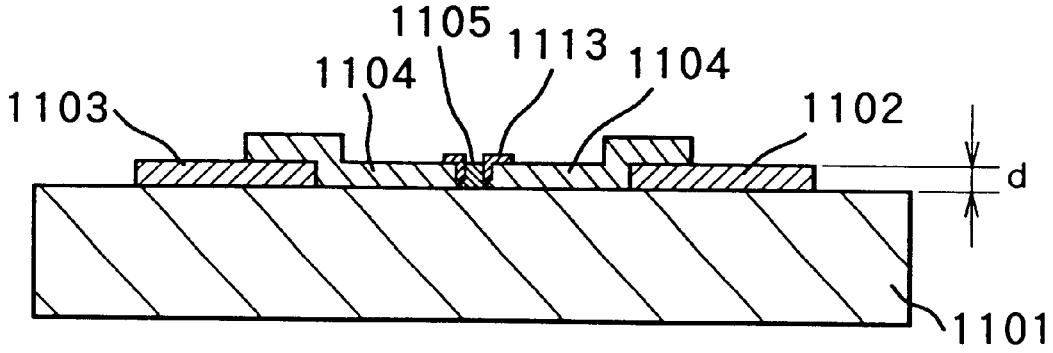
FIG. 31B is a sectional view showing the sectional configuration of the element.

The element construction and manufacture of a flat panel-type surface-conduction electron emission element will be described first. FIGS. 31A, 31B are plan and sectional views, respectively, for describing the construction of a flat panel-type surface-conduction electron emission element.

Shown in FIGS. 31A, 31B are a substrate 1101, element electrodes 1102, 1103, an electrically conductive thin film 1104, an electron emission portion 1105 formed by an electrification forming treatment, and a thin film 1113 formed by an electrification activation treatment. Examples of the substrate 1101 are various glass substrates such as quartz glass and blue glass, various substrates of a ceramic such as alumina, or a substrate obtained by depositing an insulating layer such as $SiO_2$ on the various substrates mentioned above.

The element electrodes 1102, 1103, which are provided to oppose each other on the substrate 1101 substantially in parallel with the substrate-surface, are formed from a material exhibiting electrical conductivity. Examples of the material that can be utilized are the metals Ni, Cr, Au, Mo, W, Pt, Ti, Al, Cu, Pd and Ag oralloys of these metals, metal oxides such as $In_2O_3$—$SnO_2$ and semiconductor materials such as polysilicon. In order to form the electrodes, a film manufacturing technique such as vacuum deposition and a patterning technique such as photolithography or etching may be used in combination. However, it is permissible to form the electrodes using other methods, such as a printing technique.

The shapes of the element electrodes 1102, 1103 are decided in conformity with the application and purpose of the electron emission element. In general, the spacing L10 between the electrodes may be a suitable value selected from a range of several hundred Angstroms to several hundred micrometers. Preferably, the range is on the order of several micrometers to several tens of micrometers in order for the device to be used in a display apparatus. With regard to the thickness d of the element electrodes, a suitable numerical value is selected from a range of several hundred Angstroms to several micrometers.

A film of fine particles is used at the portion of the electrically conductive thin film 1104. The film of fine particles mentioned here signifies a film (inclusive of island-shaped aggregates) containing a large number of fine particles as structural elements. If a film of fine particles is examined microscopically, usually the structure observed is one in which individual fine particles are arranged in spaced-apart relation, one in which the particles are adjacent to one another or one in which the particles overlap one another.

The particle diameter of the fine particles used in the film of fine particles falls within a range of from several Angstroms to several thousand Angstroms, with the particularly preferred range being 10 to 200 Å. The film thickness of the film of fine particles is suitably selected upon taking into consideration the following conditions: conditions necessary for achieving a good electrical connection between the element electrodes 1102 and 1103, conditions necessary for carrying out electrification forming, described later, and conditions necessary for obtaining a suitable value, described later, for the electrical resistance of the film of fine particles per se. More specifically, the film thickness is selected in the range of from several Angstroms to several thousand Angstroms, preferably 10 to 500 Å.

Examples of the material used to form the film of fine particles are the metals Pd, Pt, Ru, Ag, Au, Ti, In, Cu, Cr, Fe, Zn, Sn, Ta, W and Pb, etc., the oxides PdO, $SnO_2$, $In_2O_3$, PbO and $Sb_2O_3$, etc., the borides $HfB_2$, $ZrM_2$, $LaB_6$, $CeB_6$, $YB_4$ and $GdB_4$, the carbides TiC, ZrC, HfC, TaC, SiC and WC, etc., the nitrides TiN, ZrN and HfN, etc., the semiconductors Si, Ge, etc., and carbon. The material may be selected appropriately from these.

As mentioned above, the electrically conductive thin film 1104 is formed from a film of fine particles. The sheet resistance is set so as to fall within the range of from $10^3$ to $10^7$ Ω/□. Since it is preferred that the electrically conductive thin film 1104 come into good electrical contact with the element electrodes 1102, 1103, the adopted structure is such that the film and the element electrodes partially overlap each other. As for the methods of achieving this overlap, one method is to build up the device from the bottom in the order of the substrate, element electrodes and electrically conductive film, as shown in the example of FIG. 31B. Depending upon the case, the device may be built up from the bottom in the order of the substrate, electrically conductive film and element electrodes.

The electron emission portion 1105 is a fissure portion formed in part of the electrically conductive thin film 1104 and, electrically speaking, has a resistance higher than that of the surrounding conductive thin film. The fissure is formed by subjecting the electrically conductive thin film 1104 to an electrification forming treatment, described later. There are cases in which fine particles having a particle diameter of several Angstroms to several hundred Angstroms are placed inside the fissure.

It should be noted that since it is difficult to illustrate, finely and accurately, the actual position and shape of the electron emission portion, only a schematic illustration is given in FIGS. 31A, 31B.

The thin film 1113 comprises carbon or a carbon compound and covers the electron emission portion 1105 and its vicinity. The thin film 1113 is formed by carrying out an electrification activation treatment, described later, after the electrification forming treatment.

The thin film 1113 is one or a mixture of single-crystal graphite, polycrystalline graphite or amorphous carbon. The film thickness preferably is less than 500 Å, especially less than 300 Å.

It should be noted that since it is difficult to precisely illustrate the actual position and shape of the thin film 1113, only a schematic illustration is given in FIGS. 31A, 31B. Further, in the plan view of FIG. 31A, the element is shown with part of the thin film 1113 removed.

The desired basic construction of the element has been described. The following element was used in this embodiment: Soda-lime glass was used as the substrate 1101, and a thin film of Ni was used as the element electrodes 1102, 1103. The thickness d of the element electrodes was 1000 Å, and the electrode spacing L10 was 2 μm. Pd or PdO was used as the main ingredient of the film of fine particles, the thickness of the film of fine particles was about 100 Å, and the width W was 100 μm.

The method of manufacturing the preferred flat panel-type of the surface-conduction electron emission element will now be described.

FIGS. 32A~32E are sectional views for describing the process steps for manufacturing the surface-conduction electron emission element. Portions similar to those in FIGS. 31A, 31B are designated by like reference numerals.

Figure 32A:
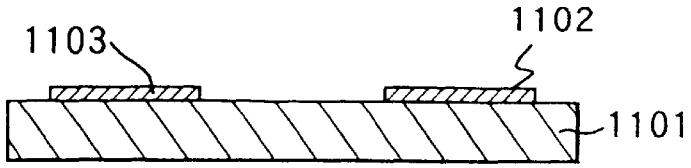
FIGS. 32A~32E are sectional views showing a process for manufacturing a flat panel-type surface-conduction electron emission element.

(1) First, the element electrodes 1102, 1103 are formed on the substrate 1101, as shown in FIG. 32A. With regard to formation, the substrate 1101 is cleansed sufficiently in advance using a detergent, pure water or an organic solvent, after which the element-electrode material is deposited. (An example of the deposition method used is a vacuum film-forming technique such as vapor deposition or sputtering. Thereafter, the deposited electrode material is patterned using photolithography to form the pair of electrodes 1102, 1103 shown in FIG. 32A.

Figure 32B:
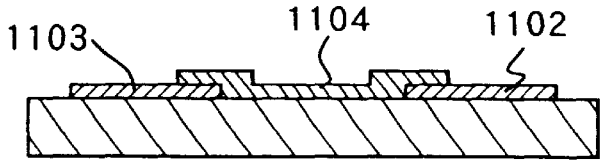

(2) Next, the electrically conductive thin film 1104 is formed, as shown in FIG. 32B. With regard to formation, the substrate of FIG. 32A is coated with an organic metal solution, the latter is allowed to dry, and heating and calcination treatments are applied to form a film of fine particles. Patterning is then carried out by photolithographic etching to obtain a prescribed shape. The organic metal solution is a solution of an organic metal compound in which the main element is the material of the fine particles used in the electrically conductive film. (Specifically, Pd was used as the main element in this embodiment. Further, the dipping method was employed as the method of application in this embodiment. However, other methods which may be used are the spinner method and spray method.)

Further, besides the method of applying the organic metal solution used in this embodiment as the method of forming the electrically conductive thin film made of the film of fine particles, there are cases in which use is made of vacuum deposition and sputtering or chemical vapor deposition.

Figure 32C:
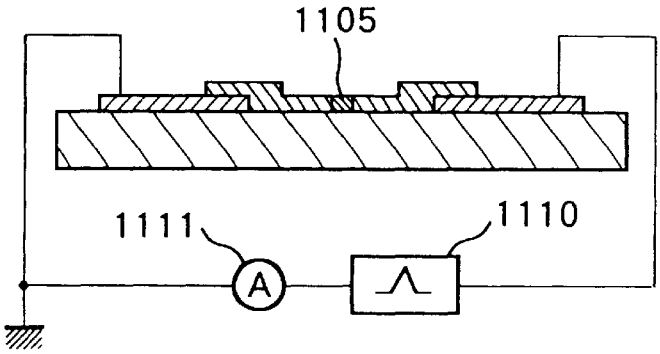

(3) Next, as shown in FIG. 32C, a suitable voltage is applied across the element electrodes 1102 and 1103 from a forming power supply 1110, whereby an electrification forming treatment is carried out to form the electron emission portion 1105.

The electrification forming treatment includes passing a current through the electrically conductive thin film 1104, which is made from the film of fine particles, to locally destroy, deform or change the property of this portion, thereby obtaining a structure ideal for performing electron emission. At the portion of the electrically conductive film, made of the film of fine particles, changed to a structure ideal for electron emission (i.e., the electron emission portion 1105), a fissure suitable for a thin film is formed. When a comparison is made with the situation prior to formation of the electron emission portion 1105, it is seen that the electrical resistance measured between the element electrodes 1102 and 1103 after formation has increased to a major degree.

Figure 33:
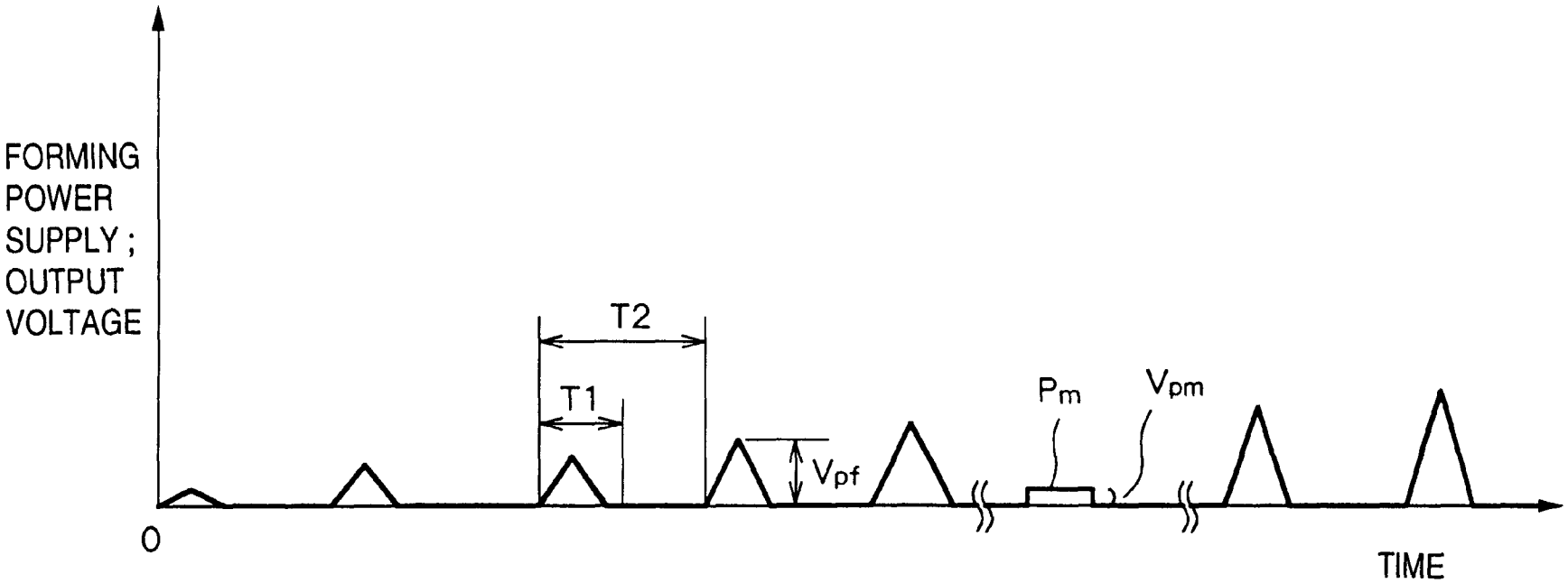
FIG. 33 is a diagram showing an applied voltage waveform for an electrification forming treatment.

In order to give a more detailed description of the electrification method, an example of a suitable voltage waveform supplied from the forming power supply 1110 is shown in FIG. 33. In a case where the electrically conductive film made of the film of fine particles is subjected to forming, a pulsed voltage is preferred. In the case of this embodiment, triangular pulses having a pulse width T1 were applied consecutively at a pulse interval T2, as illustrated in the Figure. At this time, the peak value Vpf of the triangular pulses was gradually increased. A monitoring pulse Pm for monitoring the formation of the electron emission portion 1105 was inserted between the triangular pulses at a suitable spacing and the current which flows at such time was measured by an ammeter 1111.

In this embodiment, under a vacuum of, say, $10^{-5}$ torr, the pulse width T1 and pulse interval T2 were made 1 ms and 10 ms, respectively, and the peak voltage Vpf was elevated at increments of 0.1 V every pulse. The monitoring pulse Pm was inserted at a rate of once per five of the triangular pulses. The voltage Vpm of the monitoring pulses was set to 0.1 V so that the forming treatment would not be adversely affected. Electrification applied for the forming treatment was terminated at the stage that the resistance between the terminal electrodes 1102, 1103 became $1\times10^{6}\Omega$, namely at the stage that the current measured by the ammeter 1111 at application of the monitoring pulse fell below $1\times10^{-7}$ Å.

The method described above is preferred in relation to the surface-conduction electron emission element of this embodiment. In a case where the material or film thickness of the film consisting of the fine particles or the design of the surface-conduction electron emission element such as the element-electrode spacing L10 is changed, it is desired that the conditions of electrification be altered accordingly.

Figure 32D:
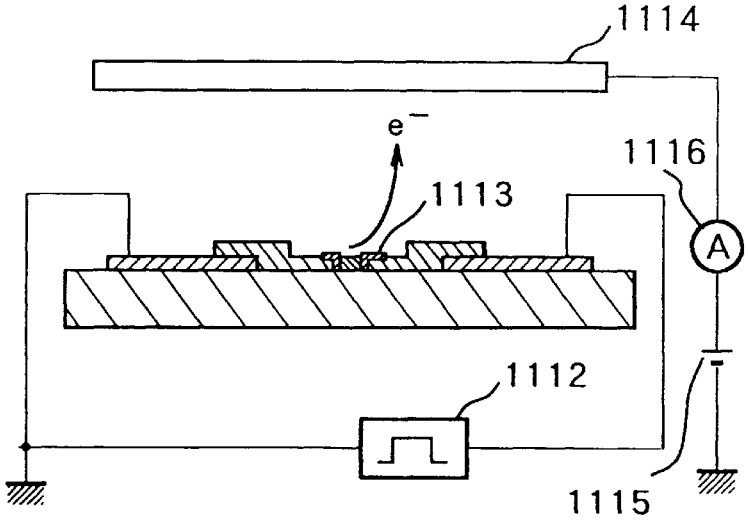

(4) Next, as shown in FIG. 32D, a suitable voltage from an activating power supply 1112 was impressed across the element electrodes 1102, 1103 to apply an electrification activation treatment, thereby improving the electron emission characteristic.

This electrification activation treatment involves subjecting the electron emission portion 1105; which has been formed by the above-described electrification forming treatment, to electrification under suitable conditions and depositing carbon or a carbon compound in the vicinity of this portion. (In the Figure, the deposit consisting of carbon or carbon compound is illustrated schematically as a member 1113.) By carrying out this electrification activation treatment, the emission current typically can be increased by more than 100 times, at the same applied voltage, in comparison with the current before application of the treatment.

More specifically, by periodically applying voltage pulses in a vacuum ranging from $10^{-4}$ to $10^{-5}$ torr, carbon or a carbon compound in which an organic compound present in the vacuum serves as the source is deposited. The deposit 1113 is one or a mixture of single-crystal graphite, polycrystalline graphite or amorphous carbon. The film thickness is less than 500 Å, preferably less than 300 Å.

Figure 34A:
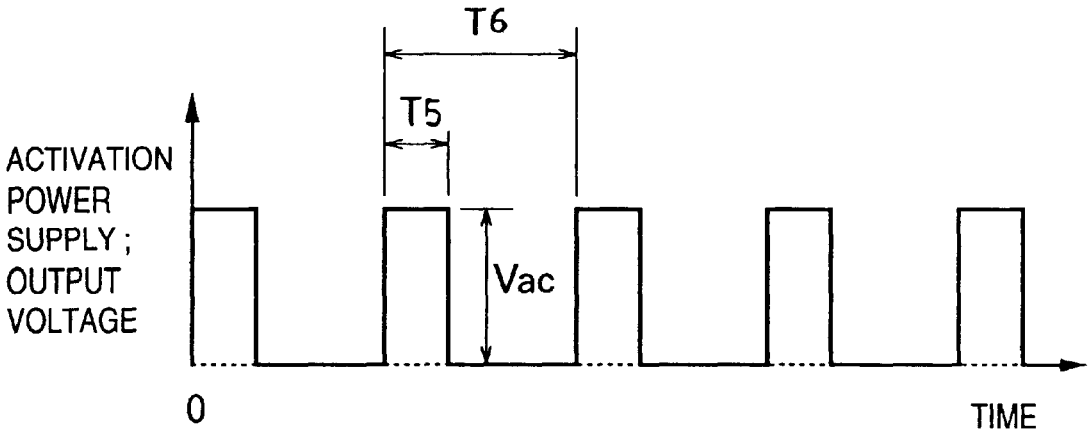
FIG. 34A is a diagram showing an applied voltage waveform for an electrification activation treatment.

In order to give a more detailed description of the electrification method for activation, an example of a suitable waveform supplied by the activation power supply 1112 is illustrated in FIG. 34A. In this embodiment, the electrification activation treatment was conducted by periodically applying rectangular waves of a fixed voltage. More specifically, the voltage Vac of the rectangular waves was made 14 V, the pulse width T5 was made 1 ms, and the pulse interval T6 was made 10 ms. The electrification conditions for activation mentioned above are desirable conditions in relation to the surface-conduction electron emission element of this embodiment. In a case where the design of the surface-conduction electron emission element is changed, it is desired that the conditions be changed accordingly.

Figure 34B:
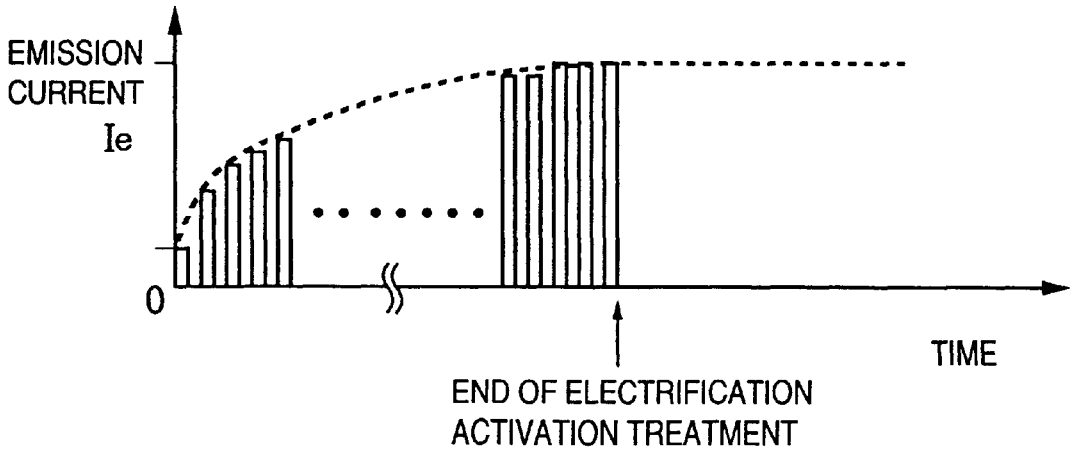
FIG. 34B is a diagram showing a change in emission current at the time of the electrification activation treatment.

Numeral 1114 in FIG. 32D denotes an anode electrode for capturing the emission current Ie obtained from the surface-conduction electron emission element. The anode electrode is connected to a DC high-voltage power supply 1115 and to an ammeter 1116. (In a case where the activation treatment is carried out after the substrate 1101 is installed in the display panel, the phosphor surface (metal back) of the display panel is used as the anode electrode 1114.) During the time that the voltage is being supplied from the activation power supply 1112, the emission current Ie is measured by the ammeter 1116 to monitor the progress of the electrification activation treatment, and the operation of the activation power supply 1112 is controlled. FIG. 34B illustrates an example of the emission current le measured by the ammeter 1116. When the pulsed voltage starts being supplied by the activation power supply 1112, the emission current Ie increases with the passage of time but eventually saturates and then almost stops increasing. At the moment the emission current Ie thus substantially saturates, the application of voltage from the activation power supply 1112 is halted and the activation treatment by electrification is terminated.

It should be noted that the above-mentioned electrification conditions are desirable conditions in relation to the surface-conduction electron emission element of this embodiment. In a case where the design of the surface-conduction electron emission element is changed, it is desired that the conditions be changed accordingly.

Figure 32E:
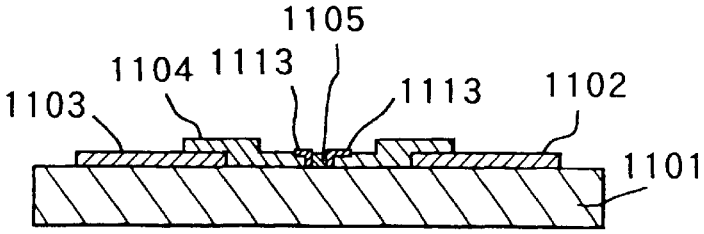

Thus, the flat panel-type surface-conduction electron emission element shown in FIG. 32E is manufactured as set forth above.

(Step-type surface-conduction electron emission element)

Next, one more typical construction of a surface-conduction electron emission element in which the electron emission portion or its periphery is formed from a film of fine particles, namely the construction of a step-type surface-conduction electron emission element, will be described.

Figure 35:
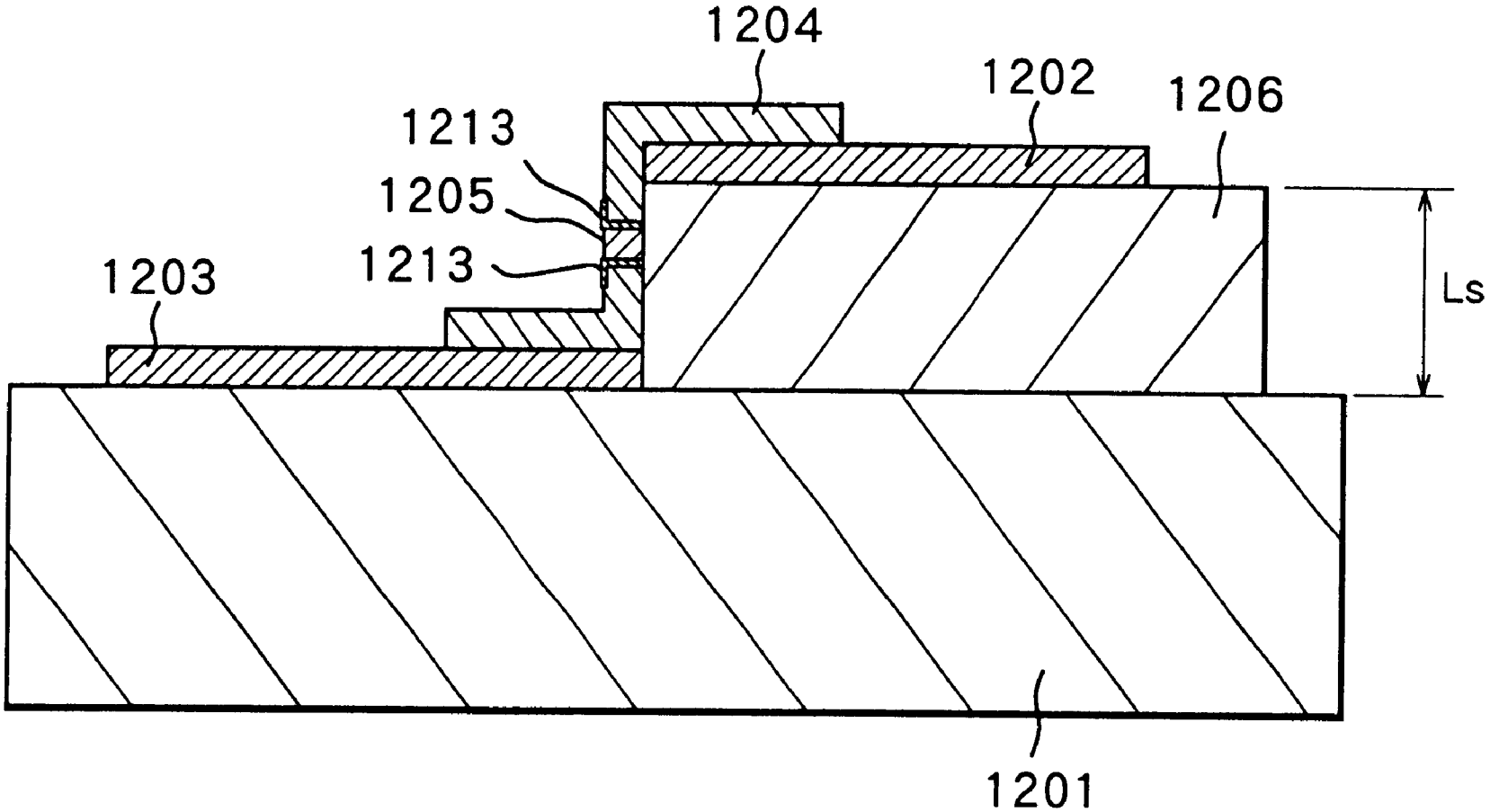
FIG. 35 is a sectional view of a step-type surface-conduction electron emission element used in this embodiment.

FIG. 35 is a schematic sectional view for describing the basic construction of the step-type-element. Numeral 1201 denotes a substrate, 1202 and 1203 element electrodes, 1206 a step forming member, 1204 an electrically conductive thin film using a film of fine particles, 1205 an electron emission portion formed by an electrification forming treatment, and 1213 a thin film formed by an electrification activation treatment.

The step-type element differs from the flat panel-type element in that one element electrode (1202) is provided on the step forming member 1206, and in that the electrically conductive thin film 1204 covers the side of the step forming member 1206. Accordingly, the element-electrode spacing L10 in the flat panel-type surface-conduction electron emission element shown in FIG. 31A is set as the height Ls of the step forming member 1206 in the step-type element.

The substrate 1201, the element electrodes 1202, 1203 and the electrically conductive thin film 1204 using the film of fine particles can consist of the same materials mentioned in the description of flat panel-type element. An electrically insulating material such as $SiO_2$ is used as the step forming member 1206.

A method of manufacturing the step-type surface-conduction electron emission element will now be described. FIGS. 36A~36F are sectional views for describing the manufacturing steps. The reference characters of the various members are the same as those in FIG. 35.

Figure 36A:
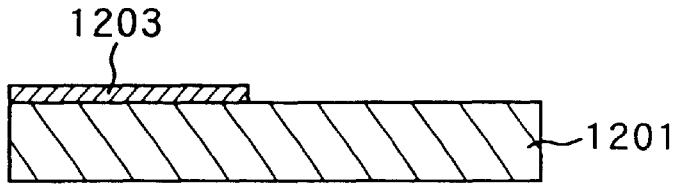
FIGS. 36A~36F are sectional views showing a process for manufacturing a step-type surface-conduction electron emission element.

(1) First, the element electrode 1203 is formed on the substrate 1201, as shown in FIG. 36A.

Figure 36B:
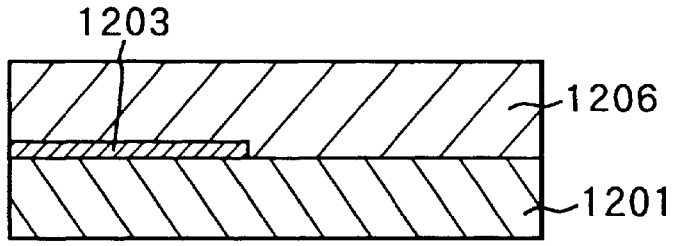

(2) Next, an insulating layer for forming the step forming member is built up, as shown in FIG. 36B. It will suffice if this insulating layer is formed by building up $SiO_2$ using the sputtering method. However, other film forming methods may be used, such as vacuum deposition or printing, by way of example.

Figure 36C:
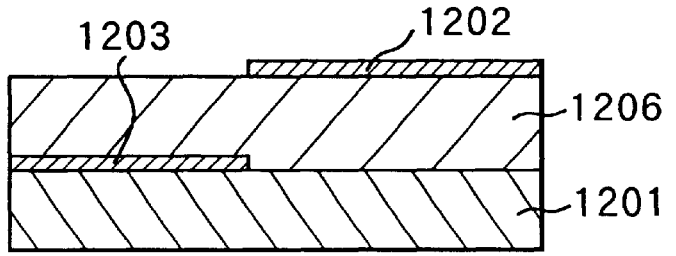

(3) Next, the element electrode 1202 is formed on the insulating layer, as shown in FIG. 36C.

Figure 36D:
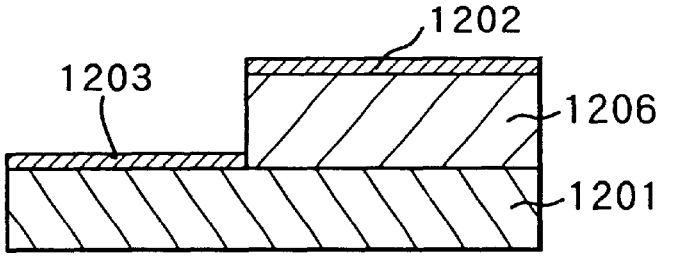

(4) Next, part of the insulating layer is removed as by an etching process, thereby exposing the element electrode 1203, as shown in FIG. 36D.

Figure 36E:
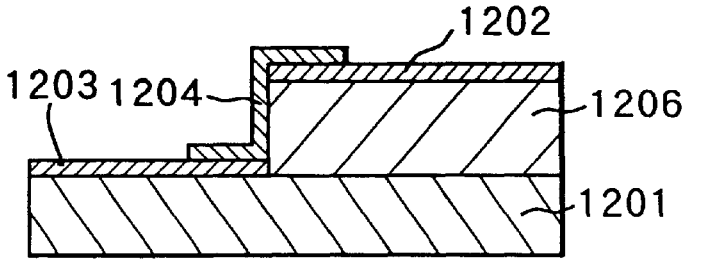

(5) Next, the electrically conductive thin film 1204 using the film of fine particles is formed, as shown in FIG. 36E. In order to form the electrically conductive thin film, it will suffice to use a film forming technique such as painting in the same manner as in the case of the flat panel-type element.

(6) Next, an electrification forming treatment is carried out in the same manner as in the case of the flat panel-type element, thereby forming the electron emission portion. (It will suffice to carry out a treatment similar to the flat panel-type electrification forming treatment described using FIG. 32C.)

(7) Next, as in the case of the flat panel-type element, the electrification activation treatment is performed to deposit carbon or a carbon compound on the vicinity of the electron emission portion. (It will suffice to carry out a treatment similar to the flat panel-type electrification activation treatment described using FIG. 32D.)

Figure 36F:
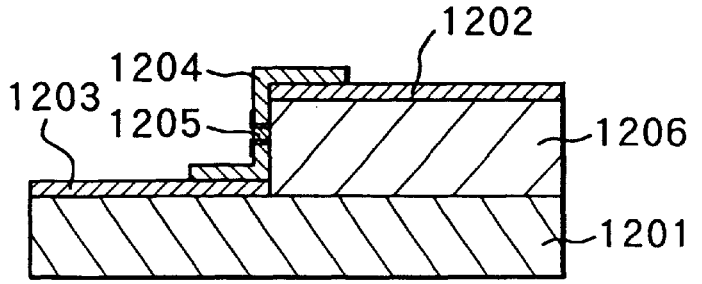

Thus, the step-type surface-conduction electron emission element shown in FIG. 36F is manufactured as set forth above.

(Characteristics of surface-conduction electron emission element used in display apparatus)

The element construction and method of manufacturing the planar-type and step-type surface-conduction electron emission elements have been described above. The characteristics of these elements used in a display apparatus will now be described.

Figure 37:
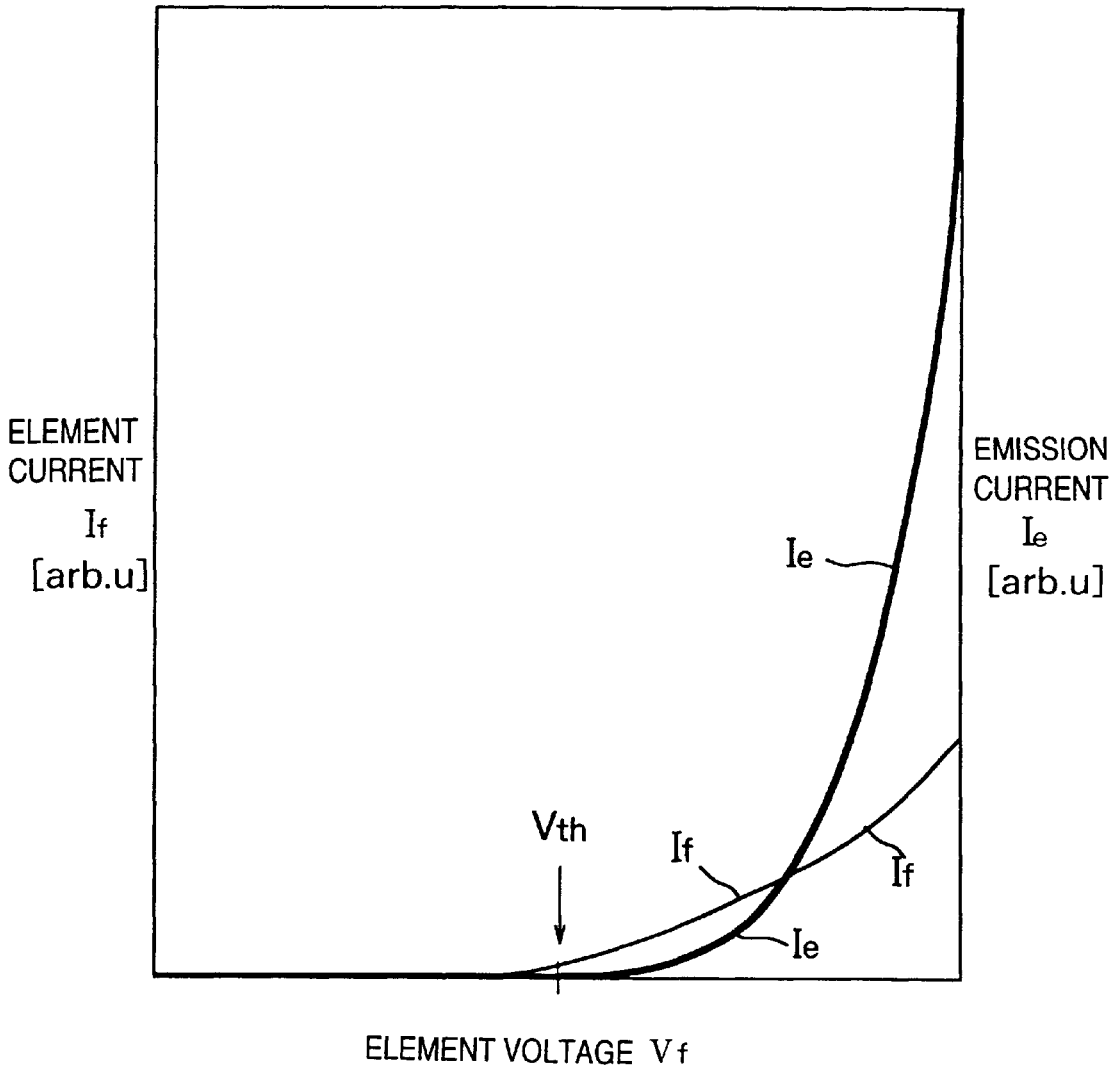
FIG. 37 is a graph showing a typical characteristic of a surface-conduction electron emission element used in this embodiment.

FIG. 37 illustrates a typical example of an emission current Ie characteristic vs. applied element voltage Vf characteristic and of an element current If characteristic vs. applied element voltage Vf characteristic of the elements used in a display apparatus. It should be noted that the emission current Ie is so much smaller than the element current If that it is difficult to use the same scale to illustrate it. Moreover, these characteristics are changed by changing the design parameters such as the size and shape of the elements. Accordingly, the two curves in the graph are each illustrated using arbitrary units.

The elements used in this display apparatus have the following three features in relation to the emission current Ie:

First, when a voltage greater than a certain voltage (referred to as a threshold voltage Vth) is applied to the element, the emission current Ie suddenly increases. When the applied voltage is less than the threshold voltage Vth, on the other hand, almost no emission current Ie is detected. In other words, the element is a non-linear element having the clearly defined threshold voltage Vth with respect to the emission current Ie.

Second, since the emission current Ie varies in dependence upon the voltage Vf applied to the element, the magnitude of the emission current Ie can be controlled by the voltage Vf.

Third, since the response speed of the current Ie emitted from the element is high in response to a change in the voltage Vf applied to the element, the amount of charge of the electron beam emitted from the element can be controlled by the length of time over which the voltage Vf is applied.

By virtue of the foregoing characteristics, surface-conduction electron emission elements are ideal for use in a display apparatus. For example, in a display apparatus in which a number of elements are provided to correspond to pixels of a displayed image, the display screen can be scanned sequentially to present a display if the first characteristic mentioned above is utilized. More specifically, a voltage greater than the threshold voltage Vth is suitably applied to driven elements in conformity with a desired light-emission luminance, and a voltage less than the threshold voltage Vth is applied to elements that are in an unselected state. By sequentially switching over elements driven, the display screen can be scanned sequentially to present a display.

Further, by utilizing the second characteristic or third characteristic, the luminance of the light emission can be controlled. This makes it possible to present a grayscale display.

(Structure of multiple electron beam source having number of elements wired in form of simple matrix)

Described next will be the structure of a multiple electron beam source obtained by arraying the aforesaid surface-conduction electron emission elements on a substrate and wiring the elements in the form of a simple matrix.

Figure 38:
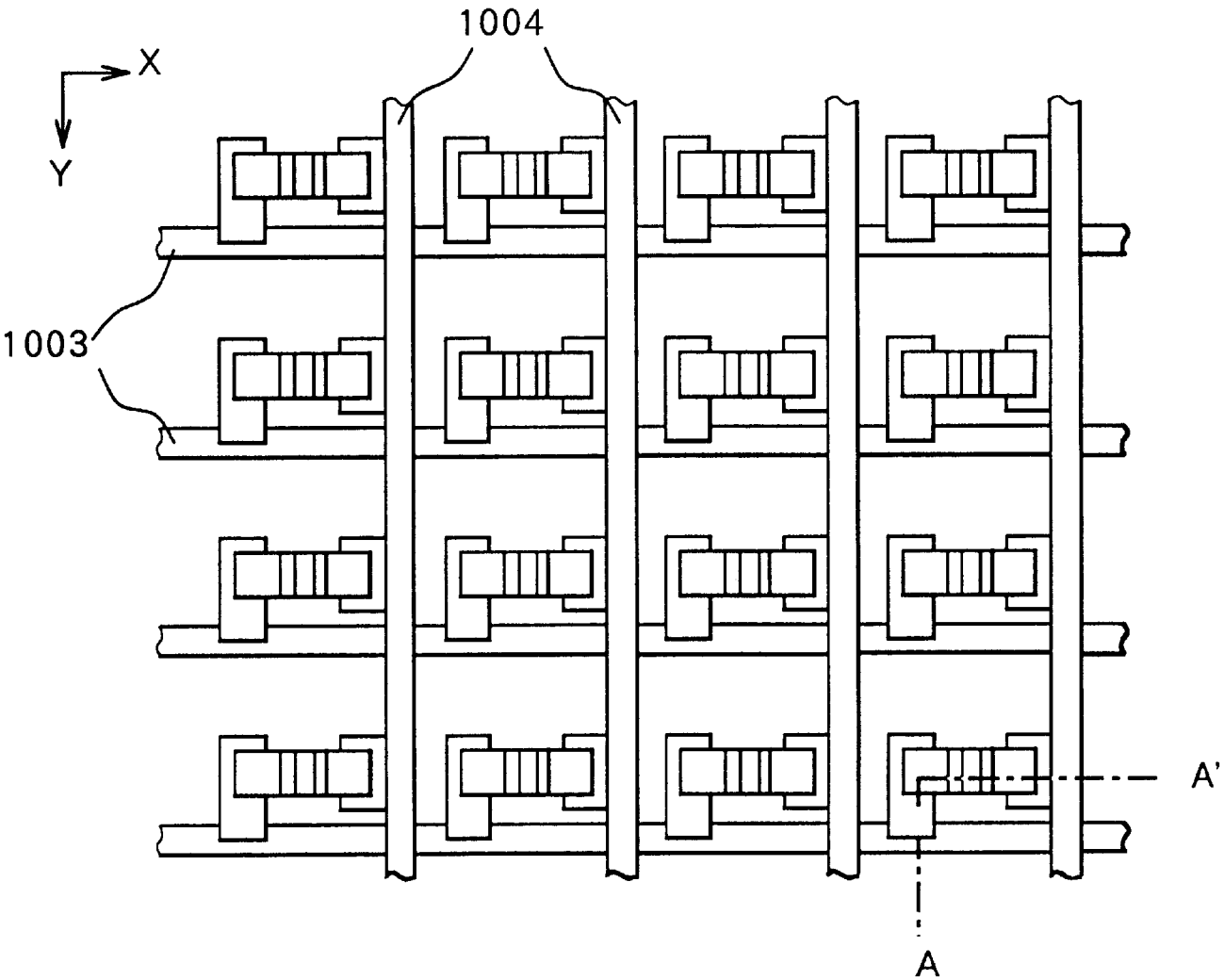
FIG. 38 is plan view showing the substrate of a multiple electron beam source used in this embodiment.

FIG. 38 is a plan view of a multiple electron beam source used in the display panel of FIG. 30. Here surface-conduction electron emission elements similar to the type shown in FIG. 31A are arrayed on the substrate, and these elements are wired in the form of a simple matrix by the row-direction wiring electrodes 1003 and column-direction wiring electrodes 1104. An insulating layer (not shown) is formed between the electrodes at the portions where the row-direction wiring electrodes 1003 and column-direction wiring electrodes 1004 intersect, thereby maintaining electrical insulation between the electrodes.

Figure 39:
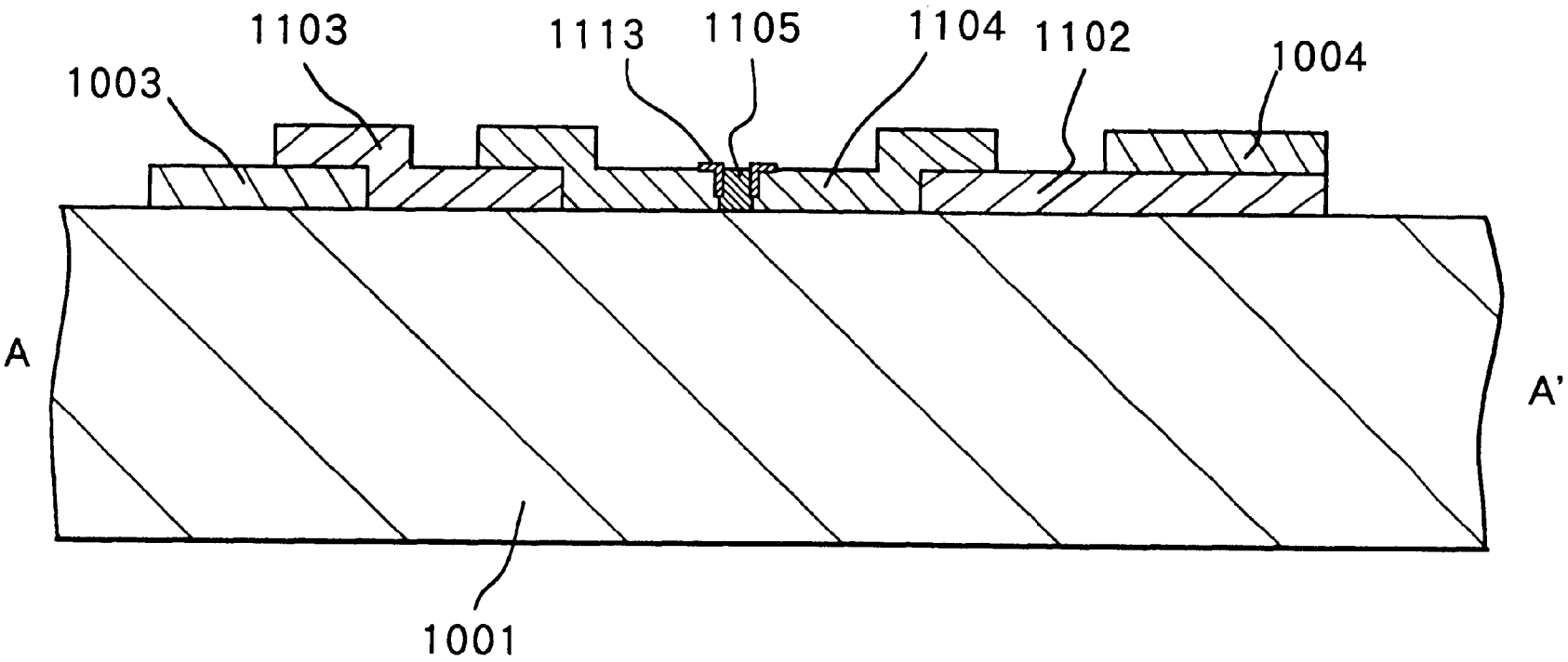
FIG. 39 is a partial sectional view showing the substrate of the multiple electron beam source used in this embodiment.
Figure 40:
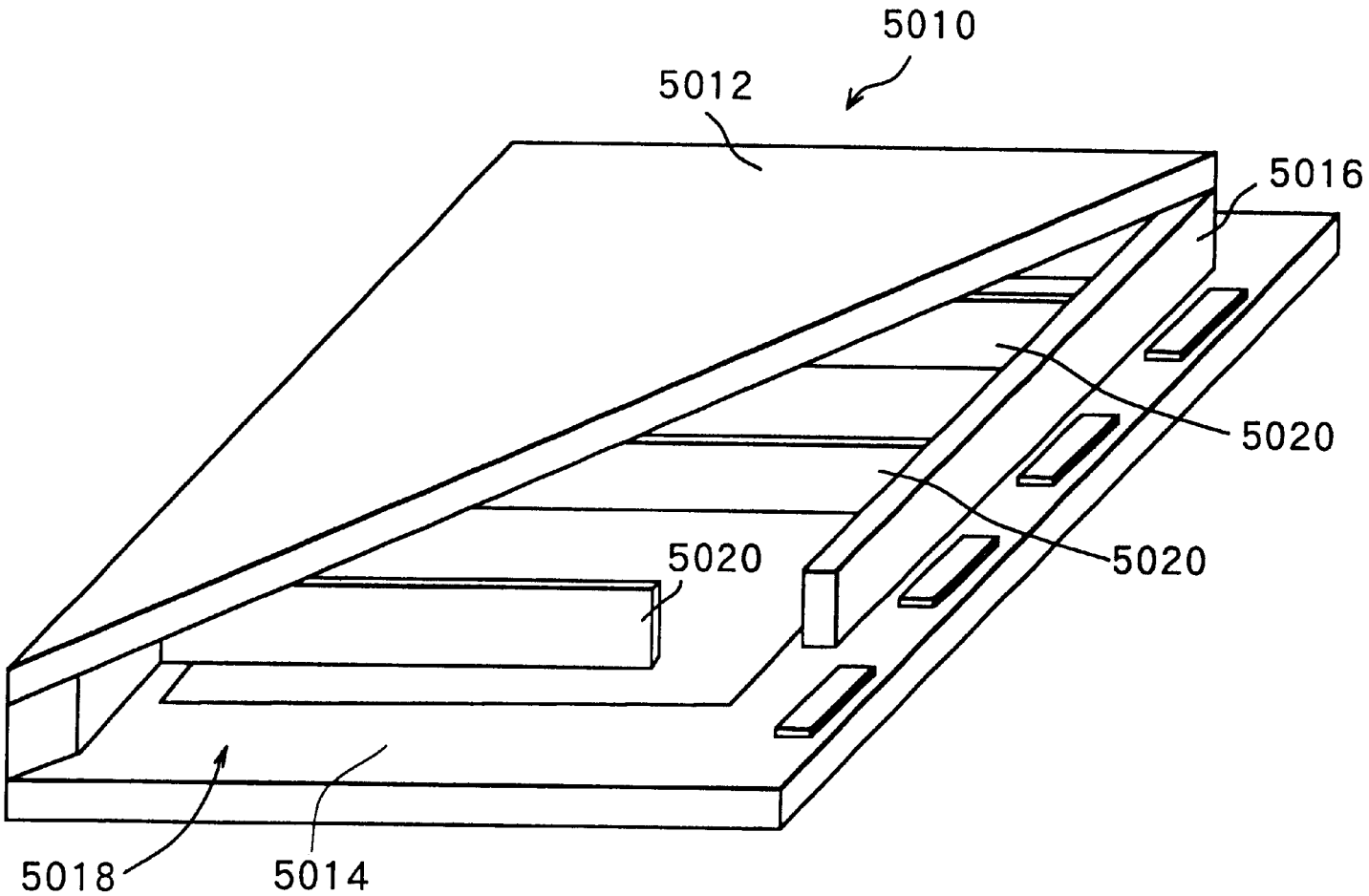
FIG.40 PRIOR ART
FIG. 40 is a perspective view, partially cut away, showing an image display device according to the prior art.
Figure 41:
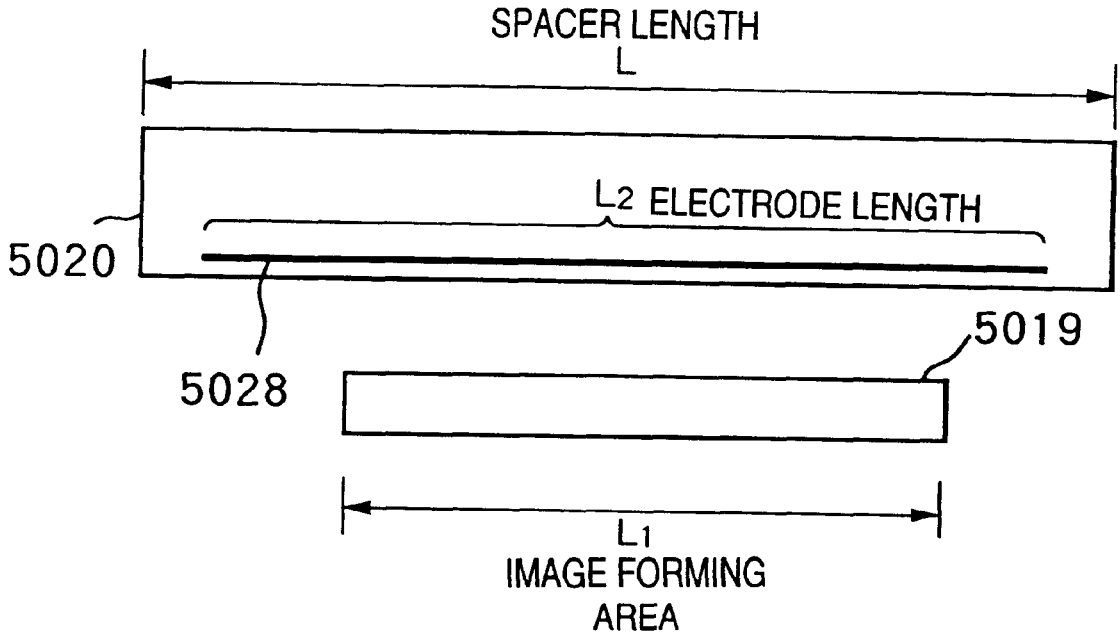
FIG.41 PRIOR ART
FIG. 41 is a side view of a spacer according to the prior art.
Figure 42:
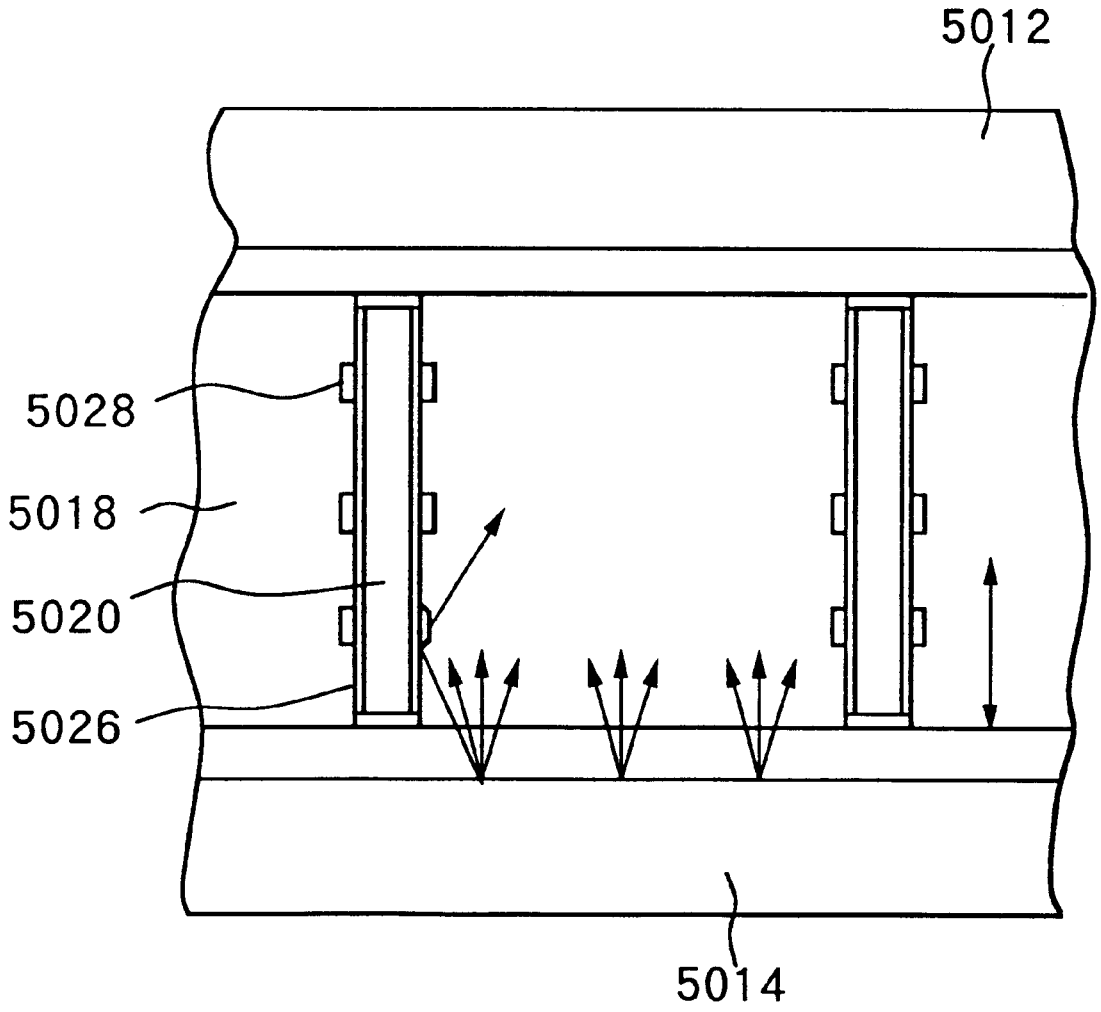
FIG.42 PRIOR ART
FIG. 42 is a sectional view of an image display device according to the prior art.

FIG. 39 is a sectional view taken along line A–A' of FIG. 38.

It should be noted that the multiple electron source having this structure is manufactured by forming the row-direction wiring electrodes 1003, column-direction wiring electrodes 1004, inter-electrode insulating layer (not shown) and the element electrodes and electrically conductive thin film of the surface-conduction electron emission elements on the substrate in advance, and then applying the electrification forming treatment and electrification activation treatment by supplying current to each element via the row-direction wiring electrodes 1003 and column-direction wiring electrodes 1004.

The present invention can be applied to a system constituted by a plurality of devices (e.g., a host computer, interface, reader, printer, etc.) or to an apparatus comprising a single device (e.g., a copier or facsimile machine, etc.).

Further, it goes without saying that the object of the present invention can also be achieved by providing a storage medium storing program codes for performing the aforesaid functions of the foregoing embodiment to a system or an apparatus, reading the program codes with a computer (e.g., a CPU or MPU) of the system or apparatus from the storage medium, and then executing the program.

In this case, the program codes read from the storage medium implement the functions according to the embodiments, and the storage medium storing the program codes constitutes the invention.

The storage medium, such as a floppy disk, hard disk, optical disk, magneto-optical disk, CD-ROM, CD-R, magnetic tape, non-volatile type memory card or ROM can be used to provide the program codes.

Furthermore, besides the case where the aforesaid functions according to the embodiments are implemented by executing the program codes read by a computer, it goes without saying that the present invention covers a case where an operating system or the like working on the computer performs a part of or the entire process in accordance with the designation of program codes and implements the functions according to the embodiment.

Furthermore, it goes without saying that the present invention further covers a case where, after the program codes read from the storage medium are written to a function extension board inserted into the computer or to a memory provided in a function extension unit connected to the computer, a CPU or the like contained in the function extension board or function extension unit performs a part of or the entire process in accordance with the designation of program codes and implements the function of the above embodiment.

In a case where the present invention is applied to the above-mentioned storage medium, the program codes described above are stored on this storage medium.

In accordance with the embodiments according to the present invention, as described above, electrodes which are substantially parallel to anodes are provided on the side surfaces of the spacers around. As a result, (1) a parallel electric field between the anodes and elements is not disturbed, and (2) the spacers do not become charged. The paths of the electron beams are not adversely affected.

Thus, as set forth above, the present invention provides an image forming apparatus having an electron emission element, an image forming member and a spacer provided within a vacuum envelope, wherein it is possible to achieve formation of a high-definition image and a reduction in image deterioration, especially in the vicinity of the spacer, as caused by deviation of the electron beam irradiation position toward the image forming member.

Further, the present invention provides an image forming apparatus having an electron emission element, an image forming member possessing phosphors and a spacer provided within a vacuum envelope, wherein it is possible to achieve formation of a high-luminance image and a reduction in image deterioration, especially in the vicinity of the spacer, as caused by a deformation in the shape of the light emission, a change in light-emitting position and a shift in color.

Further, the present invention provides an image forming apparatus capable of reducing the occurrence of spacer charging and especially spark discharge attributable to the spacer.

Further, the present invention provides an image forming apparatus in which the surface potential of each portion of a spacer is controlled to provide a prescribed potential distribution in such a manner that the path of an electron beam will not be adversely affected.

Further, the present invention reduces the abovementioned charging and spark discharge and facilitates the manufacture of the spacers.

Further, the present invention provides an image forming apparatus in which the above-mentioned charging and spark discharge are reduced and in which there are disposed spacers which exhibit excellent evacuation conductance when the interior of the envelope is evacuated.

As many apparently widely different embodiments of the present invention can be made without departing from the spirit and scope thereof, it is to be understood that the invention is not limited to the specific embodiments thereof except as defined in the appended claims.

What is claimed is:

1. An electron-beam generation apparatus comprising:

a vacuum envelope;

electron emission elements;

a first electrode provided in said vacuum envelope;

at least one spacer disposed within said vacuum envelope; and a conductive member provided on an endface of said spacer, with said conductive member confronting said first electrode;

wherein at least an outer portion of said conductive member is covered by a semiconductive film.

2. The apparatus according to claim 1, wherein said spacer is arranged between said first and a second electrodes in said vacuum envelope.

3. The apparatus according to claim 2, wherein different potentials are applied to said first and second electrodes.

4. The apparatus according to claim 2, wherein a potential for accelerating electrons emitted from the electron emission element is applied to said first electrode.

5. The apparatus according to claim 2, wherein said first electrode is connected to an electron emission element.

6. The apparatus according to claim 2, wherein said first electrode is a control electrode for controlling electrons emitted by said electron emission elements.

7. The apparatus according to claim 2, wherein said semiconductive film electrically connects said first and second electrodes.

8. The apparatus according to claim 1, wherein said semiconductive film has a surface resistance more than $10^5$ Ω/□.

9. The apparatus according to claim 8, wherein said semiconductive film has a surface resistance less than $10^{12}$ Ω/□.

10. An electron-beam generation apparatus comprising:

a vacuum envelope;

electron emission elements;

a first electrode provided in said vacuum envelope;

at least one spacer disposed within said vacuum envelope; and an electrode provided on an endface of said spacer, with said electrode confronting said first electrode;

wherein at least an outer portion of said electrode is covered by a semiconductive film.

11. The apparatus according to claim 10, wherein said spacer is arranged between said first electrode and a second electrode in said vacuum envelope.

12. The apparatus according to claim 11, wherein different potentials are applied to said first and second electrodes.

13. The apparatus according to claim 11, wherein a potential for accelerating electrons emitted from said electron emission element is applied to said first electrode.

14. The apparatus according to claim 11, wherein said first electrode is an electrode connected to an electron emission element.

15. The apparatus according to claim 11, wherein said first electrode is a control electrode for controlling electrons emitted from said electron emission elements.

16. The apparatus according to claim 11, wherein said semiconductive film electrically connects said first and second electrodes.

17. The apparatus according to claim 10, wherein said semiconductive film has a surface resistance more than $10^5$ Ω/□.

18. The apparatus according to claim 17, wherein said semiconductive film has a surface resistance less than $10^{12}$ Ω/□.

* * * * *

UNITED STATES PATENT AND TRADEMARK OFFICE

CERTIFICATE OF CORRECTION

PATENT NO. : 6,420,824 B1
DATED : July 16, 2002
INVENTOR(S) : Naoto Abe et al.

It is certified that error appears in the above-identified patent and that said Letters Patent is hereby corrected as shown below:

Title page,
Item [56], References Cited, insert the following:

-- OTHER PUBLICATIONS

H. Araki, et al., "Electroforming and Electron Emission of Carbon Thin Films", Journal of the Vacuum Society of Japan, Vol. 26, No. 1, pp. 22-29 (January 26, 1983).

M.I. Elinson, et al., "The Emission of Hot Electrons and the Field Emission of Electrons From Tin Oxide", Radio Engineering and Electronic Physics, pp. 1290-1296 (July 1965).

G. Dittmer, "Electrical Conduction and Electron Emission of Discontinuous Thin Films", Thin Solid Films, 9, pp. 317-328 (1972).

M. Hartwell, et al., "Strong Electron Emission From Patterned Tin-Indium Oxide Thin Films", International Electron Devices Meeting, pp. 519-521 (1975).

W.P. Dykes, et al., "Field Emission", Advances in Electronics and Electron Physics, Vol. 8, pp. 89-185 (1956).

C.A. Spindt, et al., "Physical Properties of Thin Film Field Emission Cathodes with Molybdenum Cones", Journal of Applied Physics, Vol. 47, No. 12, pp. 5248-5263 (December 1976).

C.A. Mead, "Operation of Tunnel-Emission Devices", Journal of Applied Physics, Vol. 32, No. 4, pp. 646-652 (April 1961).

R. Meyer, et al., "Recent Development on "Microtips" Display at LETI", Technical Digest of IVMC 91, Nagahama, pp. 6-9 (1991).--

Column 2,
Line 57, "applying," should read -- applying --.

Column 4,
Line 59, "at serious" should read -- as serious --.

Column 12,
Line 33, "1010 FIGS." should read -- 1010 shown in FIGS.. --.

UNITED STATES PATENT AND TRADEMARK OFFICE

CERTIFICATE OF CORRECTION

PATENT NO. : 6,420,824 B1
DATED : July 16, 2002
INVENTOR(S) : Naoto Abe et al.

It is certified that error appears in the above-identified patent and that said Letters Patent is hereby corrected as shown below:

Column 20,
Line 17, "electrons-emitted" should read -- electrons emitted --.

Column 22,
Line 24, "based." should read -- base. --.

Column 23,
Line 51, "positions, in" should read -- positions in --.

Column 26,
Line 33, "ATV" should read -- A TV --.

Column 29,
Line 35, "now-be" should read -- now be --.
Line 36, "specific," should read -- specific --.
Line 45, "must to" should read -- must --.

Column 30,
Line 54, "$D_{x1}$~$D_{xm}$, $D_{y1}$,~$D_{yn}$" should read -- Dx1~DxM, Dy1~DyN --.
Line 59, "$D_{y1}$~$D_{ym}$" should read -- Dy1~DyN --.

Column 32,
Line 66, "used" should read -- use --.

Column 33,
Line 36, "substrate-surface" should read -- substrate surface --.
Line 39, "oralloys" should read -- or alloys --.

UNITED STATES PATENT AND TRADEMARK OFFICE

CERTIFICATE OF CORRECTION

PATENT NO. : 6,420,824 B1
DATED : July 16, 2002
INVENTOR(S) : Naoto Abe et al.

It is certified that error appears in the above-identified patent and that said Letters Patent is hereby corrected as shown below:

Column 35,
Line 18, "element-electrode" should read -- element electrode --.
Line 20, "sputtering." should read -- sputtering.) --.

Column 37,
Line 12, "le" should read -- Ie --.

Signed and Sealed this

Eighth Day of July, 2003

JAMES E. ROGAN
*Director of the United States Patent and Trademark Office*